US011044971B2

(12) United States Patent
Buick

(10) Patent No.: US 11,044,971 B2
(45) Date of Patent: Jun. 29, 2021

(54) FACETED GEMSTONE FOR FOCAL POINT ILLUMINATION AND METHOD OF MAKING FACETED GEMSTONE

(71) Applicant: Brian D. Buick, Moraga, CA (US)

(72) Inventor: Brian D. Buick, Moraga, CA (US)

( * ) Notice: Subject to any disclaimer, the term of this patent is extended or adjusted under 35 U.S.C. 154(b) by 129 days.

(21) Appl. No.: 16/448,958

(22) Filed: Jun. 21, 2019

(65) Prior Publication Data

US 2020/0008544 A1 Jan. 9, 2020

Related U.S. Application Data

(60) Provisional application No. 62/694,307, filed on Jul. 5, 2018.

(51) Int. Cl.
*A44C 17/00* (2006.01)

(52) U.S. Cl.
CPC ..... *A44C 17/001* (2013.01)

(58) Field of Classification Search
CPC ... A44C 17/001; A44C 17/006; A44C 17/007; A44C 17/008; A44C 17/005; A44C 17/00; A44C 17/002
USPC ..... 63/26, 28, 32
See application file for complete search history.

(56) References Cited

U.S. PATENT DOCUMENTS

| | | | | |
|---|---|---|---|---|
| 1,005,564 | A | 10/1911 | Lightbody | |
| 1,319,251 | A | 10/1919 | Schless | |
| 2,081,483 | A | 5/1937 | Haltom | |
| 2,270,210 | A | 1/1942 | Barbieri | |
| 2,511,510 | A | 6/1950 | Mukai | |
| 2,982,058 | A | 5/1961 | Maitenaz | |
| 3,420,005 | A | 1/1969 | Moppett | |
| 3,742,731 | A | 7/1973 | Phillips et al. | |
| 3,835,665 | A | 9/1974 | Kitchel | |
| 3,898,869 | A * | 8/1975 | Reneer | A44C 17/02 63/15 |
| 4,201,018 | A | 5/1980 | Pool | |
| 4,686,795 | A | 8/1987 | Colliva | |
| 5,003,791 | A | 4/1991 | Colliva | |
| 5,044,123 | A | 9/1991 | Hoffman | |
| 5,090,216 | A | 2/1992 | Waugh | |
| 5,722,261 | A | 3/1998 | Lehrer | |

(Continued)

FOREIGN PATENT DOCUMENTS

| | | | |
|---|---|---|---|
| CN | 2744536 | Y | 12/2005 |
| DE | 2552996 | A1 | 6/1977 |

(Continued)

OTHER PUBLICATIONS

ConcaveGems.com "What is Concave Faceting?" (2003) (available at: http://www.concavegems.com/concave.html).

(Continued)

*Primary Examiner* — Jack W Lavinder
(74) *Attorney, Agent, or Firm* — Leydig, Voit & Mayer, Ltd.

(57) ABSTRACT

Embodiments of the disclosure provide a gemstone, jewelry piece, and method for faceting a gemstone. The gemstone, includes: a top portion having a spheroidal surface, the spheroidal surface acting as a refractive surface for light incident on the top portion of the gemstone and focal point lens originator; and a bottom portion shaped as a cone, the cone acting as a light axis to form a focal point on a reflective surface at a base of the gemstone.

18 Claims, 66 Drawing Sheets

(56) References Cited

U.S. PATENT DOCUMENTS

| | | | | |
|---|---|---|---|---|
| 6,006,548 | A | 12/1999 | Freilich | |
| 6,761,044 | B2 | 7/2004 | Samuels | |
| D619,037 | S * | 7/2010 | Wilheim | D11/90 |
| 8,033,136 | B2 * | 10/2011 | Maltezos | A44C 17/001 63/32 |
| D764,963 | S * | 8/2016 | Loinger | D11/90 |
| D890,623 | S * | 7/2020 | Paikin | D11/90 |
| 2003/0145623 | A1 | 8/2003 | Yaskil et al. | |
| 2003/0192346 | A1 | 10/2003 | Samuels | |
| 2004/0083757 | A1 * | 5/2004 | Ruth | A44C 17/002 63/26 |
| 2005/0000246 | A1 * | 1/2005 | Brookshire | A44C 17/001 63/32 |
| 2005/0000405 | A1 * | 1/2005 | Brookshire | A44C 17/00 117/68 |
| 2016/0232432 | A1 * | 8/2016 | Regev | G06K 9/6202 |

FOREIGN PATENT DOCUMENTS

| | | | | |
|---|---|---|---|---|
| DE | 19706573 | A | 9/1998 | |
| FR | 960494 | A * | 4/1950 | A44C 17/0275 |
| GB | 634227 | A * | 3/1950 | A44C 17/02 |
| JP | H04131300 | A | 5/1992 | |
| JP | 2015043954 | A | 3/2015 | |
| SU | 1466691 | A1 | 3/1989 | |
| SU | 1570704 | A1 | 6/1990 | |

OTHER PUBLICATIONS

JewelryPoint.com "Cuts & Shapes of Diamonds and Gemstones" (Nov. 8, 2013) (available at: https://web.archive.org/web/20131108025549/https://www.jewelrypoint.com/cuts-shapes-of-diamonds-and-gemstones/).

GemSelect.com "Why are Some Gems Cut as Cabochons?" (Mar. 23, 2015) (available at: https://web.archive.org/web/20150323013100/https://www.gemselect.com/other-info/why-cabochons.php).

Dyer, John, "A Superior Cut," Jewellery Business, Canada's Jewellery Magazine (Jun. 2009) (available at: https://www.johndyergems.com/jewellerybusiness.html).

SPIE, "Ball Lens," Optipedia, SPIE Press (Mar. 6, 2017) (available at: https://web.archive.org/web/20170306213316/https://spie.org/publications/tt48_54_ball_lens).

HyperPhysics, "Principal Focal Length" (May 6, 2016) (available at: https://web.archive.org/web/20160506185942/http://hyperphysicis.phy-astr.gsu.edu:80/hbase/geoopt/foclen.html).

Arem, Joel E. "Gems and Jewelry," Geosciences Press Inc., 2nd Edition, pp. 11, 13-14, 27 (1992).

Wikipedia. "Diamond Cutting" (Jun. 24, 2016) (available at: https://web.archive.org/web/20160624041718/https://en.wikipedia.org/wiki/Diamond_cutting).

RefractiveIndex.info. "Refractive index database," Liquids—Water (H20) May 28, 2016) (available at: https://web.archive.org/web/20160528194829/https://refractiveindex.info/?shelf=3d&book=liquids&page=water).

Cipriani, et al. "Gems and Precious Stones," Simon and Schuster, Inc., New York, pp. 61-63 (1986).

Massachusetts Institute of Technology. "Capillarity and Gravity," Non-Newtonian Fluid Dynamics Research Group (Jul. 3, 2006) (available at: https://web.archive.org/web/20060703175416/http://web.mit.edu/nnf/education/wettability/gravity.html).

The Physics Classroom. "Reflection, Refraction, and Diffraction," Physics Tutorial, Waves—Lesson 3—Behavior of Waves (Jan. 31, 2014) (available at: https://web.archive.org/web/20140131164923/http://www.physicsclassroom.com:80/class/waves/Lesson-3/Reflection,-Refraction,-and-Diffraction).

The New Encyclopedia Britanica, Inc. "Optics," Fifteenth Edition, vol. 25, pp. 212-213 (1993).

Nesse, William D. "Introduction to Optical Mineralogy," Oxford University Press, Second Edition, pp. 4, 5, 7-9 (1991).

International Search Report and Written Opinion issued in PCT/US2019/038674, dated Sep. 26, 2019 (9 pages).

Edmund Optics, "Understanding Ball Lenses," (available at: https://www.edmundoptics.com/knowledge-center/application-notes/optics/understanding-ball-lenses/) (May 14, 2013).

* cited by examiner

FACETED GEMSTONE FOR FOCAL POINT ILLUMINATION AND METHOD OF MAKING FACETED GEMSTONE

CROSS-REFERENCE TO RELATED APPLICATIONS

This application claims priority to U.S. Provisional Application No. 62/694,307, filed on Jul. 5, 2018, which is hereby incorporated by reference in its entirety.

BACKGROUND

Flat faceted gemstones have limited refraction and reflection with little further improvement of a gem's beauty. A trade-off between color, brightness, and style of cut in the flat faceted gem is a juggling act. Many "round brilliant" gemstones are disappointing, for example, in the lack and saturation of color from all its 58 flat facets. The gemstone industry has failed to provide beautiful alternatives to flat-faceted gemstones, such as the round brilliant gemstone.

As used in the disclosure that follows and as is well known in the art, the focal length of a ball lens (f) is defined by the index of refraction (n) times the diameter (D) of the ball lens divided by four times (n−1), which can be generally expressed algebraically as:

$$f = \frac{nD}{4(n-1)}.$$

SUMMARY

One embodiment provides a gemstone, including: a top portion having a spheroidal surface, the spheroidal surface acting as a refractive surface for light incident on the top portion of the gemstone and focal point lens originator; and a bottom portion shaped as a cone, the cone acting as a light axis to form a focal point on a reflective surface at a base of the gemstone.

Another embodiment provides a jewelry piece, including: a first gemstone and a second gemstone. The first gemstone comprises: a top portion having a spheroidal surface, the spheroidal surface of the first gemstone acting as a refractive surface for light incident on the top portion of the first gemstone and focal point lens originator; and a bottom portion shaped as a cone, the cone acting as a light axis of the first gemstone to form a focal point on a reflective surface at a base of the first gemstone; wherein at least some of the light that is reflected by the base of the first gemstone enters the second gemstone to illuminate the second gemstone.

Yet another embodiment provides a method for faceting a gemstone comprising: shaping a top portion of the gemstone to have a spheroidal surface, the spheroidal surface acting as a refractive surface for light incident on the top portion of the gemstone and focal point lens originator; and shaping a bottom portion of the gemstone as a cone, the cone acting as a light axis to form a focal point on a reflective surface at a base of the gemstone.

DETAILED DESCRIPTION

Figure 1:
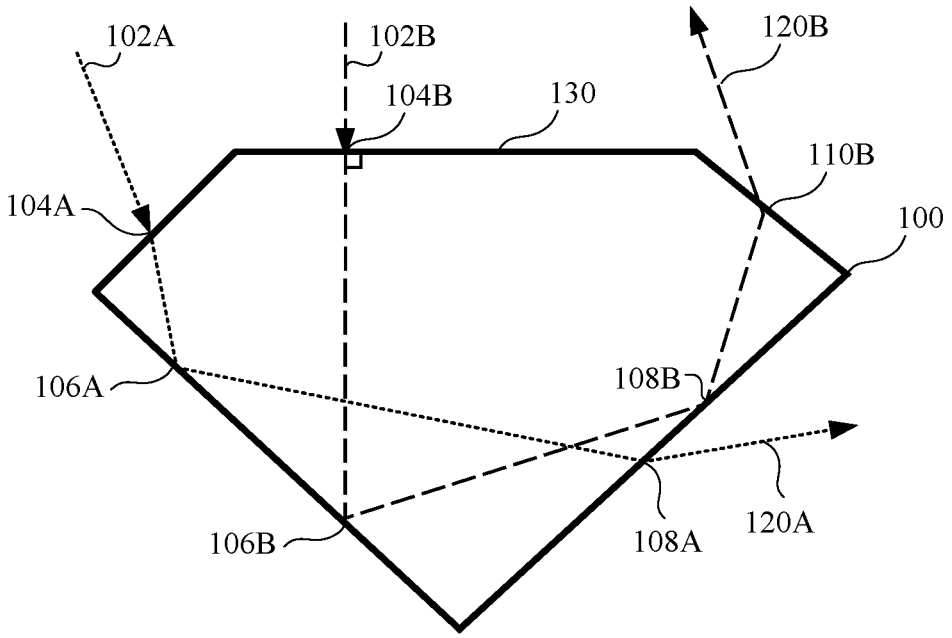
FIG. 1 (PRIOR ART)
FIG. 1 illustrates a cross-section of round brilliant cut gemstone of the prior art.

Light waves can be described as a wave phenomenon having a velocity, frequency and wavelength. Frequency (f), velocity (V) and wavelength (λ) can be related by the equation, $f=V/\lambda$. Frequency of light remains constant regardless of the material that the light travels through; hence, as velocity of light changes through a medium, wavelength changes to hold the relationship. Refraction occurs as a result of velocity changes of light traveling from one medium to another. Sunlight, often referred to as white light, includes different light wavelengths, so as a ray of sunlight hits a glass prism, the glass prism reduces the velocity of the ray of sunlight. Since sunlight is composed of multiple wavelengths, the speed of each wavelength is reduced differently resulting in separation of sunlight into separate colored rays of different wavelengths to comprise the natural visible spectrum that we see. Intensity of the brightness of the incident ray of sunlight is proportional to the square of the amplitude of the ray of sunlight.

The velocity of light depends on the nature of the material that the light travels through and the wavelength of the light. Light has a maximum possible speed of $3\times10^8$ m/sec in a vacuum and is slowed down in any other medium. The slowdown is a result of interaction between the electric vector of the light and the electronic environment around each atom in the medium, especially electrons of the atoms. In some implementations, closely packed carbon atoms in diamond cut light speed by 2.42 times.

Light bends when passing from one medium to another at an angle other than perpendicular to the boundary between the two media. The "index of refraction" or "refractive index" (n) is a measure of how effective a material is in slowing light, or bending light coming from a vacuum. The refractive index $n=(V_v)/V$, where $V_v$ is the velocity of light in a vacuum and V is the velocity of light in the material. The refractive index of a vacuum is 1.0 and for all other materials greater than 1.0. In some implementations, velocity of light in air is almost the same as the velocity in a vacuum and can be approximated as 1.0. In general, light is refracted towards the normal to the boundary on entering a material with higher refractive index and is refracted away from the normal on entering a material with lower refractive index.

Over 450 years of gemstone enhancement has resulted in spectacular gemstones with numerous flat facets that take advantage of wave properties of visible light. A compromise between color, brightness, and shape of gemstone has given, as an example, the "round brilliant" gemstone, one of many styles of cuts of gemstones. Although variations in quality still occur with the final polished result, a sparkling gem usually ensues, giving brightness and many tones of color of the natural visible spectrum from the 58 flat, mathematically precise, sparkling facets of the round brilliant cut gemstone. Present state of the art of faceting does not allow sunlight to be focused in the gemstone. Colors reflect off the gemstone's multiple flat facets to the eye of the viewer.

As described in greater detail herein, spheroidal sculpturing or faceting affects the light properties, and therefore beauty, of a gemstone in several ways. Spheroidal faceting can affect the number and saturation of colors present, increasing brightness in the gemstone, brilliance, and sparkle or scintillation on rotation. In some embodiments, combining gems in pairs dazzles both gems.

Described in this disclosure are a gemstone and methods of faceting gemstones with spheroidal gem optics that focus light rays inside or near the bottom of the gemstone and reflect colors throughout the gemstone to an outside observer. Also described in this disclosure are enhanced surface structures (e.g., external shapes and other surface features) that cause refraction and reflection in gemstones. Also described in this disclosure are methods of enhancing refraction and reflection in gemstones. Also described in this disclosure are methods to capture and reflect focused colorful rays and brightness for an outside observer, such that the rays of light exhibit a lessor amount of leakage, following a shortest, most direct path while traveling into, through and exiting the gemstone to the outside observer.

According to various embodiments, using the laws of refraction and reflection applied to spheroidal shapes, gemstones and gem materials can be faceted to exhibit more saturated and numerous, longer-lasting spectral colors, intense illumination, greater brilliance, and enhanced scintillation. Additionally, using gem materials with relatively higher refractive indices can achieve even greater results. For example, diamond has a refractive index of 2.417 and a dispersion of 0.044. In some embodiments, faceted spheroidal diamonds have more numerous saturated colors than faceted diamonds of the present state of the art.

FIG. 1 illustrates a cross-section of a round brilliant cut gemstone 100 of the prior art. The round brilliant cut gemstone 100 may be a diamond with refractive index of 2.417. The crossection shown in FIG. 1 illustrates incoming light rays 102A, 102B incident on the gemstone 100. Light ray 102A is refracted as it enters the gemstone 100 at location 104A. In the example shown, light ray 102B is perpendicular to a top surface 130 (i.e., table) of the gemstone 100, and is thus not refracted when it intersects the gemstone at location 104B. Light rays originating or continuing from locations 104A, 104B are reflected at locations 106A, 106B, respectively, on an oppostise (i.e., bottom) side of the gemstone 100 from the side (i.e., top) of the incident light rays 102A, 102B. After the light ray reflects from location 106A, the light ray intersects the gemstone 100 again at location 108A, where the light ray is refracted and exits the gemstone 100 as light ray 120A. After the light ray reflects from location 106B, the light ray intersects the gemstone 100 again at location 108B, where the light ray is reflected once more, and intersects the gemstone 100 a third time at location 110B, and then refracts on exiting the gemstone 100 as light ray 120B. It should be understood that at each interaction of the light rays with a boundary of the gemstone, some light may be reflected and some light may be refracted based on the Fresnel equations. For purposes of illustration, the primary interaction (i.e., reflection or refraction) is illustrated in FIG. 1 for each intersection with the gemstone boundary.

In FIG. 1, some incident light (e.g., sunlight) refracts on entering the gemstone 100 an an angle relative to the surface normal of the facet that the light ray intersects. Angled facets of the crown (i.e., top) of the gemstone 100 refract the incident light into colored rays. Incident light that enters the table of the gemstone 100 perpendicular to the table is not refracted (e.g., incident light ray 102B). Colored rays and unrefracted sunlight then reflect off two pavilion facets and refract a second time on exiting the gemstone 100. Unrefracted incident sunlight may refract upon exiting the gemstone 100 into colored rays. Refracted colored rays leave the crown and reflect off adjacent facets to the observer. The tone of colors of the return light may vary, with many flat facets absent of color at any position. Other flat facets on the crown of the gemstone overpower with brilliant color. However, some incident light will leak out the bottom of the gemstone 100 and not return to the viewer, such as light ray 120A. Such light leakage may result in a darker area in the gemstone and less "sparkle."

Figure 2A:
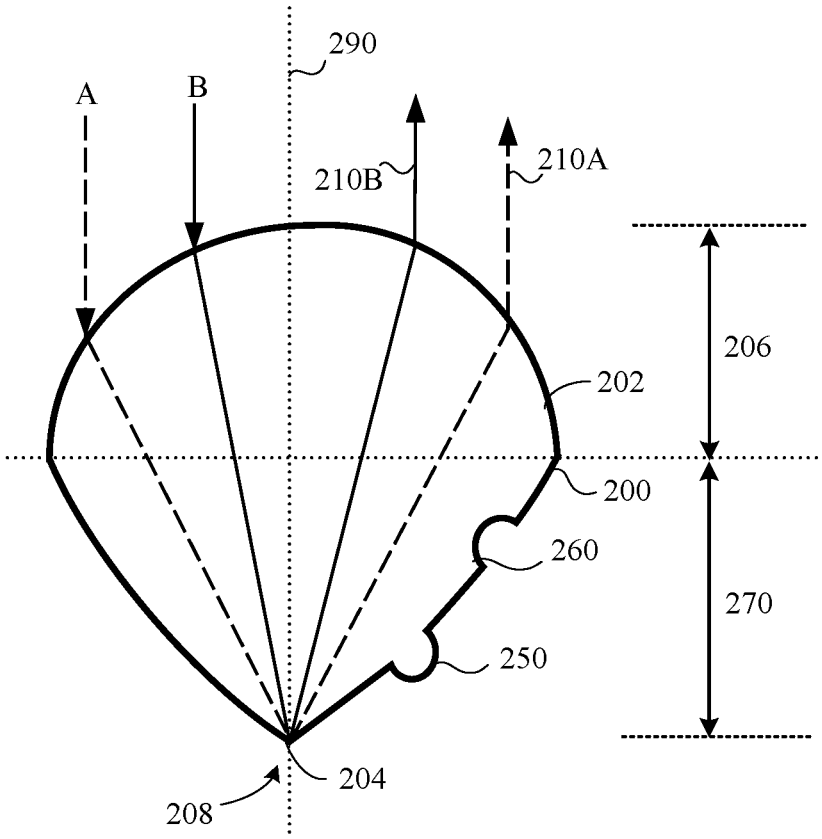
FIGS. 2A-2B illustrate a cross-section of a focal point brilliant spheroidal faceted gemstone according to various embodiments of the disclosure.

In comparision, FIG. 2A illustrates a cross-section of a focal point brilliant spheroidal faceted gemstone 200 for self-illumination according to an embodiment of the disclosure. In one embodiment, the spheroidal faceted gemstone 200 of FIG. 2A can be a zircon with refractive index of 2.00. In other embodiments, the gemstone 200 may be of any transparent or semitransparent material, including diamond. The cross-section of of the gemstone 200 shows that the gemstone 200 has a spheroidal surface 202 at the top 206 (crown) of the gemstone 200 that refracts incoming light rays A, B to a focal point 204 at the bottom 208 of the gemstone 200 (culet). At the bottom 208 of the gemstone 200, colored rays and sunlight at the focal point 204 are reflected back towards the spheroidal surface 202 and then out of the gemstone 200 as colored light rays 210A, 210B. In one embodiment, the bottom 208 of the gemstone is a sharp point, as shown in FIG. 2A. In another embodiment, the bottom 208 of the gemstone is a small flat facet (culet). In another embodiment, the bottom 208 of the gemstone approximates a slightly rounded surface with a series of small flat facets. In other embodiments, the bottom 208 of the gemstone can have any shape.

The spheroidal gemstone 200 of FIG. 2A causes incident light that enters the gemstone parallel to a light axis 290 to focus to a focal point or area inside the gemstone 200, on the bottom surface of the gemstone 200, or just outside the bottom surface the gemstone 200 (e.g., a mother-daughter pairing, as discussed below), depending on depth of the gemstone and the refractive index of the gemstone. It should be understood that in various implementations, the focal "point" can be a singular point or an area.

Figure 2B:
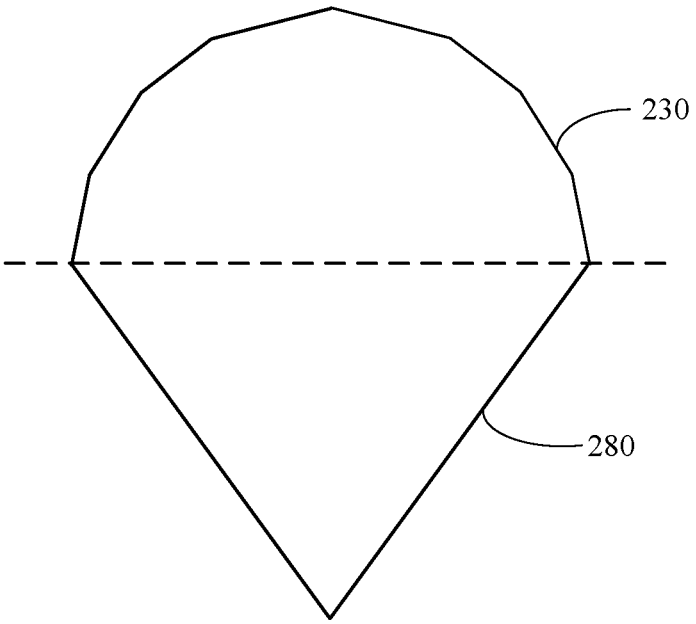

The shape of the gemstone 200 can also vary based on the refractive index of the gem material. For example, the shape of the gem may be cut to be similar to that of an American football shape, for example, i.e., greater than spheroidal. The design of the gem can be configured such that the focal point 204 is within the gem to reflect from facets or basins at the bottom of the gem. According to various embodiments, the spheroidal faceted gemstone can be designed with numerous reflective facets at the bottom of the gem that show brilliant, saturated colors of the visible light spectrum, from red to violet, in any position of the gemstone. In some embodiments, the spheroidal surface 202 is rounded, e.g., polished rounded surface. The polished rounded surface may have a mirror-like finish, in some implementations. In other embodiments, the spheroidal surface is formed of small flat facets that can approximate a rounded shape, as shown in FIG. 2B. The top portion 230 of the gemstone in FIG. 2B includes a series of flat facets that approximate a hemisphere shape. In one embodiment, the top portion 230 may comprise flat facets, except for one rounded facet in the center (table) of the gemstone. The bottom portion 280 of the gemstone in FIG. 2B includes a series of flat facets that approximates a cone, e.g., can be similar to a conventional round brilliant pavilion with a sharp point.

The disclosed spheroidal gemstone is empowered by the much-increased intensity of light reflecting from the focal point 204 of its gemstone as it sweeps across the lower half (relative to the orientation shown in FIGS. 2A-2B) of the gemstone on rotation of the gemstone. In some embodiments, such "self-illumination" focal point brilliant spheroidal gemstone can reach 180 diopters in lens power for a diamond.

In some embodiments, reflective basins 250, 260 can be included in the gemstone 200. The reflective basins 250, 260 can be along the side of the pavillion (as shown), or may be closer to the bottom 208 of the gemstone 200, in various implementations. The amount of reflected light back to the observer depends on the refractive index of the gemstone material and cut of the gem forming a focal point to self-illuminate the reflective facets and/or the reflective basins 250, 260 at the gemstone's base. According to various embodiments, the reflective basin can be convex (e.g., reflective basin 250), concave (e.g., reflective basin 260), or have any other shape, e.g., flat. In some embodiments, the reflective basins 250, 260 may be etches made into flat facets. For example, the flat facets can have any shape, including square, triangle, rectangle, hexagon, diamond, or any other shape. Curved facets can also have any shape, including concave or convex shapes, as shown in FIGS. 2A-2B.

Light interaction with the spheroidal faceted gemstones of FIGS. 2A-2B is different than light interaction with a conventional round brilliant gemstone, such as shown in FIG. 1. With the disclosed spheroidal faceted gemstones, sunlight refracts into colored rays and unrefracted light upon entering the gemstone. In various embodiments, the spheroidal crown acts like a convex lens to form a focal point at or near the base of the gemstone. Intense colored rays and/or unrefracted sunlight refract on exiting the gemstone. In some embodiments, flat facets on the crown (and pavilion) of the spheroidal faceted gemstones act as a small prism to create a visible light spectrum with consistent sequences of red, orange, yellow, green, blue, and violet colors. In some implementations, this visible light spectrum may be observed on each flat facet when the gemstone is turned slowly. This spectrum of visible light colors may also be observed on a darker background around the intensely illuminated spheroidal faceted gemstones (with focal point created at or near the base). In some implementations, the gemstone crown may have a few hundred facets on the hemispheric surface, where each flat facet may be at a slightly different angle to the refracted sunlight and, thus, displays a different spectral color. The observer of the gemstone then sees random colors from the spectrum of colors that each flat facet displays.

Described herein is a new method of gem creation (or gem cutting) to improve the beauty of gemstones and gem materials by increasing the saturation of colors, the duration over which colors are observed in a gemstone as it is rotated, greater brightness, more numerous colors observed at one time, and many colors of the visible spectrum occurring with one position of the gemstone, in some embodiments. For example, each facet's reflection may contain all colors of the natural visible spectrum. New spectral color patterns and gem designs may occur due to enhanced spheroidal optics employed, as described in greater detail herein.

The spheroidal shape of the top of the gem and adjoining connected curvilinear surfaces act as a convex lens to focus the rays and brightness at or near the base of the gem. Basins included at the bottom of the gem are illuminated by this focused light. Light that reflect from said basins forms saturated color patterns and ultra-brightness for illuminating the gemstone. In some embodiments, light rays that enter the gemstone are reflected only a single time in the gemstone before exiting the gemstone (as opposed to the typical two or more reflections that occur in a round brilliant cut diamond), and thus have a shorter path to travel than flat faceting. Also, conventional gem cuts with multiple reflections within the gemstone may cause loss of light intensity. By providing a single reflection point or surface and shorter path for the light rays to travel, embodiments of the disclosure create ultra-brightness and brilliant colors radiating from the spheroidal gemstone. In some cases, longer lasting, rich colors are observed on rotation of the spheroidal gem, unrestricted by the need for connecting prisms, which cause chopped-off natural visible spectra, as in flat faceting of conventional gems. According to embodiments of the disclosure, the new, saturated colors and 3-D (three-dimensional) brilliance of gemstones simulate a celestial experience and are a wonder to behold.

The spheroidal shape of the top/crown of the gemstone 200 acts as a convex lens to focus the refracted colored rays and sunlight to a focal point at or near the base, which in turn reflects, only a single time, to cause intense colors and light to the observer. With this and other added enhancements described below, gems with unusually rich color patterns and unique designs may be created. In some embodiments, the spheroidal-shaped gemstone can include flat faceting to approximate spheroidal (i.e., curved) faceting.

Embodiments of the disclosure provide saturated colors with greater lasting duration in a gem as it is rotated, in addition to more sparkle in the gem to attract the eye. The disclosed embodiments allow for all the colors of the natural visible spectrum to be present at the same time. In some embodiments, the base of the gemstone may be painted with color, e.g., pastel or vivid "electric-light" colors, that sweep across the gem's basin, which may remain radiant on rotation of the gem.

In one embodiment, top portion 206, 230 of a spheroidal gemstone in FIGS. 2A, 2B can be formed similar to a surface ball lens. For a ball lens, the focal length can be described as a function of the refractive index of the ball lens and its diameter. The gemstone can be designed with overall spheroidal features that give an intense focal point in the gemstone 200. In such a case, the focal point distance can be used to illuminate the base and/or reflective facets or reflective basins at this distance in the lower half of the gemstone, opposite to the incoming sunlight incident on the upper half (i.e., top 206) of the gemstone 200, as shown in FIG. 2A. This combination of new optical features (i.e., spheroidal gem design and formation of an intense focal point in the gemstone), transforms the gem material into a unique, shockingly beautiful gemstone.

Spheroidal gemstones, according to some embodiments of the disclosure, utilize a focal point for intense optical self-illumination giving more saturated tones of color, sparkle, and brightness from the base and/or reflective facets or small reflective basins. In some implementations, this creates a new internal source of light illumination in the gemstone (i.e., the focal point) and a new light intensity design dimension (LIDD) to consider for creation of beautifully different colored gem designs. LIDD is an intricate physical design of a gemstone and the facet arrangement and location on the gemstone that will govern the intensity of the refracted and reflected colors, brightness of the gemstone, and scintillation on rotation seen by the observer. LIDD also pertains to very small segments within the gemstone with special color or optical properties, highlighting in part, physical design or certain artistic features, and also mother-daughter pairs and adjacent gemstones.

In an embodiment, the distance from the center of a spheroidal gemstone to its focal point, that is, the focal length 270 of the gem, indicates where the reflective facets of a spheroidal gem should be located at the lower half of the gem, opposite to the incoming light. The location of facets at the focal point 204 results in self-illumination of the gemstone's facets, improved resolution of saturated colors, greater brilliancy of the gemstone packed into a small point or area. In some embodiments, two or more spheroidal gemstones can be arranged together (as described in greater detail herein), where a first gemstone imparts increased light illumination into a second gemstone, and the second gemstone reciprocates with additional color, body color, and sparkle (if a pair). Spheroidal gemstones may exhibit unusual spectral color patterns including: sparking rainbows, multicolored spectral basins, northern lights, rising and setting colored suns, pastel-colored gems, internal pinpoint spectral rays, and colored bands. In some implementations, the disclosed design for a spheroidal gemstone that self-illuminates by forming a focal point within or near the base of the gemstone are also applicable to reflective signs, billboards, road markers, etc.

Figure 3A:
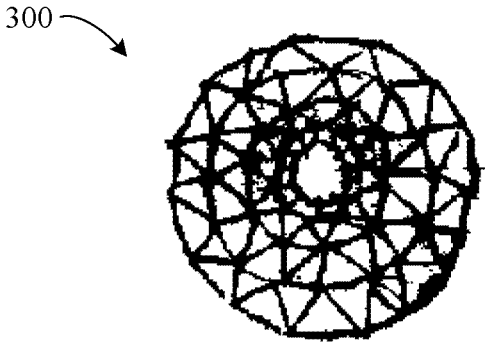
FIGS. 3A-3C illustrate views of a focal point brilliant spheroidal gemstone according to an embodiment of the disclosure.
Figure 3B:
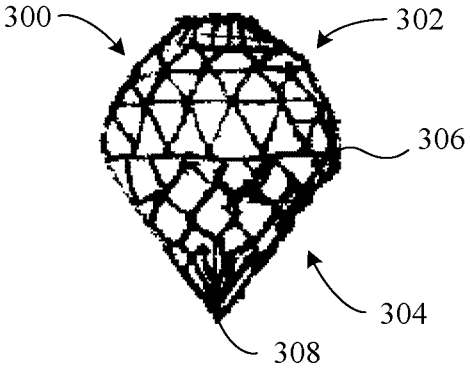
Figure 3C:
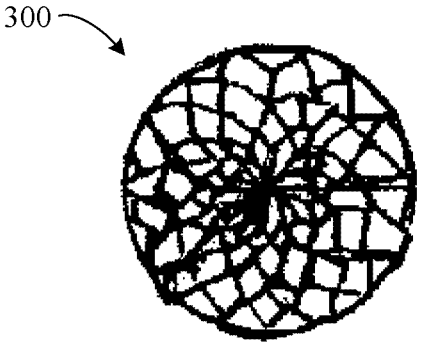

In some embodiments, small flat facets can be used to approximate a spheroidal shape. These small flat facets can be effectively spaced as small reflective basins. FIGS. 3A-C illustrate views of a focal point brilliant spheroidal gemstone for self-illumination according to an embodiment of the disclosure. FIG. 3A illustrates a top view of the spheroidal gemstone 300 showing a small table center surrounded by twelve (12) beveled facets in a first row. Surrounding the 12 beveled facets are three rows of triangles, each row of triangles increasing in size as a function of the distance from the small table center. FIG. 3B illustrates a side view of the spheroidal gemstone 300 of FIG. 3A. The side view shows that the spheroidal gemstone 300 has a hemispehrical shaped crown 302 and a cone shaped pavilion 304. The side view shows that the three rows of triangles increase in size until the girdle 306 of the spheroidal gemstone 300. The cone shaped pavilion 304 includes elongated diamond-shaped facets that decrease in size from the girdle 306 of the spheroidal gemstone 300 to its culet 308. At the base of the spheroidal gemstone, sixteen (16) elongated facets terminate at its culet 308. FIG. 3C illustrates a bottom view of the spheroidal gemstone 300. The 16 facets at the culet 308 are shown to be small, elongated and diamond-like in shape.

The gemstone design and dimensions in FIGS. 3A-C is provided as an example approximation to a spheroidal shaped gem. The small table center can be surrounded by more than 12 or less than 12 beveled facets, according to various embodiments. In addition, more than three rows of triangles may surround the beveled facets, according to various embodiments. Additionally, the elongated facets at the culet may be more than or less than 16, according to various embodiments.

Figure 4A:
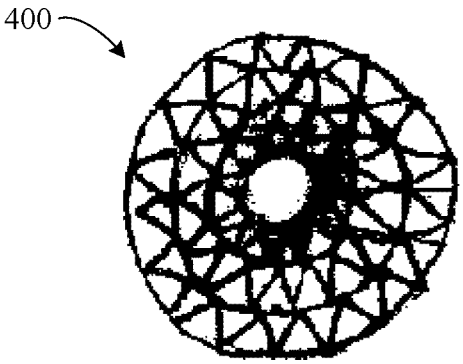
FIGS. 4A-4C illustrate views of a spheroidal gemstone according to an embodiment of the disclosure.
Figure 4B:
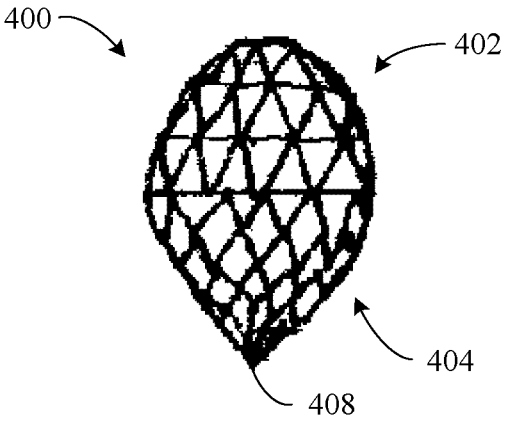
Figure 4C:
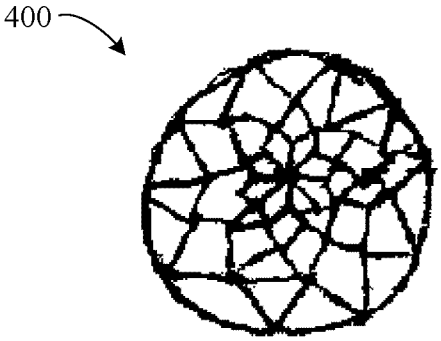

FIGS. 4A-C illustrate views of a focal point brilliant spheroidal gemstone 400 according to an embodiment of the disclosure. FIG. 4A illustrates a top view of the spheroidal gemstone 400 showing a small table center surrounded by twelve (12) triangular facets in a first row. Surrounding the 12 triangular facets are two rows of triangles, each row of triangles increasing in size as a function of the distance from the small table center. FIG. 4B illustrates a side view of the spheroidal gemstone 400 of FIG. 4A, showing a hemispheroidally shaped crown 402 with a slightly cone shaped bottom 404. The slightly cone shaped bottom 404 includes diamond-shaped facets that decrease in size from the girdle of the spheroidal gemstone. At the base of the spheroidal gemstone 400, eight (8) elongated facets terminate at its culet 408. FIG. 4C illustrates a bottom view of the spheroidal gemstone 400. The 8 facets at the culet 408 are shown to be small, elongated and diamond-like in shape. The numbers of facets at each row of facets discussed above with respect to FIGS. 4A-C are provided as examples.

Figure 5:
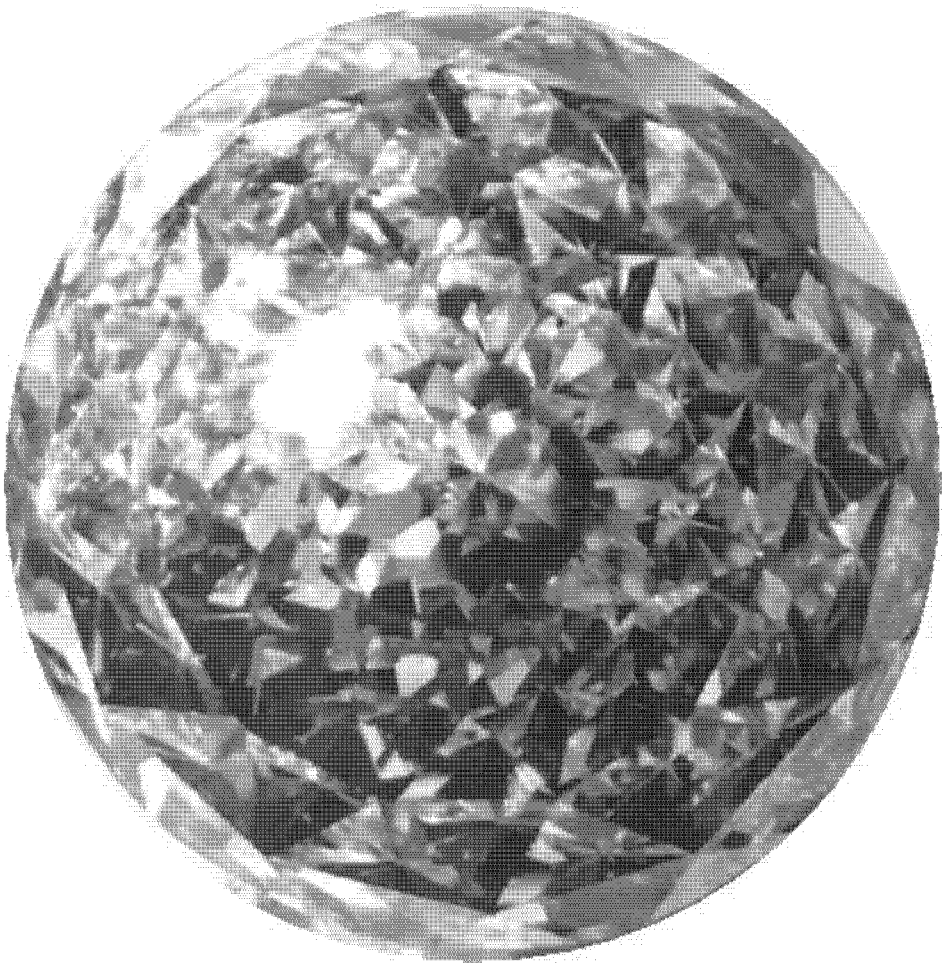
FIG. 5 is an example of a faceted spheroidal gemstone according to the embodiment of FIG. 3A.

As previously discussed, a lens has a focal length. The inverse of the focal length is called the lens strength or lens power and is measured in diopters. That is, lens power in diopters (P) is provided by P=1/focal length (f) in meters. As an example, a 13.0 mm diameter diamond with a focal length of 5.544 mm (measured from the center of a spheroidal gem) is P=1/0.005544 meters. The lens power of this spheroidal gem is 180 diopters in strength but will vary with the refractive index of the gem material. An ordinary gemstone receives unfocused sunlight to illuminate the gemstone; by contrast, focusing of the light at a focal point such that it reflect back out the top of the gemstone (i.e., so-called "self-illumination") occurs with spheroidal gemstones that are cut according to the present disclosure. Embodiments of the disclosure result in numerous intensely saturated spectral colors and, on rotation of the gemstone, shocking scintillation and enhanced brightness throughout the gemstone. In some embodiments, regions of color in the gemstone may be smaller in size, but have greater saturation of color, more numerous in occurrence, and much more intense in illumination compared to conventional gemstones. An example of a spheroidal gemstone, according to an embodiment of the disclosure, showing enhanced brightness and saturation of color is provided in FIG. 5.

In some embodiments, gemstone material is faceted into other spheroidal shapes besides ball lens shapes. These spheroidal shapes may include pear, oval, marquise, heart, hexagonal, trilliant, briolette shapes, each having a focal point and self-illumination of basal facets.

In some embodiments, darker gem materials (for example, smoky quartz) may be faceted to become self-illuminated (i.e., by a focal point) so as to be more adaptive as gemstones. Also, in some embodiments, cabochons may sparkle with color and brighten intensely with the disclosed focal point brilliant design (i.e., with a more spheroidal crown and a deeper pavilion).

Embodiments of the disclosure can be used to facet spheroidal gemstones to provide: (1) an increasing number of colors occurring in the gemstone; (2) longer lasting colors on gem rotation; (3) all colors of the natural visible spectrum displayed at one time; (4) saturated tones of color compared to flat faceted gemstones; (5) finer colors occur but much more intense; and (6) colors caused by refraction on entering the gemstone's spheroidal upper surface, and reflection of refracted colors and light from the gemstone's lower surface to all or a subset of facets on the gemstone.

Embodiments of the disclosure provide spheroidal faceting that creates centers of enhanced refraction in the top half of a gemstone (i.e., above the girdle) and areas of reflection at the bottom half of the gemstone. The enhanced refraction to a focal point within or at the base of the gemstone provides for additional color formation in the gemstone, and together with enhanced reflective basins in the lower half of the gemstone, these colors are reflected back to an observer providing a further increase in number of colors, saturation, and brightness that the observer receives from the gemstone. The spheroidal faceting according to embodiments of the disclosure provides self-illumination of enhanced reflective basins by beams of colored rays and, when combined with un-refracted sunlight, causes even stronger colors and brightness throughout the spheroidal gemstone that, in turn, radiates to the observer on rotation of the gemstone. Also, if the base of the gemstone is darkened on its underlying surface, a transparent gemstone will show a better color contrast and even faint colors (e.g., yellows and pinks) can be better seen in strong sunlight.

In an embodiment, a major axis of light illumination of a spheroidal gemstone can be made longer or shorter to accommodate the focal length of the gemstone to be inside the gemstone so that the focal point can self-illuminate reflective facets or reflective basins at the base of the gem on rotation with intense focal point light. Bright, rich colors with intense gem brightness and dazzling scintillation on rotation provide for more radiant gemstones. Embodiments of the disclosure include spheroidal optic features for multiple styles of gem cuts designed into the external surface of the gemstone, which enhance refraction and reflection. This gives more numerous, brighter, saturated, and longer-lasting spectral colors in the gemstone with different designs than in conventional art.

In some embodiments, colors reflect from various shaped and sized facets on the lower half of a spheroidal gemstones. In some embodiments, numerous reflective facets show brilliant, saturated colors of both individual and rainbow designs of the visible spectrum in any position of the gemstone. In some embodiments, all colors in the visible spectrum may occur, ranging from violet to red.

In some embodiments, a gem with dual pair of refractive features on the top surface of the gem and approximately diagonally opposite reflective basin designs, sculptured around the bottom half of the gemstone, may exhibit spectacular continuous color on rotation. The spectral colors caused by refractive features faceted into the top half of the gemstone's surface, and the reflective basins and surfaces and optic-ornamental designs faceted into diagonally opposite positions into the lower half of the gemstone give increased spectral patterns of bright, saturated colors and new unique designs, which may be seen through the top half of the gemstone.

Optic-ornamental designs of gemstones according to embodiments of the disclosure may include, but are not limited to: a flower, a bird, an animal, a fish, a flag, a map, a picture, a letter, a number, a symbol, a word, a phrase, an emblem, one or more initials, a name, a country, a location, and/or a logo, etc. For surface features enhancing refraction, the gemstone may be faceted with an overall spheroid or rounded cone shape with additional convex lens-like features, which may include: hemispheres, mushroom shapes, domes, ridges, spheroidal pentagonal polished facets and concave-like dimples, and small caldera structures.

In some embodiments, the addition of horizontal and/or vertical rounded bands or grooves around the top half of the gemstone, the mid-section, and/or near the base of the gemstone also enhance refraction in the gemstone.

Prominent colors in gemstones sculptured or faceted according to embodiments of the disclosure are created by, but not limited to: (1) refraction and a convex focused lens effect of the overall enhanced spheroidal gem and many other spheroidal surface features, (2) reflection from flat facets, (3) pin-point internal focused colored rays similar to water waves focusing before a parabolic barrier, (4) prism effect due to varying thickness of gem material in the gemstone, and (5) light interference effects of spectra.

Some examples of surface features enhancing reflection to occur include, but are not limited to: headlight, tail light, flash light concave reflectors, including a parabolic pavilion, and curved or spheroidal facets, basins, bowls, cups, valleys, oval reflective curved surfaces (small cirques) around the bottom half, and perhaps a central dome(s) or optical ornamental display, to reflect colored light upward from the base throughout the gem. An observer, due to the overall spheroid or rounded hemisphere shape on the surface, acting as a lens at the top of the gem, may easily see these features with a 10× hand lens. Prisms of thinning gem material around gem edges can also cause bright refractive colors to appear in the gem. Additionally, in some cases, darkening the base of the gem or its underlying surface makes light colors, faint pinks and yellows, easier to be seen especially under strong sunlight.

With water waves approaching a two-dimensional parabolic barrier, the wave energy is reflected off the barrier to a point in front of the barrier before the wave energy dissipates around the focal point. As sunlight mainly exhibits wave motion, in a three-dimensional gemstone spheroid, light waves may exhibit an internal point of focus inside the walls of the gem similar to the parabolic barrier approached by water waves. This focal point may cause a beam of bright colored rays to originate from a single point inside the gem. As the gem is slowly rotated, a different color occurs adjacent to the color just observed and is the next color along a spectrum of visible light. The new bright color originates from the same area, but with a different wavelength due to a slightly different path through the gem. This is the next colored ray of a spectrum occurring at an internal focal point in the gem. Embodiments of the invention exhibit sparkling examples of colors suddenly appearing from a point within the gemstone and changing colors on rotation of the gem, give rising and setting suns of varying spectral colors.

Prominent colors in gemstones may be created by, but not limited to: refraction and a convex focused lens effect of the overall enhanced spheroidal gem and many other spheroidal surface features on it, reflected colors from enhanced basins, pin-point internal focused colored rays similar to water waves focusing before a parabolic barrier, prism effect due to varying thickness of gem material in the gemstone, and light interference effects of spectra. Other features which may create color include but are not limited to: an undulating basin surface or pin point array at the base of the basin, a ringed or dimpled basin, reflective gem walls, internal partition of borders or gem faces, one or more central domes or optical ornamental features, very small caldera-like structures, rounded horizontal and vertical bands, grooves and small parallel growth striations which imitate a colorful diffusion grid.

With the embodiments of the disclosure, sunlight is refracted on entering the gemstone's surface, strongly focused by the spheroidal crown to the focal point near its base (i.e., so-called "focal point brilliant" cut), and reflected only once inside the gem (as compared to twice for flat faceted gems, such as the round brilliant), and refracted once again on leaving the gemstone. Inexpensive non-gem materials such as glass, marbles, plastic, acrylic, plexiglass, etc., can also be faceted in spheroidal fashion as described above. In various embodiments, any non-opaque natural or man-made gem material or solid non-gem material may be used.

Possible shapes for spheroidal gemstones in addition to hemispheric/cone include transparent peeled mandarin orange or a transparent jelly donut. These two possible shapes can exhibit a bulbous top and/or bottom surface. The feature of sphericity in the gemstones of these shapes may allow formation of a focal point and self-illumination that causes enhanced reflection to occur, resulting in increased rich colors and brightness originating in the gem.

In some embodiments, spheroidal gemstones may be about as deep as they are wide. In some embodiments, small lens-like spheroids may be sculptured or faceted on the larger gem spheroid for enhanced refractive features and magnification at the top of the gem to see small gem features at the base and enhanced curved reflective basins around the base of the gemstone for brilliance and color radiance throughout the gemstone. In some embodiments, gem surfaces may exhibit a mirror-like finish which enhances refraction and reflection and adds quality of gem workmanship.

Spheroidal gemstones according to embodiments of the disclosure may reduce wastage, which can occur up to 60% during the gem cutting process. Thus, while faceting to obtain spheroidal shapes according to some embodiments of the disclosure, less gem material may be wasted than the present "V" shape of the round brilliant cut stones. In some embodiments, the weight of the spheroidal gemstones is heavier than their flat cut counterparts.

Figure 6A:
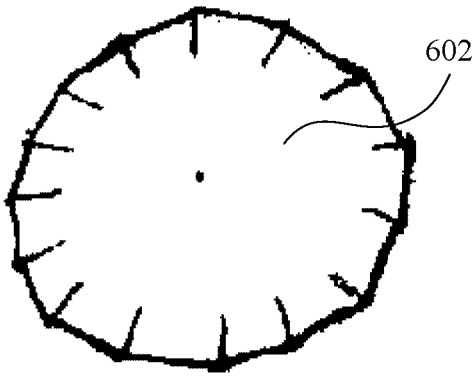
FIGS. 6A-6C illustrate views of a smooth dome hemispheric gem with slightly concave sides according to an embodiment of the disclosure.
Figure 6B:
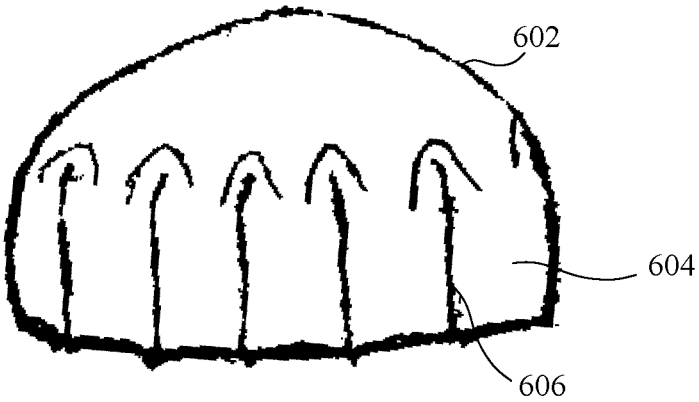
Figure 6C:
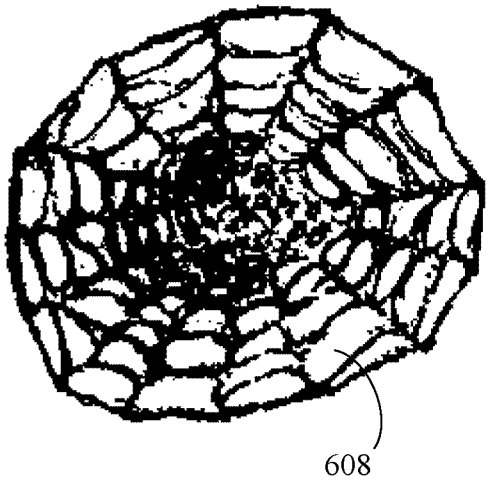

Example embodiments of spheroidal gemstones are provided in the accompanying figures. FIG. 6A illustrates a top view of a smooth dome 602 hemispheric gem with slightly concave sides 604 according to an embodiment of the disclosure. FIG. 6B illustrates a side view of the smooth dome 602 hemispheric gem showing narrow slits 606 between slightly concave sides 604 of the hemispheric gem. FIG. 6C illustrates a bottom view of the smooth dome hemispheric gem showing convex cups 608 of transparent gem material between sectors at the base of the gem.

Figure 7A:
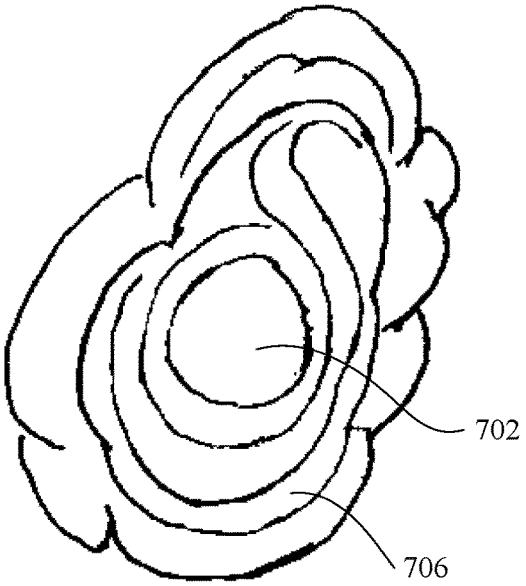
FIGS. 7A-7C illustrate views of a gem with a spheroid top according to an embodiment of the disclosure.
Figure 7B:
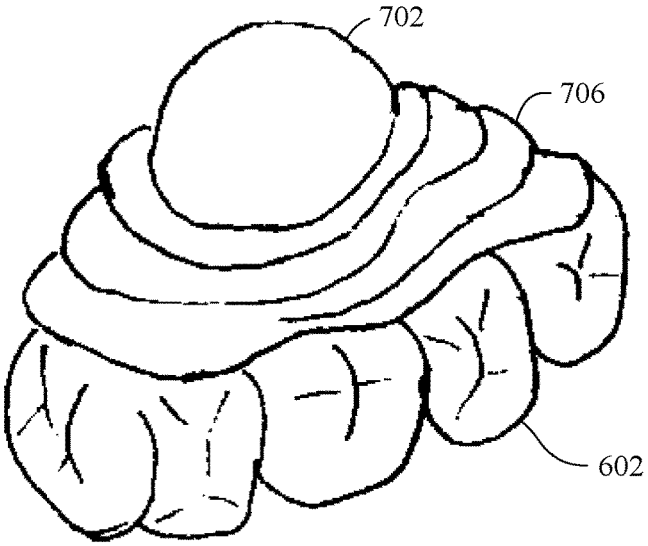
Figure 7C:
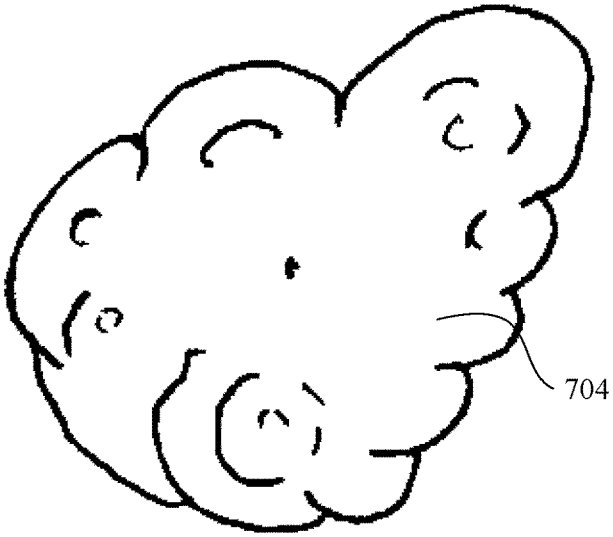

FIG. 7A illustrates a top view of a gem with a spheroid top 702 according to an embodiment of the disclosure. FIG. 7A shows that the gem includes bulbous facets 704 at the base and beveled bands 706 sloping down. FIG. 7B illustrates an oblique view of the gem with the spheroid top 702 of FIG. 7A. FIG. 7B shows that the beveled bands 706 sloping down are at the midsection of the gem, decreasing gem thickness, and the bulbous reflective basins 704 are at the base of the gem. FIG. 7C illustrates a bottom view of the gem of FIG. 7A, showing slightly convex base with bulbous reflective basins 704 exterior.

Figure 8A:
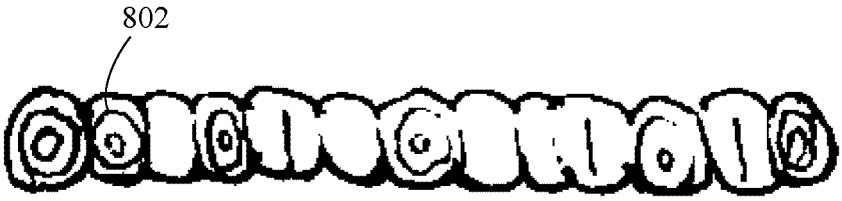
FIGS. 8A-8B illustrate views of a linearly arranged row of gem spheroids according to an embodiment of the disclosure.
Figure 8B:
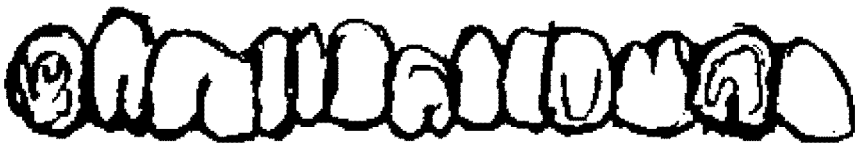

FIG. 8A illustrates a top view of a linearly arranged row of gem spheroids according to an embodiment of the disclosure. The row of gem spheroids include some gems with concentric striations 802 on mirror smooth surface. FIG. 8B illustrates a side view of the linearly arranged row of gem spheroids of FIG. 8A. The row of gem spheroids may exhibit uneven thickness and internal dimensions of the spheroids, which can cause unusual refractive colors.

Figure 9A:
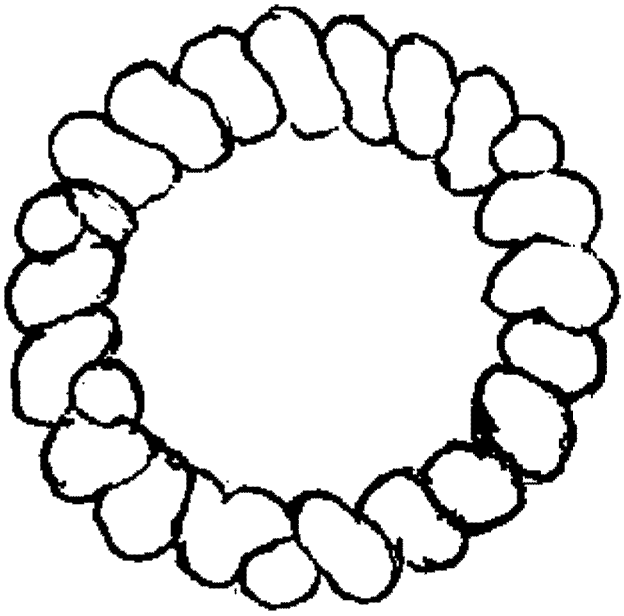
FIGS. 9A-9B illustrate views of circularly arranged gem spheroids according to an embodiment of the disclosure.
Figure 9B:
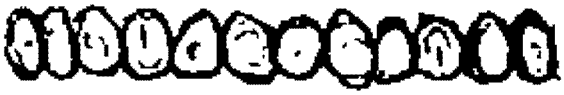

FIG. 9A illustrate a top view of circularly arranged gem spheroids according to an embodiment of the disclosure. The circularly arranged gem spheroids can include a double row of gem material offset to cause reflection in opposite spheres after refraction. FIG. 9B illustrates a side view of the circularly arranged gem spheroids of FIG. 9A.

Figure 10A:
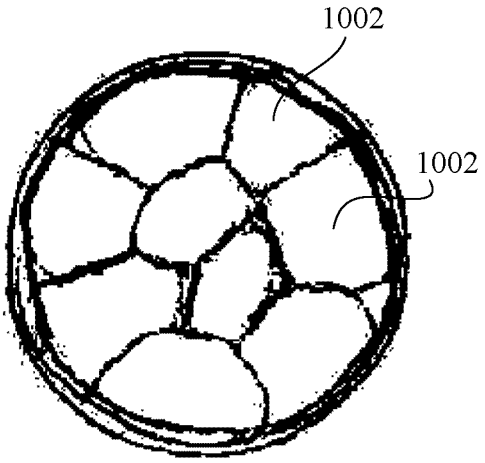
FIGS. 10A-10C illustrate views of a gem according to an embodiment of the disclosure.
Figure 10B:
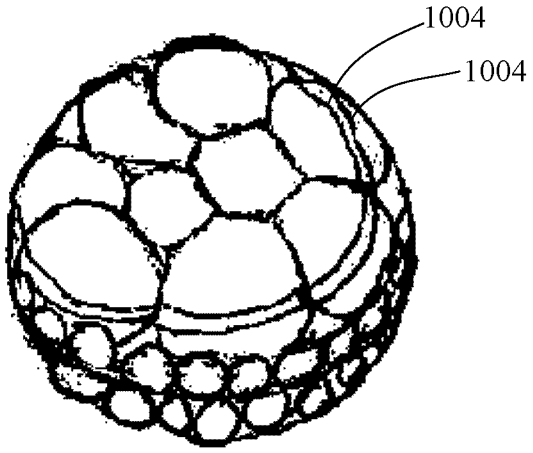
Figure 10C:
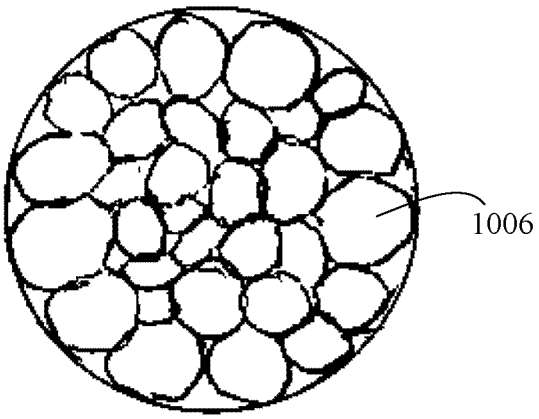

FIG. 10A illustrates a top view of a gem according to an embodiment of the disclosure. The gem includes a smooth hemispheres 1002 and two striations 1004 above its base. FIG. 10B illustrates a lateral/side view of the gem in FIG. 10A. The smooth hemispheres 1002 of the gem form bulbous curved sectors with the two striations 1004 near the bottom of the smooth hemispheres 1002. The base of the gem is shown to be convex. FIG. 10C illustrates a bottom view of the gem in FIG. 10A, showing an overall convex base with many smaller hemispheres 1006 varying in depth over the convex base.

Figure 11A:
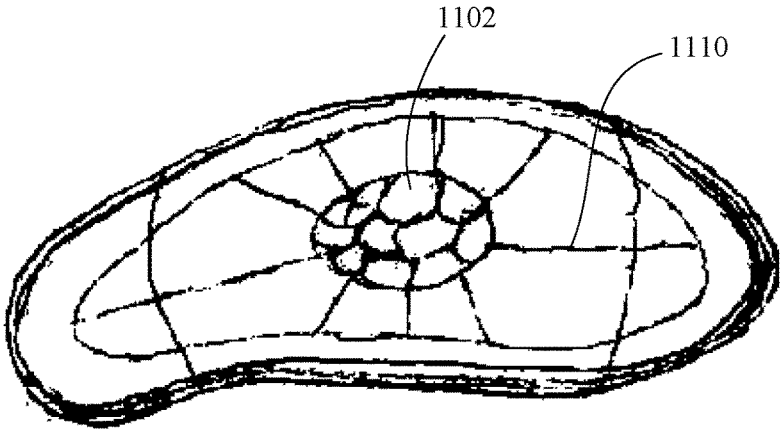
FIGS. 11A-11D illustrate views of a gem according to an embodiment of the disclosure.
Figure 11B:
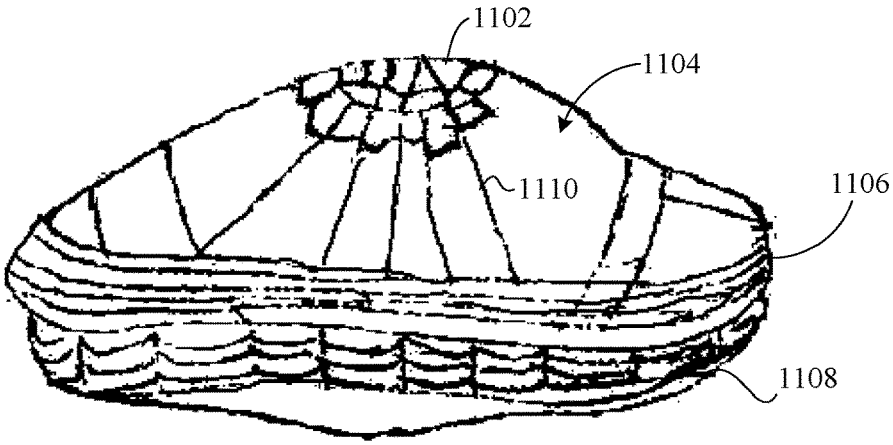
Figure 11C:
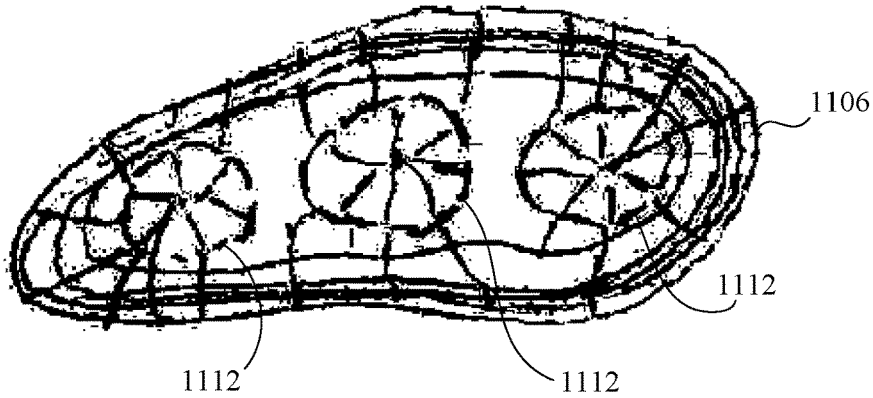
Figure 11D:
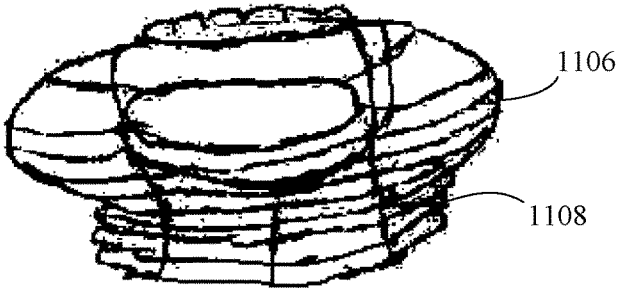

FIG. 11A illustrates a top view of a gem according to an embodiment of the disclosure. The gem is shown to exhibit a faint bulges 1102 (e.g., pentagonal or other shape bulges), a mirror finish 1104, and multiple striations 1106. FIG. 11B illustrates a side view of the gem of FIG. 11A. The side view illustrates the multiple striations 1106 further showing banded striations 1108 below the multiple striations 1106. The surface of the gem is shown to include faint indentations 1110. FIG. 11C illustrates a bottom view of the gem of FIG. 11A showing convex bulges 1112 on the base of the gem. FIG. 11D illustrates an end view of the gem of FIG. 11A showing the banded striations 1108 in relation to the multiple striations 1106.

Figure 12A:
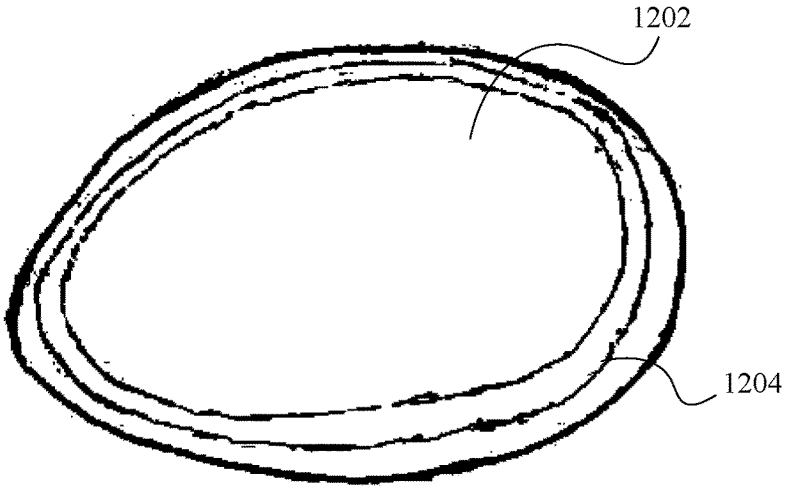
FIGS. 12A-12C illustrate views of an oval spheroidal gem according to an embodiment of the disclosure.
Figure 12B:
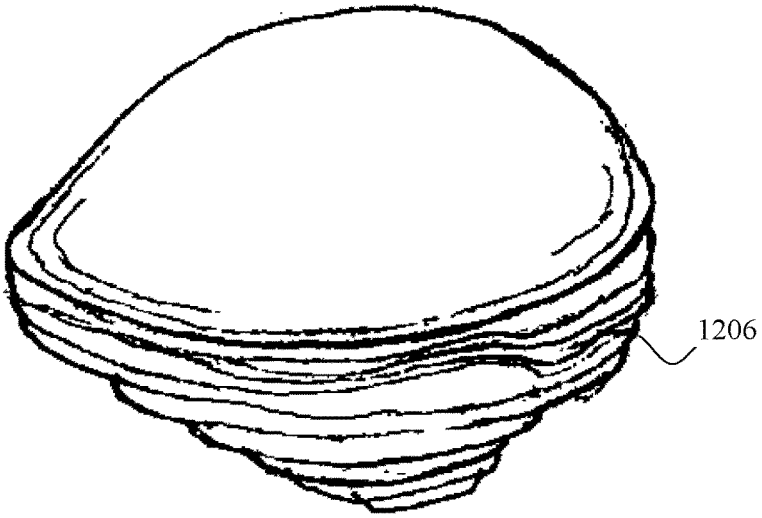
Figure 12C:
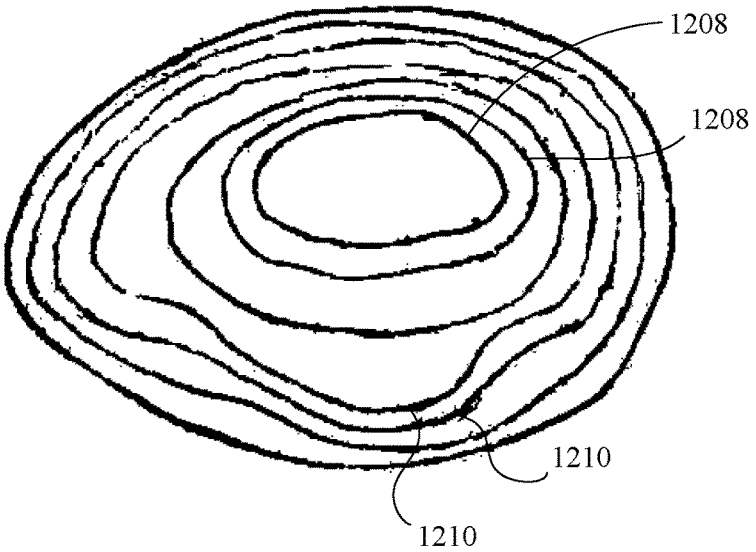

FIG. 12A illustrates a top view of an oval spheroidal gem according to an embodiment of the disclosure. The oval gem exhibits a smooth hemisphere 1202 with few curvalinear striations 1204. FIG. 12B illustrates a side view of the gem of FIG. 12A, showing decreasing bands 1206 of transparent gem material. The side view also shows a deep thickness of the oval gem where the depth of the gem is approximately equal to the width of the gem. FIG. 12C illustrates a bottom view of the gem of FIG. 12A, showing concentric indented bands 1208. Curved bands 1210 above mid-section of the oval gem and varying thickness in the gem may cause of a northern lights pattern to be viewed by an observer on the opposite side of the thick oval gem shown in FIGS. 12A-12C.

Figure 13A:
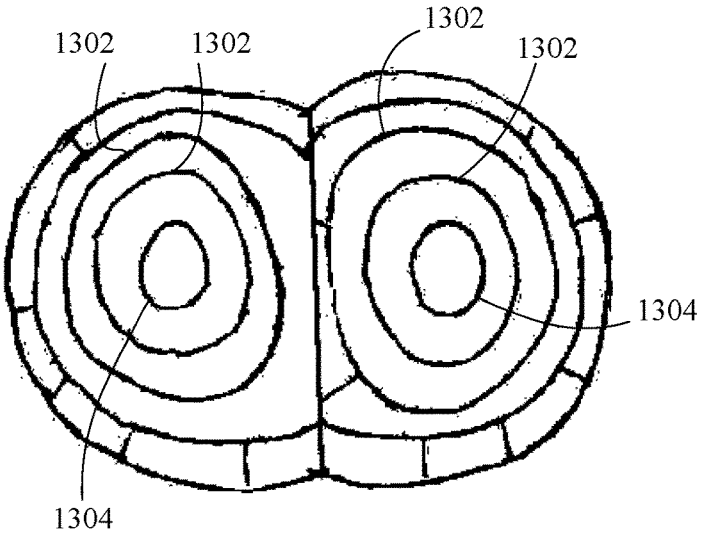
FIGS. 13A-13C illustrate views of a double gem according to an embodiment of the disclosure.
Figure 13B:
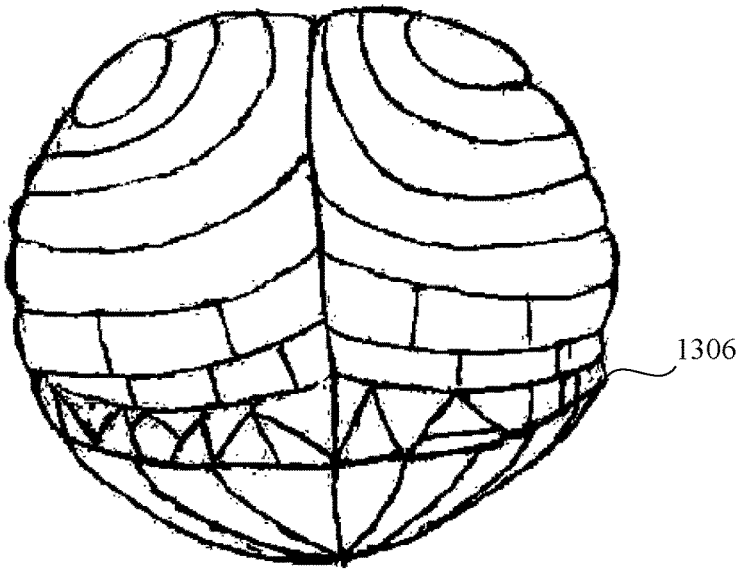
Figure 13C:
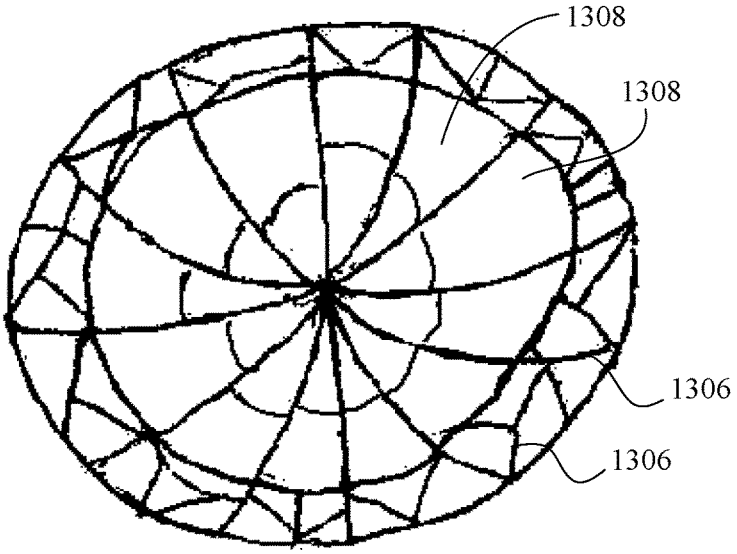

FIG. 13A illustrates a top view of a double gem according to an embodiment of the disclosure. The double gem includes beveled bands around each center. FIG. 13B illustrates a side view of the double gem of FIG. 13A showing the beveled bands 1302 around each center 1304 and a band with a polygonal 1306 design. FIG. 13C illustrates a bottom view of the gem of FIG. 13A showing convex basin sectors 1308 and bands of polygonal 1306 gem material.

Figure 14A:
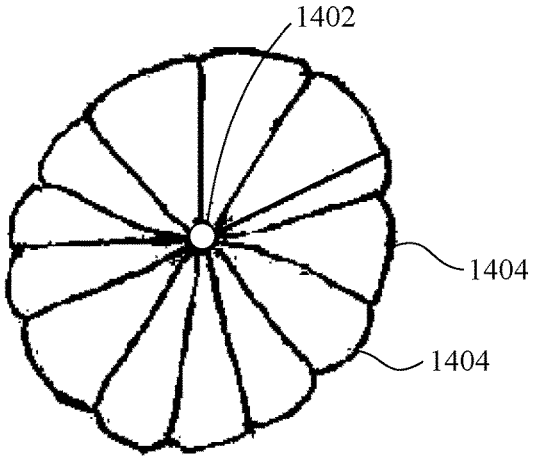
FIGS. 14A-14D illustrate views of a gem according to an embodiment of the disclosure.
Figure 14B:
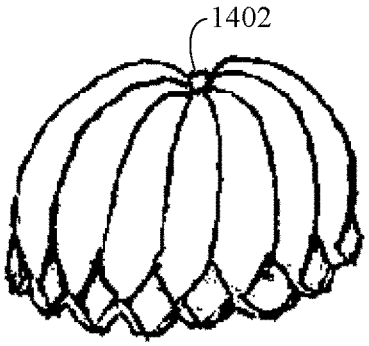
Figure 14C:
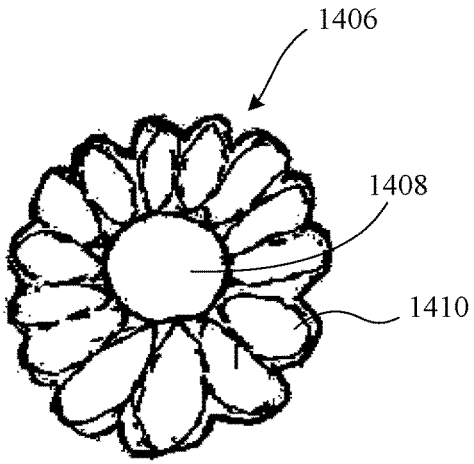
Figure 14D:
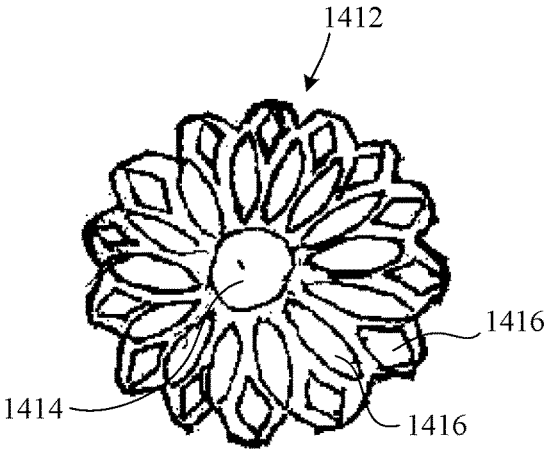

FIG. 14A illustrates a top view of a gem according to an embodiment of the disclosure. The gem is shown to include central convex lens 1402 with twelve rounded sectors 1404 each including about a 30-degree angle at an opposite end. The gem can be faceted to be symmetrical in some implementations. FIG. 14B illustrates a side view of the gem of FIG. 14A. FIG. 14C illustrates a first embodiment of a bottom view of the gem of FIG. 14A, showing "V" shaped cuts 1406 into the gem's base with a central convex basin 1408 and concave grooves 1410 in the bottom of the gem. FIG. 14D illustrates a second embodiment of a bottom view of the gem of FIG. 14A, showing "V" shaped cuts 1412 into the gem's base with a central concave 1414 basin and concave grooves 1416 at the bottom of the gem.

Figure 15A:
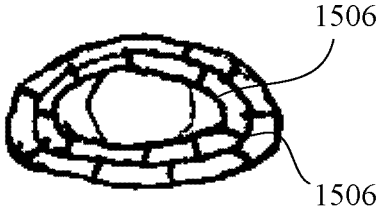
FIGS. 15A-15C illustrate views of a spheroidal gem with beveled bands according to an embodiment of the disclosure.
Figure 15B:
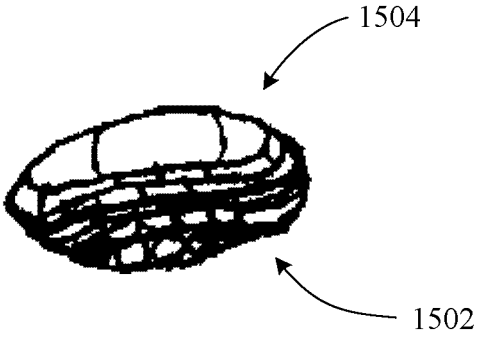
Figure 15C:
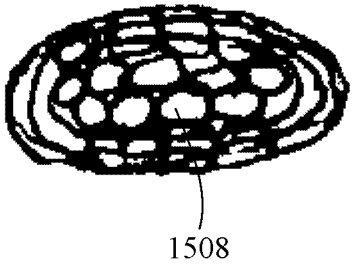

FIG. 15A illustrates a top view of a spheroidal gem with beveled bands according to an embodiment of the disclosure. In one embodiment, the gem has a spheroidal top with two or three beveled bands 1506 above its midsection. FIG. 15B illustrates a side view of the gem of FIG. 15A. The gem includes a convex base 1502 and top 1504, with two or three beveled bands 1506 on top and small hemispheres 1508 on the base. FIG. 15C illustrates a bottom view of the gem of FIG. 15A. The base of the gem is convex with some striations below the midsection and small hemispheres 1508 lining the base.

Figure 16A:
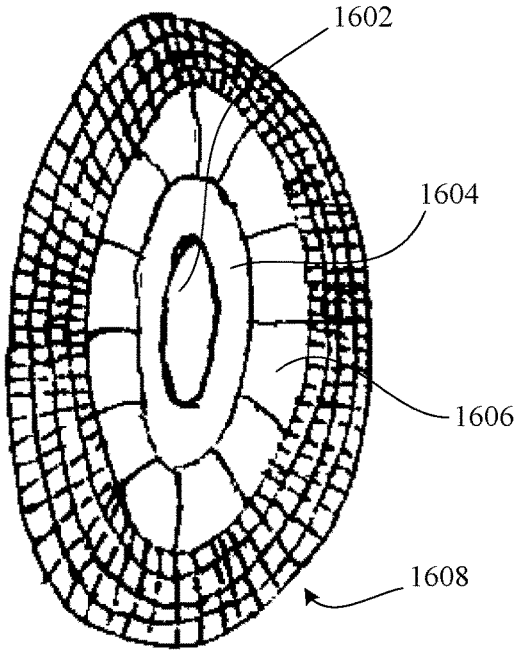
FIGS. 16A-16C illustrate views of an oval spheroidal gem with beveled cuts according to an embodiment of the disclosure.
Figure 16B:
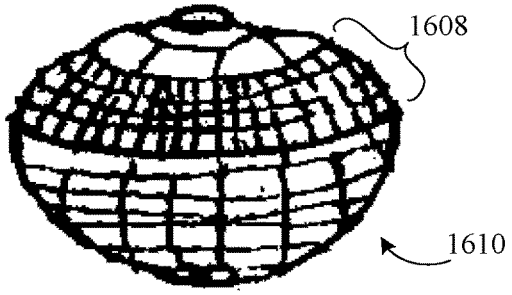
Figure 16C:
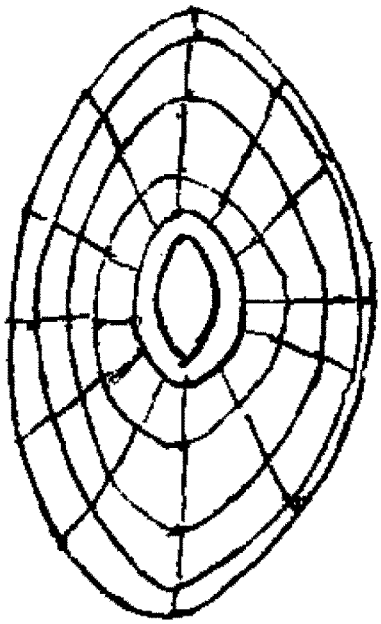

FIG. 16A illustrates a top view of an oval spheroidal gem with beveled cuts according to an embodiment of the disclosure. The gem includes oval shaped transparent layers with the first three layers 1602, 1604, 1606 being mirror smooth and the next four layers 1608 having narrow, beveled cuts. The gem has a clear top and some indentations. Furthermore, the gem includes approximately four or five layers of narrow downward sloping beveled surfaces at, e.g., 20°, 30°, 50°, 75°, 90°. FIG. 16B illustrates a side view of the gem of FIG. 16A. The side view shows an overall flattened oval spheroid with four rows of beveled surfaces 1608 on a top half and spheroidally beveled surfaces 1610 on a lower half. In an embodiment, sunlight refracts on entering the gem and reflected colors have a radial pattern around the center of the gem. FIG. 16C illustrates a bottom view of the gem of FIG. 16A, showing a convex lower half with beveled surfaces at, e.g., 0°, 20°, 40°, 60°, 80°, 90°. The bottom view of the gem may resemble an oval gem cut.

Figure 17A:
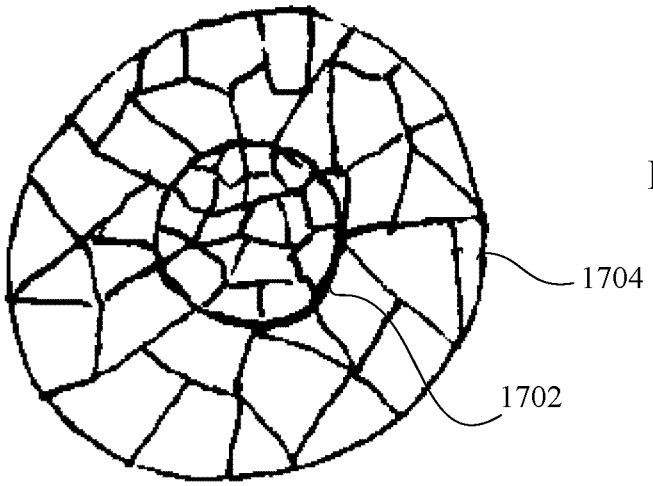
FIGS. 17A-17C illustrate views of a gem according to an embodiment of the disclosure.
Figure 17B:
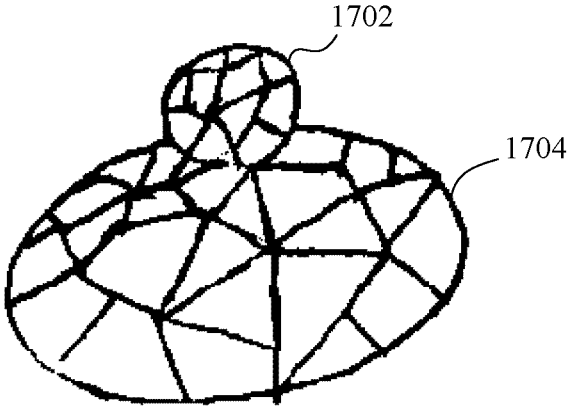
Figure 17C:
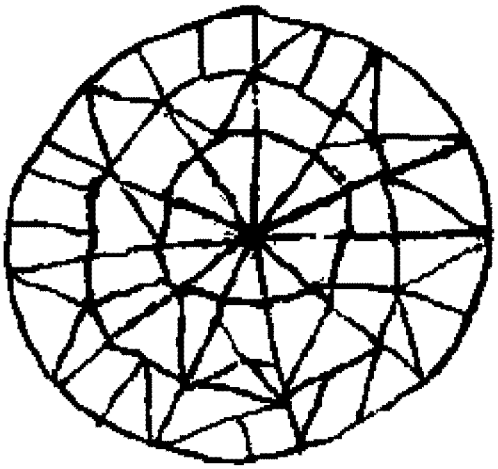

FIG. 17A illustrates a top view of a gem according to an embodiment of the disclosure. FIG. 17B illustrates a side view of the gem of FIG. 17A. FIG. 17C illustrates a bottom view of the gem of FIG. 17A. The gem includes a faceted top portion 1702 (e.g., shaped like a sphere) and an faceted bottom portion 1704 (e.g., shaped like a flattened oval).

Figure 18A:
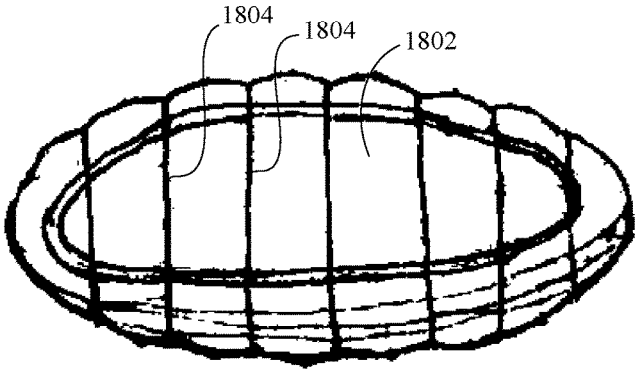
FIGS. 18A-18D illustrate views of a gem according to an embodiment of the disclosure.
Figure 18B:
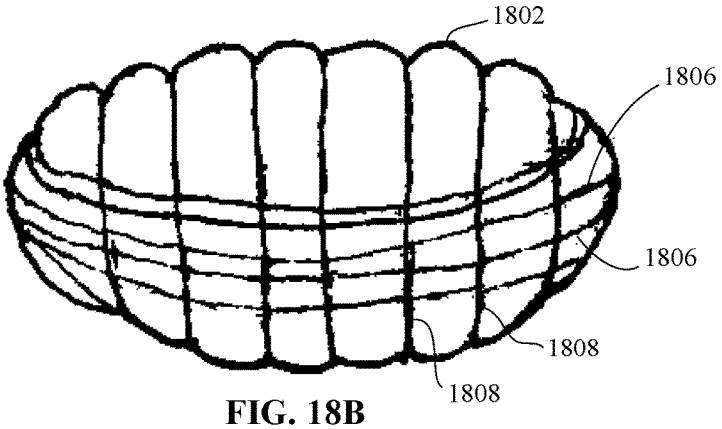
Figure 18C:
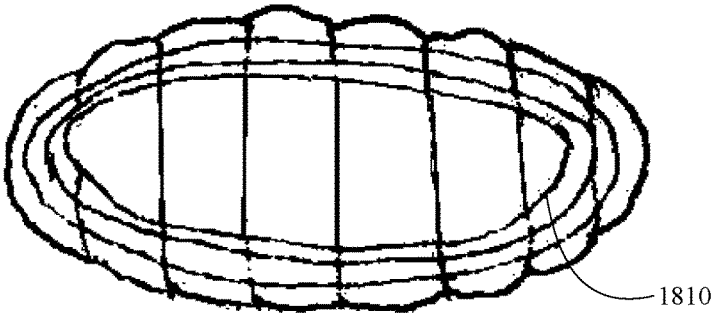
Figure 18D:
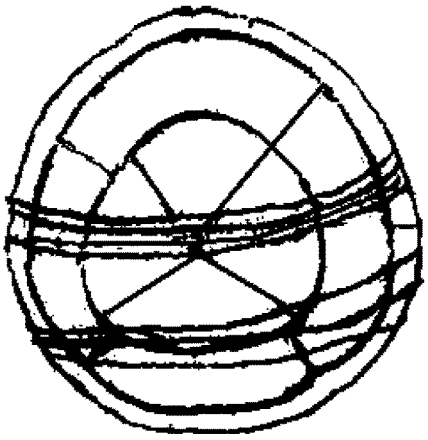

FIG. 18A illustrates a top view of a gem according to an embodiment of the disclosure. The gem exhibits a flat slab 1802, has a cocoon-like structure, and faint intersection lines 1804. In an example, seven faint vertical intersection lines 1804 may be sculptured or faceted into the gem. FIG. 18B illustrates a side view of the gem of FIG. 18A. The gem may have a mirror finish with a few striations 1806. Faint bands 1808 may be etched in the lower half of the gem. FIG. 18C illustrates a bottom view of the gem of FIG. 18A, showing a few striations and vertical bands. FIG. 18D is an end view of the gem in FIG. 18A.

Figure 19A:
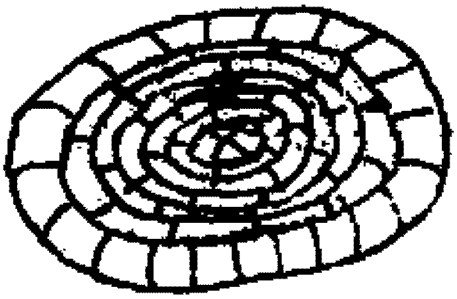
FIGS. 19A-19C illustrate views of a gem according to an embodiment of the disclosure.
Figure 19B:
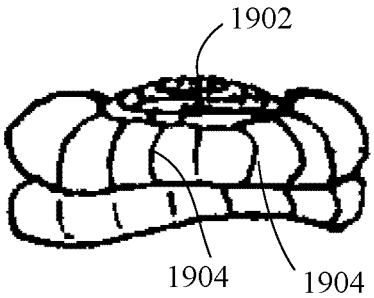
Figure 19C:
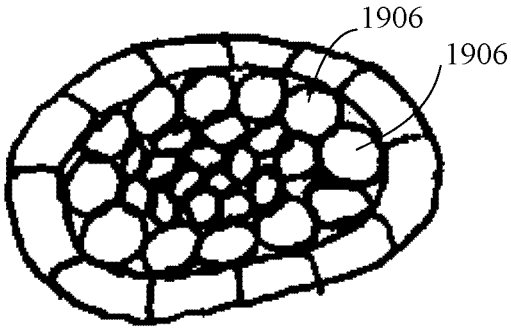

FIG. 19A illustrates a top view of a gem according to an embodiment of the disclosure. The gem is shown to exhibit a raised center 1902. FIG. 19B illustrates a side view of the gem of FIG. 19A, showing spheroidal bands 1904 around the gem. FIG. 19C illustrates a bottom view of the gem of FIG. 19A showing slightly convex basin with hemispheres 1906 acting as reflective cups or bowls.

Figure 20A:
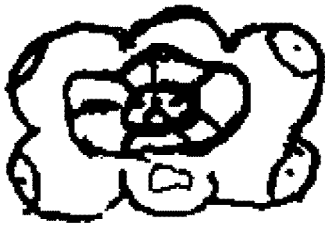
FIGS. 20A-20C illustrate views of a gem with a bulbous top according to an embodiment of the disclosure.
Figure 20B:
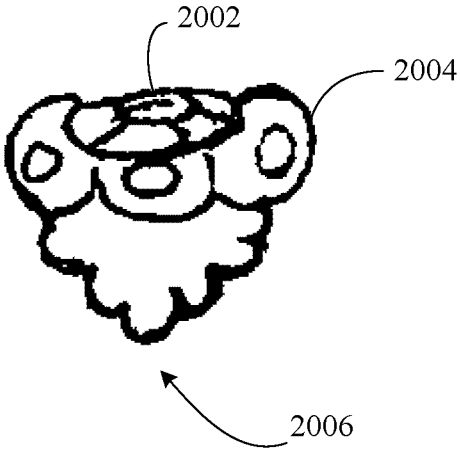
Figure 20C:
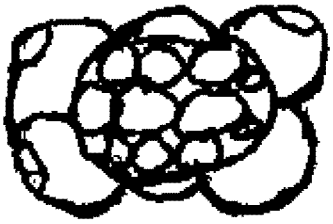

FIG. 20A illustrates a top view of a gem with a bulbous top 2002 according to an embodiment of the disclosure. FIG. 20B illustrates a side view of the of FIG. 20A showing bulbous sides 2004. FIG. 20C illustrates a bottom view of FIG. 20A, showing a convex base 2006 at a central area of the gem.

Some examples of refractive surfaces according to embodiments of the disclosure include, but are not limited to:

a. A few small lens, or many, centrally located, radially partitioned or not, on top half of hemisphere,
b. Faint convex surfaces on top half of gem,
c. Small dimples on convex surface,
d. Medium sized, segmented lens centrally located on top half of gem,
e. Thin overlapping solid layers on top of gem surfaces cause sunlight to refract,
f. Small, rounded caldera (volcanic vent-like structures) with concave features,
g. Complete top hemisphere of gem-polished,
h. Spheroidal polygonal facets on top portion of a gem, a few horizontal rows, or area wide,
i. A few horizontal bands or random horizontal and some vertical rounded bands, grooves, or striations with a few around the top half of the gem, more at mid-section, and most below midsection, cause refraction to occur,
j. Bulbous pillows of gemstone material on the top and bulbous lenses of gem material symmetrically placed near midsection and below enhance refractive colors to occur. On top half, lenses, domes, mushroom shapes, circular ridges and valleys, dimples, and circular rimed lower areas or, sections thereof, (rounded); contribute to refraction in the lower half of the gem, k. Thickening or thinning of gem material, mainly at gem edges, can cause colors to appear, as with a prism, or l. Thickening rounded top rims may give 1st, 2nd, 3rd order colors at gem's reflective base.

Some examples of reflective surfaces, for light and color, according to embodiments of the disclosure include, but are not limited to:

a. A round crown, cone-like shape of pavilion, forms reflective focal point facets, b. Any curvilinear surface reflecting colored rays or brightness, c. Cone-like or less than spheroidal shape of pavilion of the gemstone, d. Enhanced cups, bowls, basins (various sizes) and shapes (round, oval, elongated), e. Cirques (small oval convex basins), f. Caldera (round cones) in the surface-wider than deep, with round edges, g. In lower half of gem, spheroidal facets or hemispheres with varying sizes, convex out for reflective basins, h. Internal intersections of faces, corners, curves, junctions in gem, i. Polygonal spheroidal surfaces in the lower half of gem, convex out for reflective basins, j. Central lens at base either convex out or concave in, or k. Flat faceted pavilion facets suffice, but a spheroidal convex basin, or hemispheres with varying sizes, convex out, may give more saturated reflected colors Spheroidal gemstones may display the following characteristics: 1. An increasing number of colors occurring in the gemstone. 2. Longer lasting colors on gem rotation. 3. All colors of the natural visible spectrum displayed at one time, 4. A greater saturation of color, particularly with violets, blues, and greens, and 5. Brighter gems with increased scintillation on rotation.

With some embodiments of the disclosure, all colors of the natural visible spectrum may be observed with the gemstone in a fixed position, due to full spectrum refraction and reflection in the gemstone. Areas of color may be smaller in size, but more saturated in color and more numerous in occurrence in a spheroidal enhanced gemstone, than in a flat faceted gem. As the overall gem is spheroidal or augmented by lens-like structures, or may be slightly cone shaped, small features near the base in the gem are magnified and are visible with the naked eye or with a 10× hand lens. The travel path of light rays may be shorter from being reflected only once in the spheroidal gemstone, thus there is less chance of loss of light in the gemstone than presently occurs with flat faceted gemstones, adding to brighter gems, greater colors saturation and greater brilliance throughout the gemstone. All colors of the natural visible spectrum may be displayed continuously and simultaneously with shocking scintillation as the gemstone is rotated 360°.

Unusual spectral color patterns and gem designs may occur due to spheroidal optic faceting of gems according to embodiments of the disclosure, resulting in, but not restricted to: vivid 'electric-light' colors, sparkling rainbows, multicolored spectral basins, northern lights, rising and setting colored suns, pastel-colored gems, internal pinpoint spectral rays, colored bands, brighter gemstone, enhanced scintillation and optic-ornamental features as the focal point sweeps across the gem's reflective facets or basins on rotation of the gem. Unique physical gem shapes occur beyond those presently cut with the above-mentioned more saturated colors and brightness radiating throughout the gemstone to the observer with a 3-dimensional effect occurring in the gemstone.

Exemplary materials for sculpturing according to the present disclosure are inexpensive, transparent or semitransparent, and light to medium colored gemstones. Other darker stones, natural or manmade, gem or non-gem materials may be illuminated by intense focal point light in the gemstone with sparkling saturated colors and brightness to give more adaptive darker potential gemstones in the future.

Spheroid and spheroidal as used in the present disclosure refer to shapes that resemble but are not necessarily spheres, including but not limited to: perfect spheres, ellipsoids, spheres with additional features external or internal to the sphere surface, ellipsoids with additional features external or internal to the ellipsoid surface, and a series of flat facets that approximate a smooth spheroidal surface.

FIGS. 21A-33A illustrate examples of gemstones created according to the present disclosure, according to various embodiments. The gemstones shown in FIGS. 21A-33A are merely examples, and not meant to limit the scope of the disclosure. Also, some of the examples shown in FIGS. 21A-33A include air bubbles, as some of the stones are cut from sample glass marbles that included air bubbles. The air bubbles are not necessary to the disclosure, and in some embodiments better (more brilliant) results occur if there are no air bubbles.

In general, in the gemstones in FIGS. 21A-33A, the overall spheroidal crown (i.e., top portion of the gemstone) initiates formation of a focal point in the pavilion (i.e., bottom portion of the gemstone). The pavilion, which includes the axis of light, forms a focal point to illuminate reflective facets. Although the overall gem shape, especially the crown, is spheroidal, the facets may be flat due to the fact that it is difficult to form convex or concave facets on spheroidal surfaces, although convex or concave facets are part of the present disclosure. Flat facets are merely one embodiment. The shape of the facets can be polygons of any shape having three (3) sides and greater (e.g., square, rectangular, triangular, pentagonal, diamond, etc.) The location of reflective facets at the focal point gives best self, supra-illumination of spheroidal gemstones and best resolution of saturated colors, brilliancy, and scintillation on gem rotation.

Figure 21A:
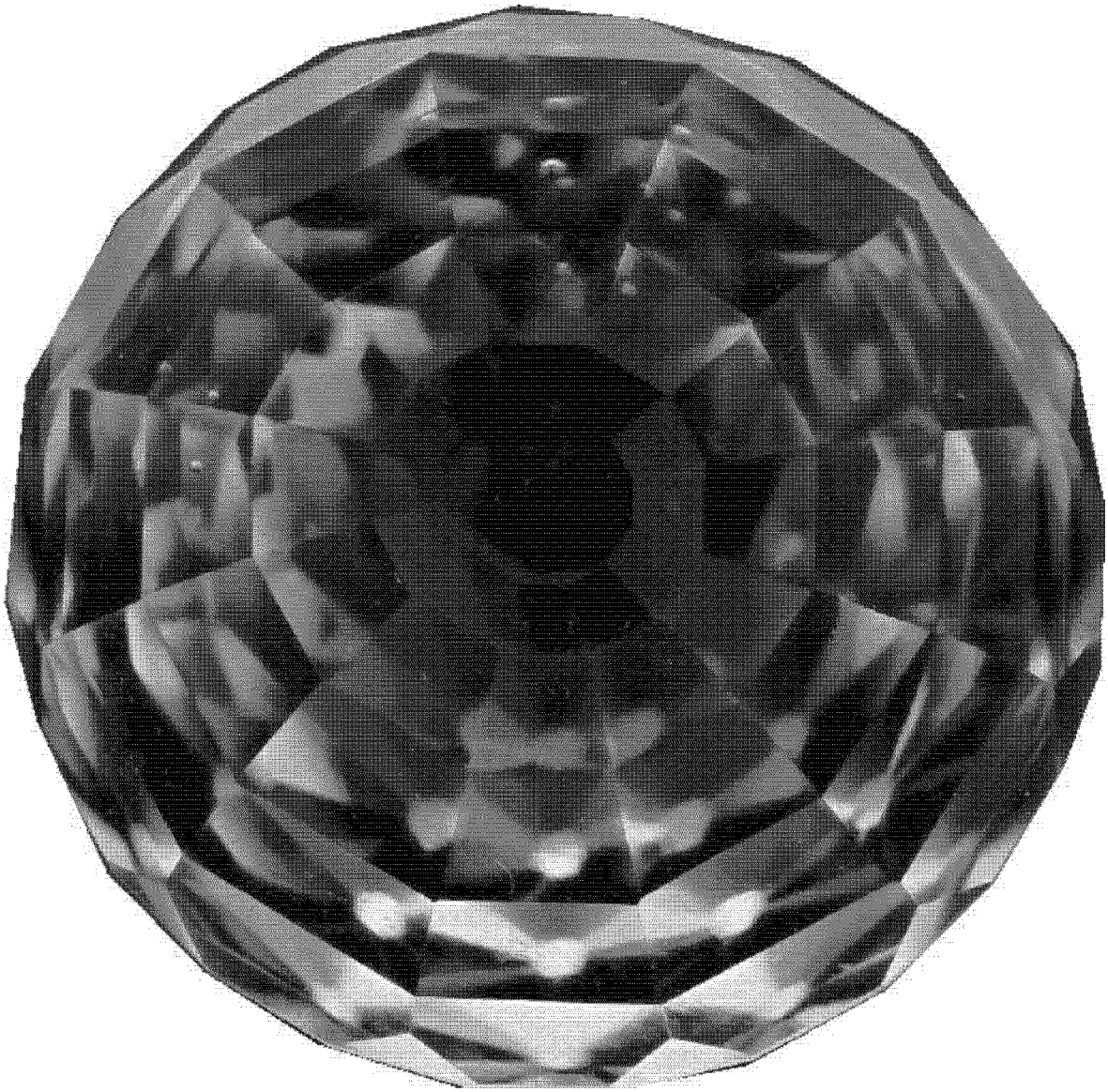
FIGS. 21A-31C illustrate examples of faceted gemstones, according to various embodiments.
Figure 21B:
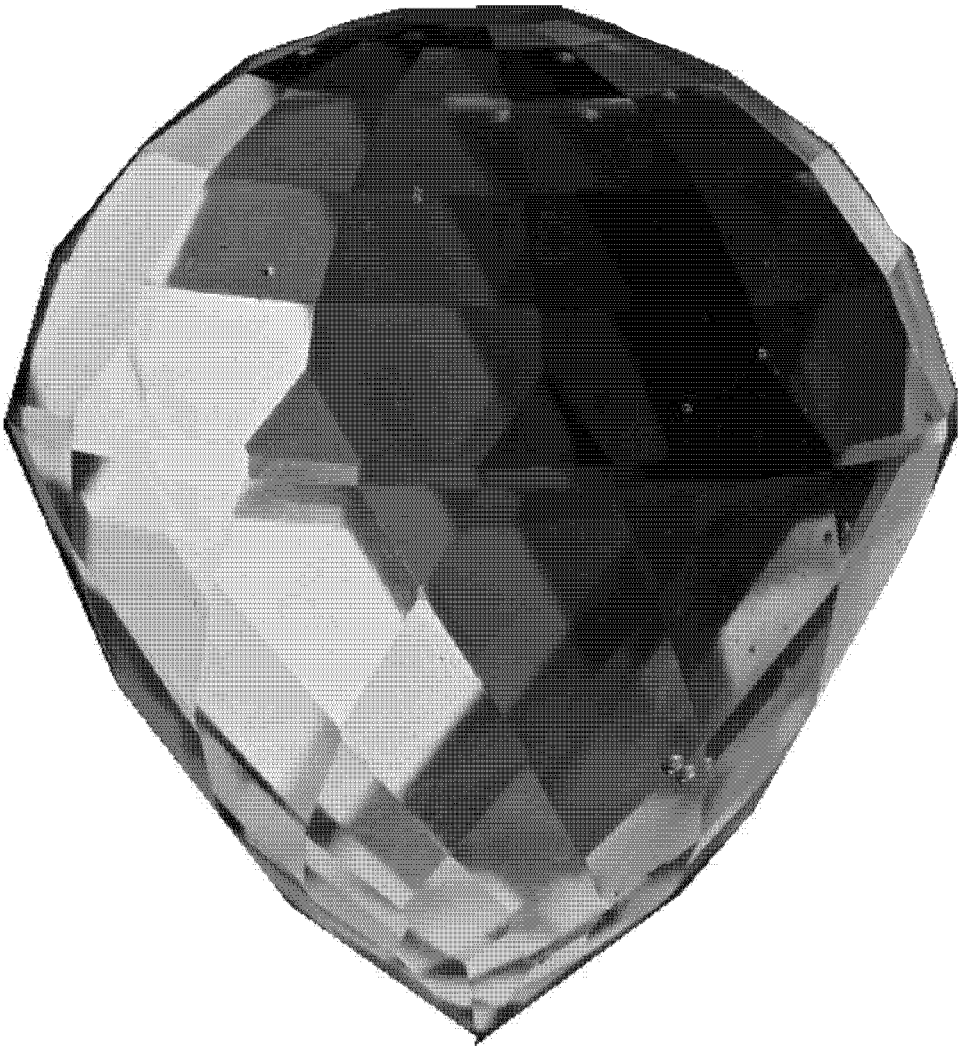
Figure 21C:
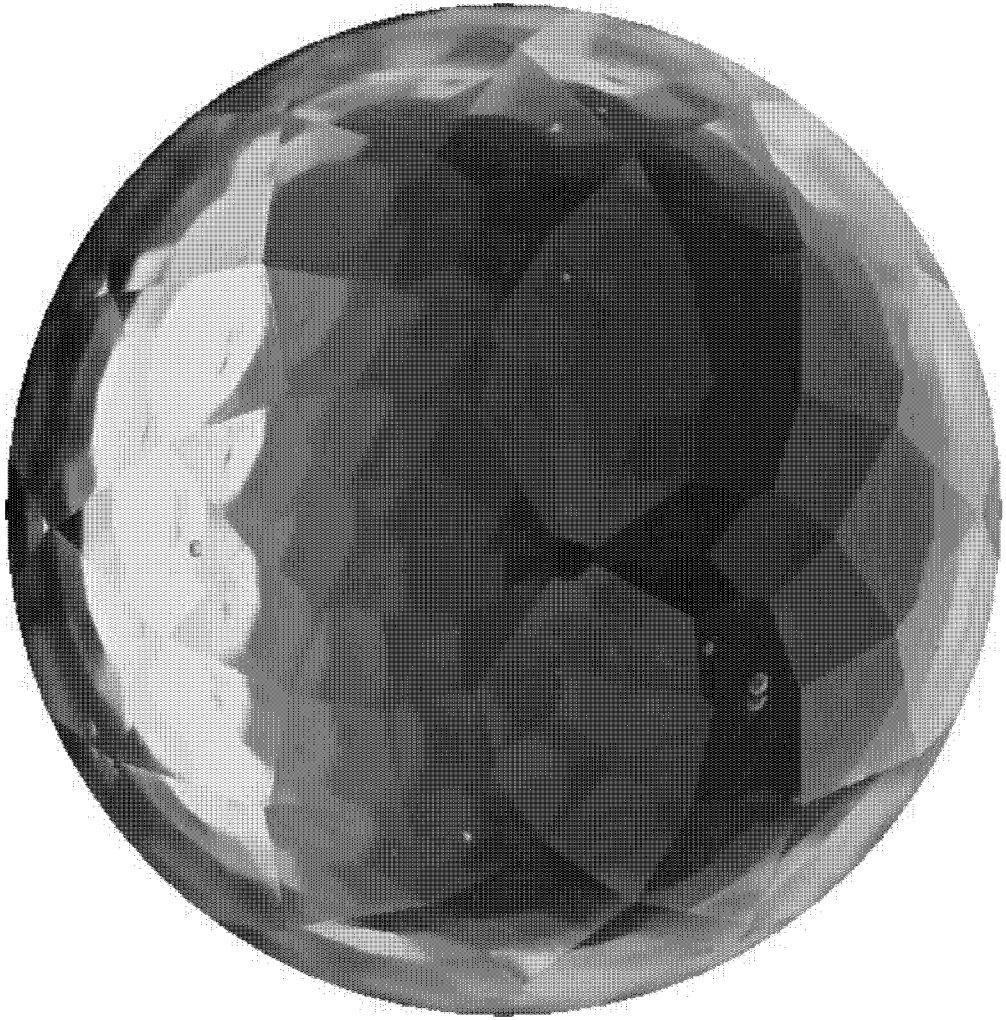

FIG. 21A illustrates a top view of a round gem, FIG. 21B illustrates a side view of the round gem in FIG. 21A, and FIG. 21C illustrates a bottom view of the round gem in FIG. 21A.

Figure 22A:
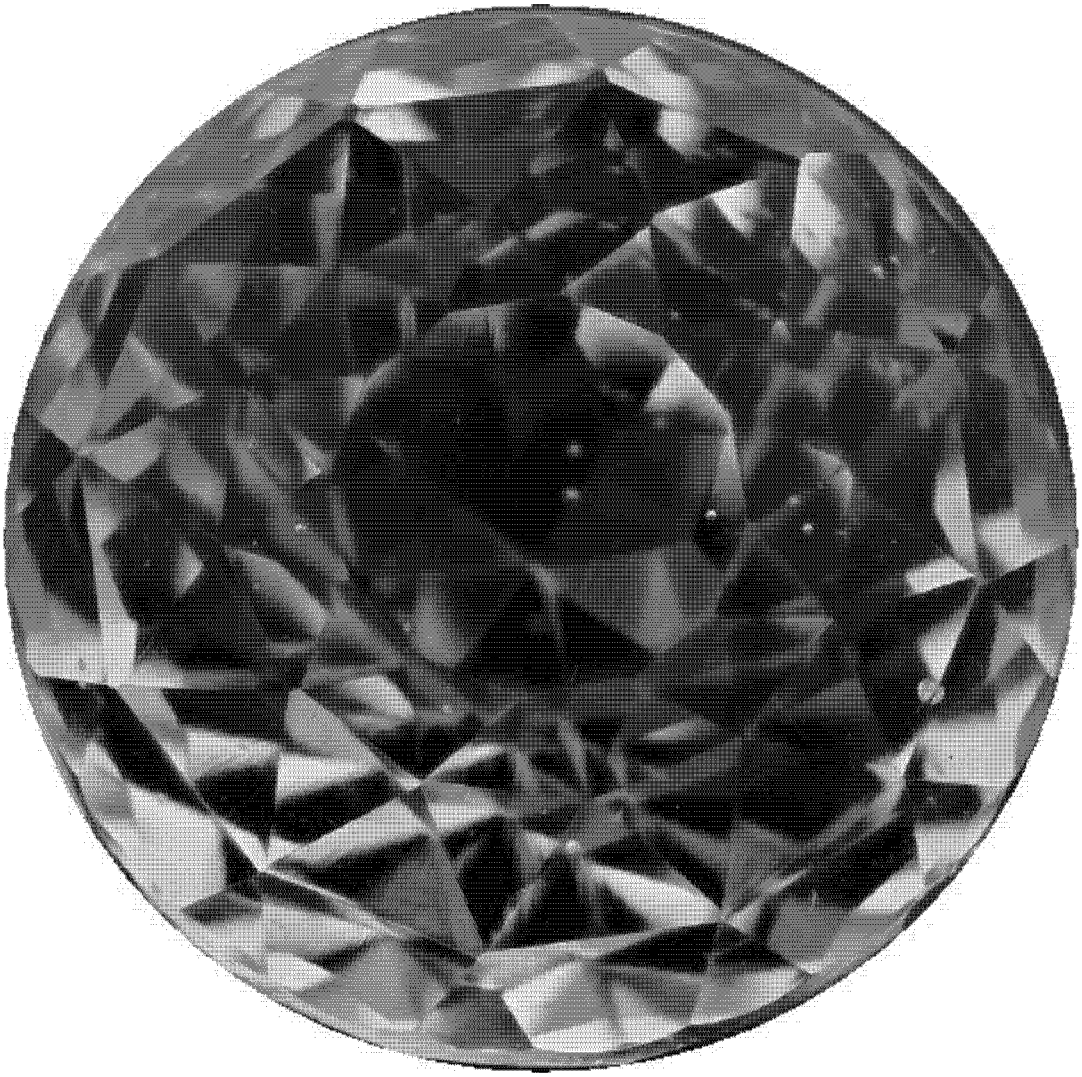
Figure 22B:
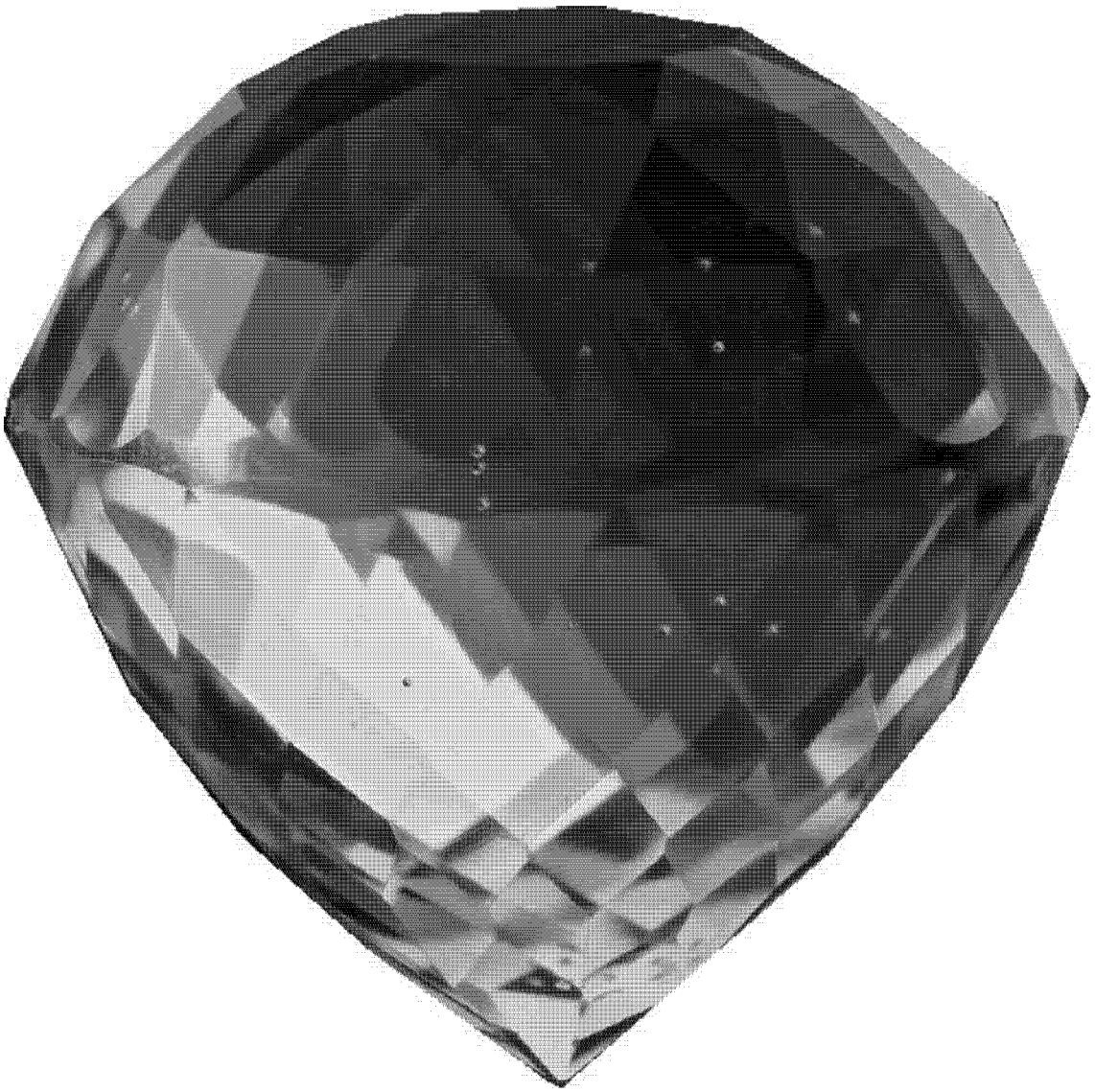
Figure 22C:
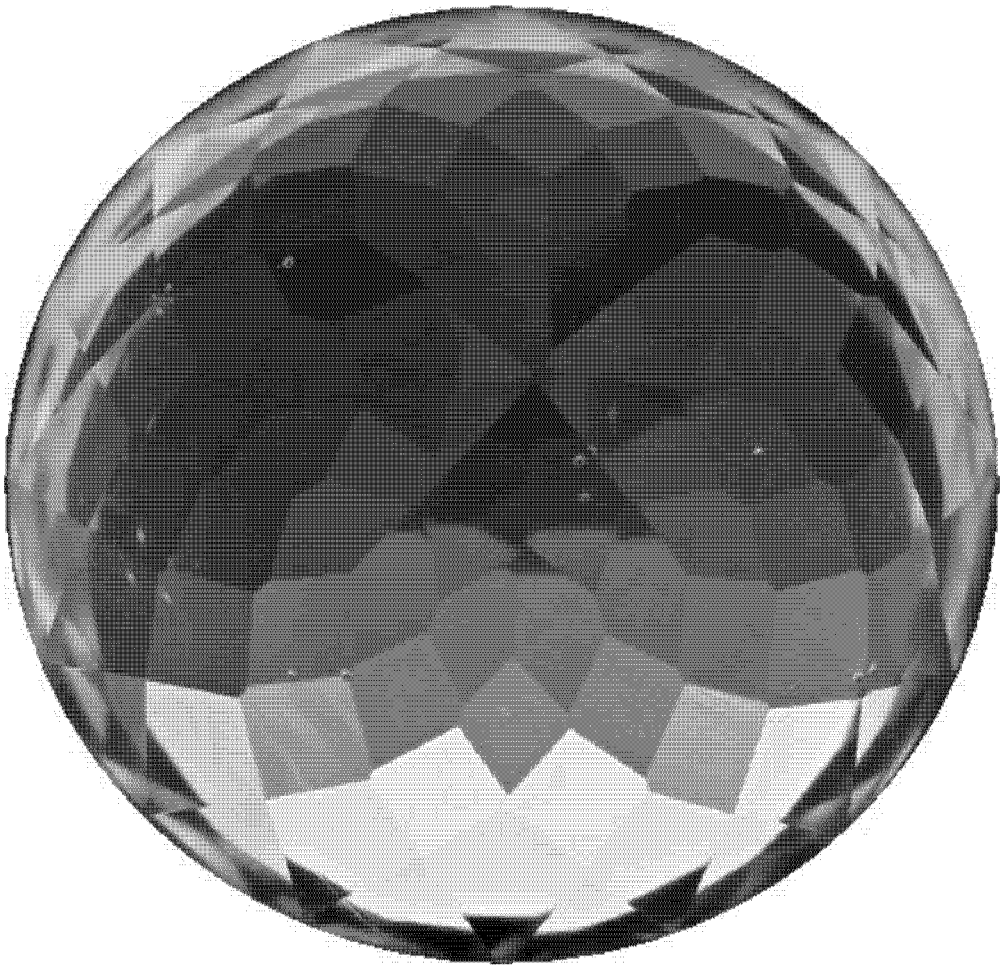

FIG. 22A illustrates a top view of a round gem, FIG. 22B illustrates a side view of the round gem in FIG. 22A, and FIG. 22C illustrates a bottom view of the round gem in FIG. 22A.

Figure 23A:
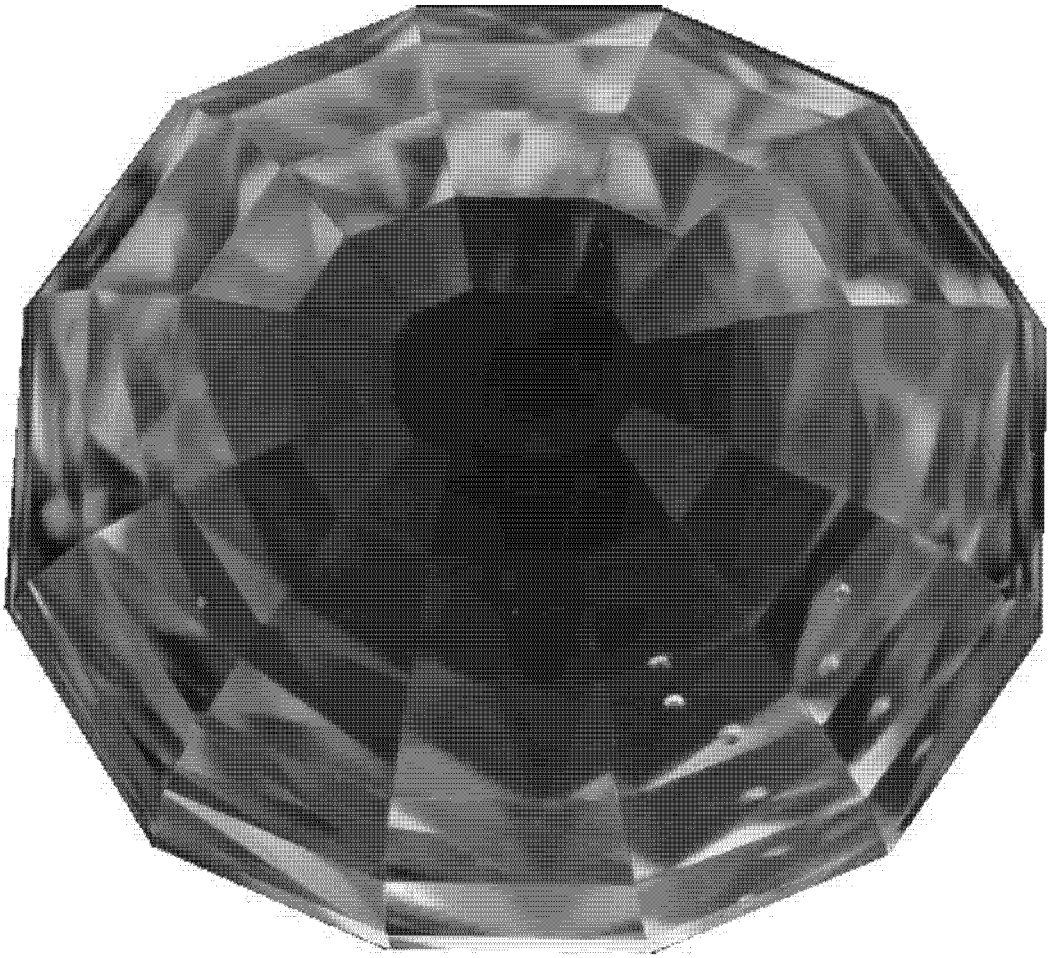
Figure 23B:
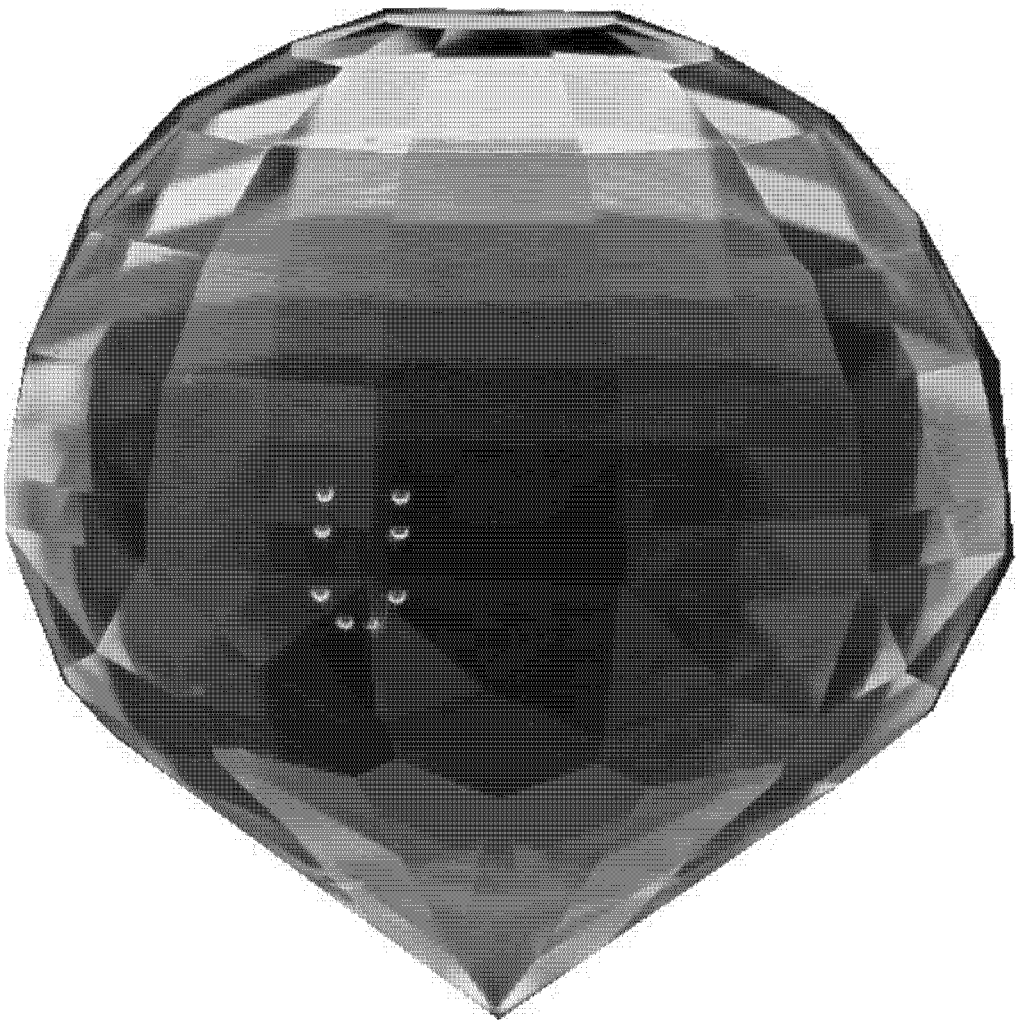
Figure 23C:
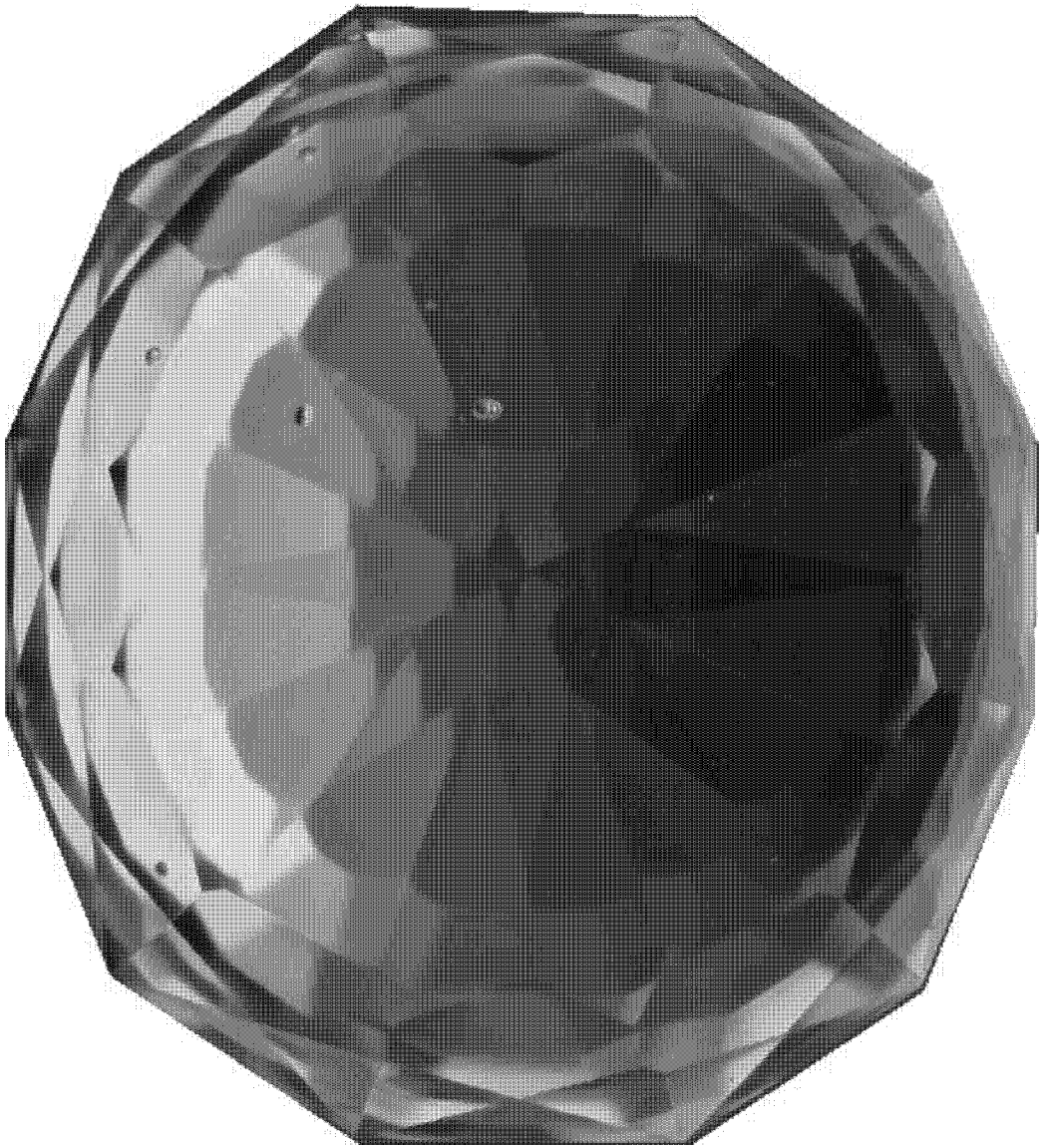

FIG. 23A illustrates a top view of an oval gem, FIG. 23B illustrates a side view of the oval gem in FIG. 23A, and FIG. 23C illustrates a bottom view of the oval gem in FIG. 23A.

Figure 24A:
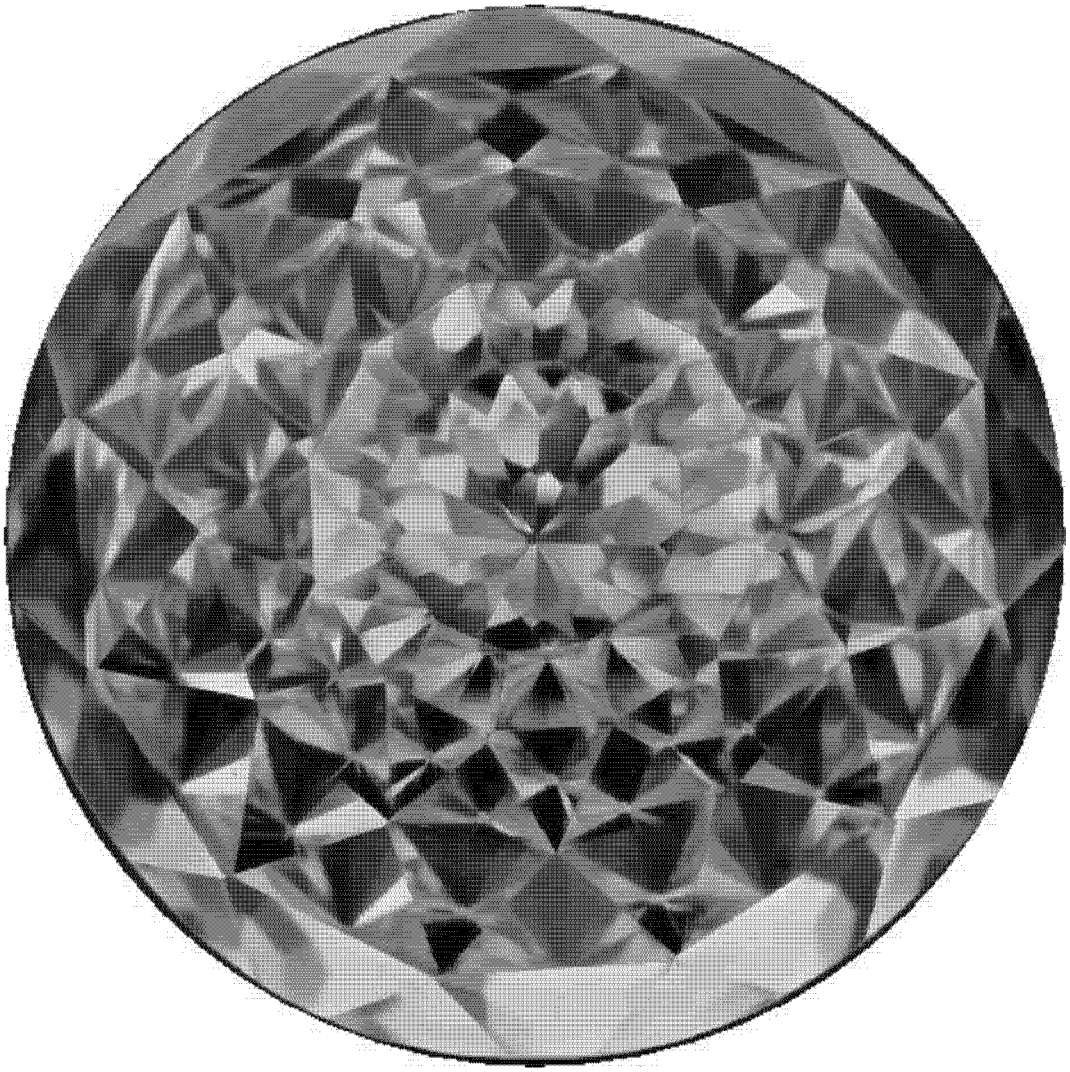
Figure 24B:
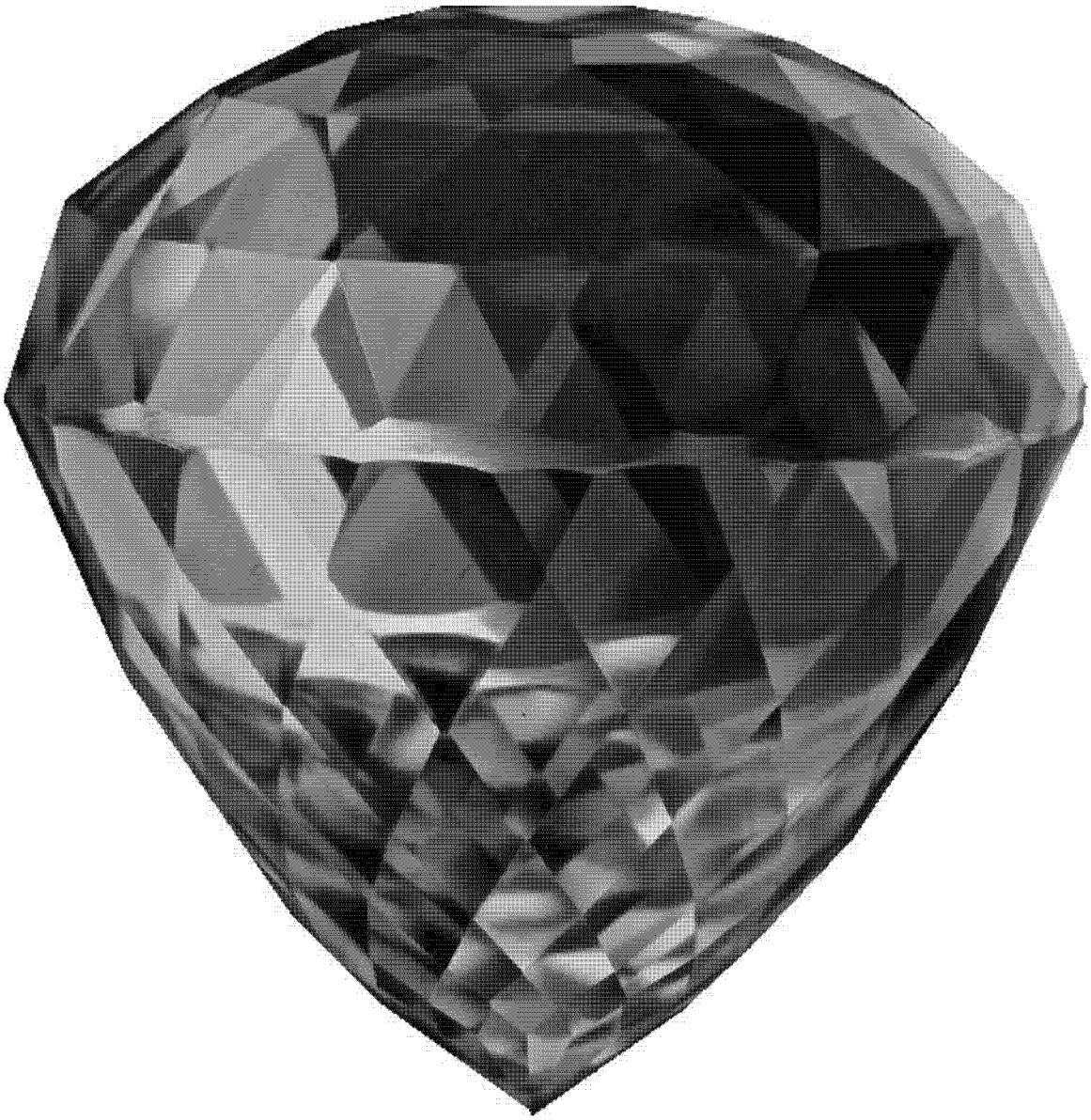
Figure 24C:
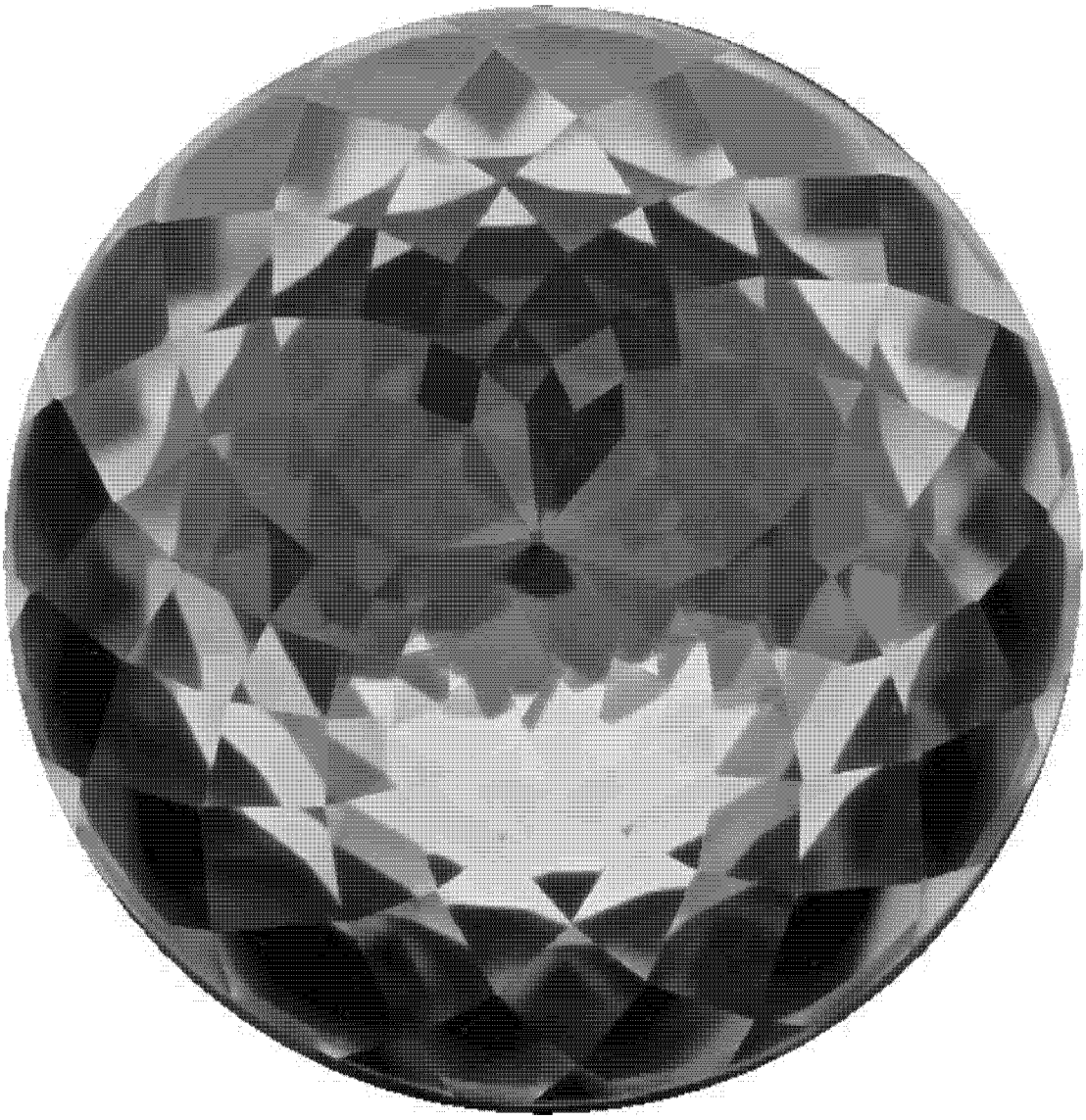

FIG. 24A illustrates a top view of a round gem, FIG. 24B illustrates a side view of the round gem in FIG. 24A, and FIG. 24C illustrates a bottom view of the round gem in FIG. 24A.

Figure 25A:
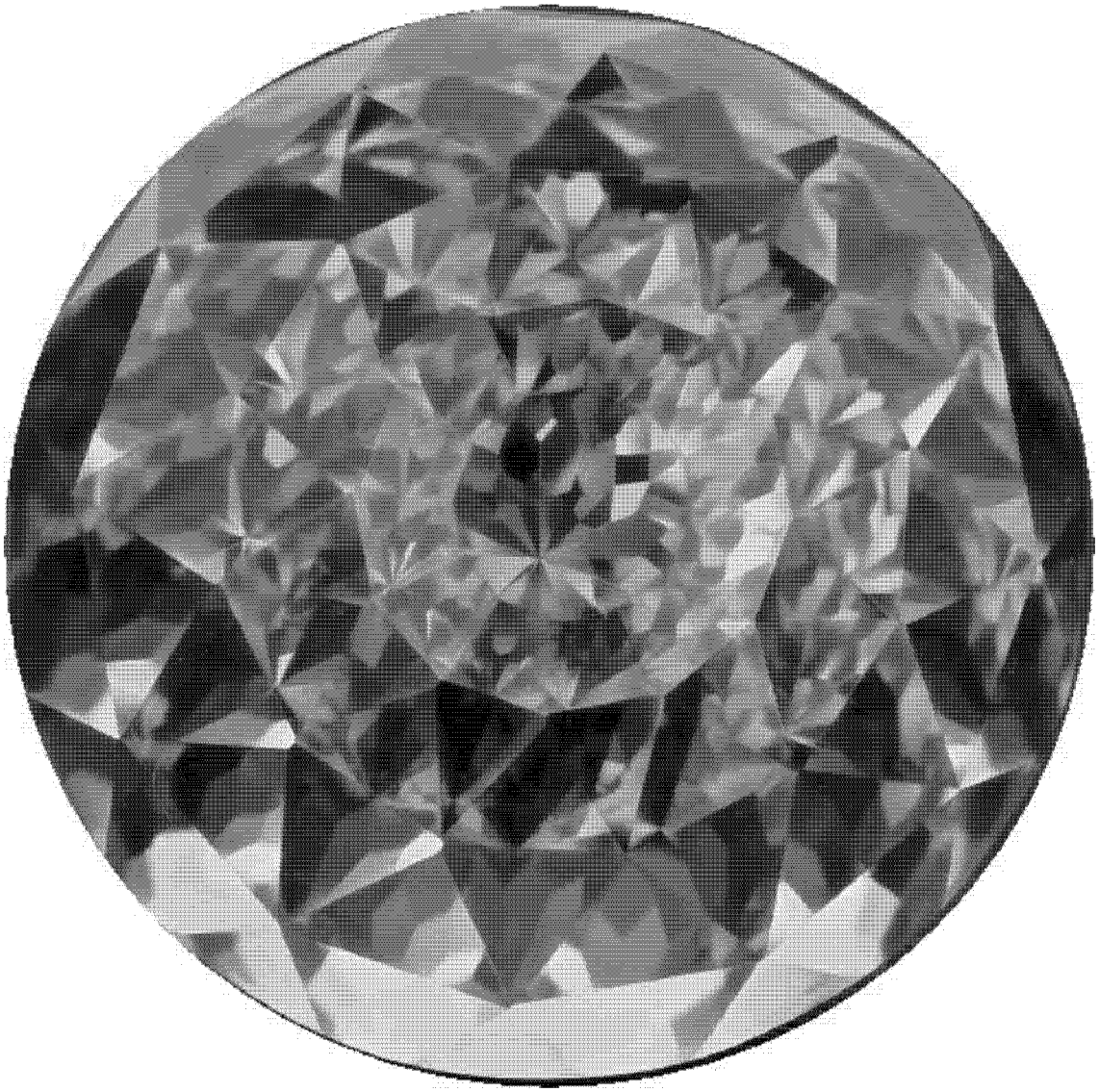
Figure 25B:
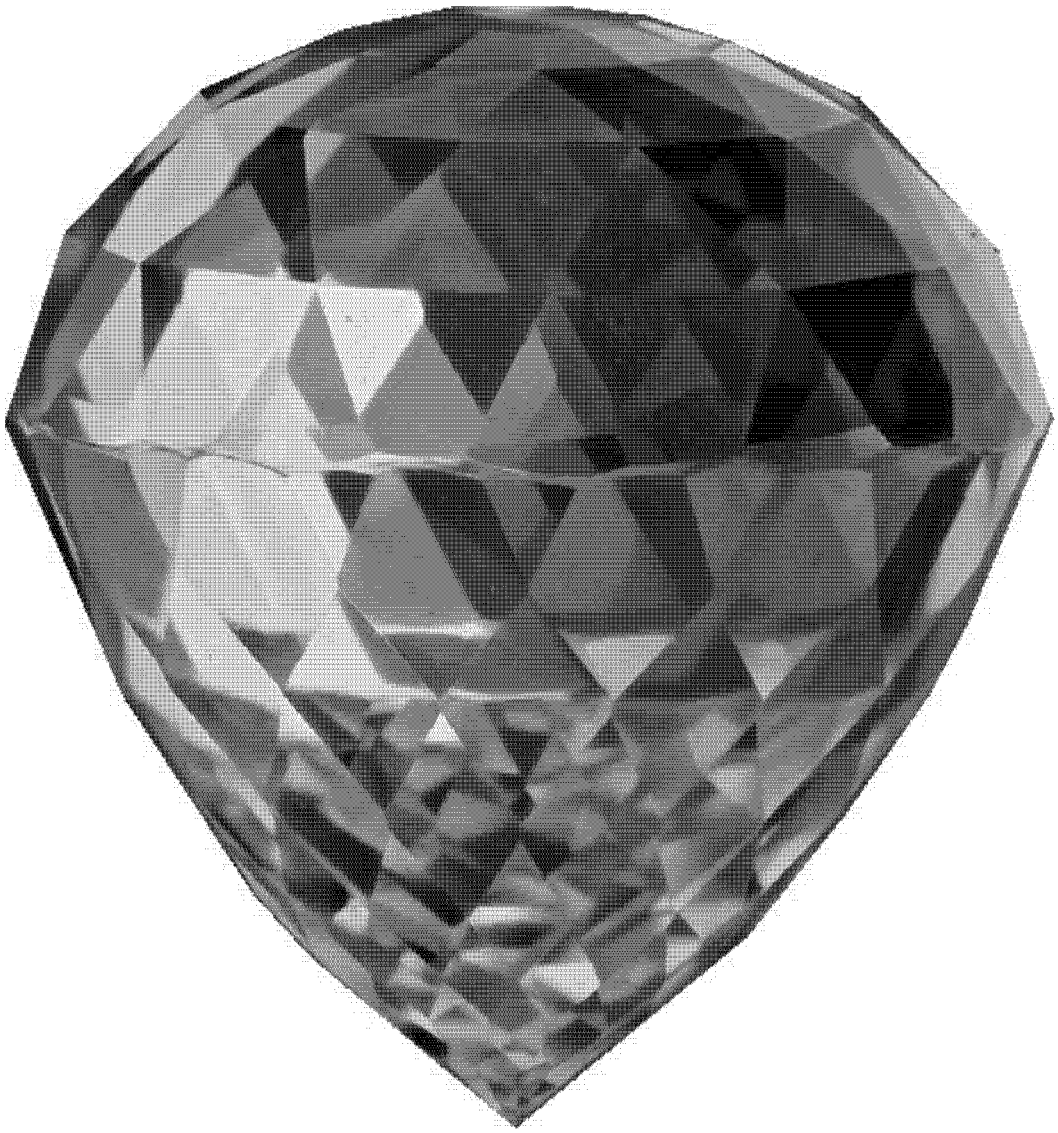
Figure 25C:
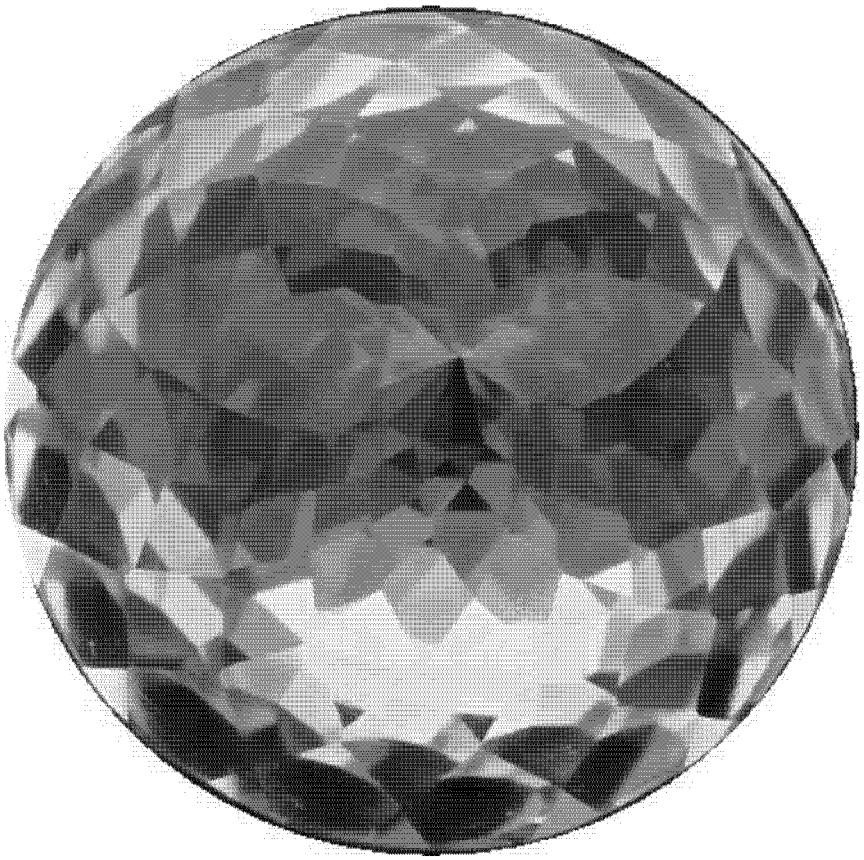

FIG. 25A illustrates a top view of a round yellow gem, FIG. 25B illustrates a side view of the round yellow gem in FIG. 25A, and FIG. 25C illustrates a bottom view of the round yellow gem in FIG. 25A.

Figure 26A:
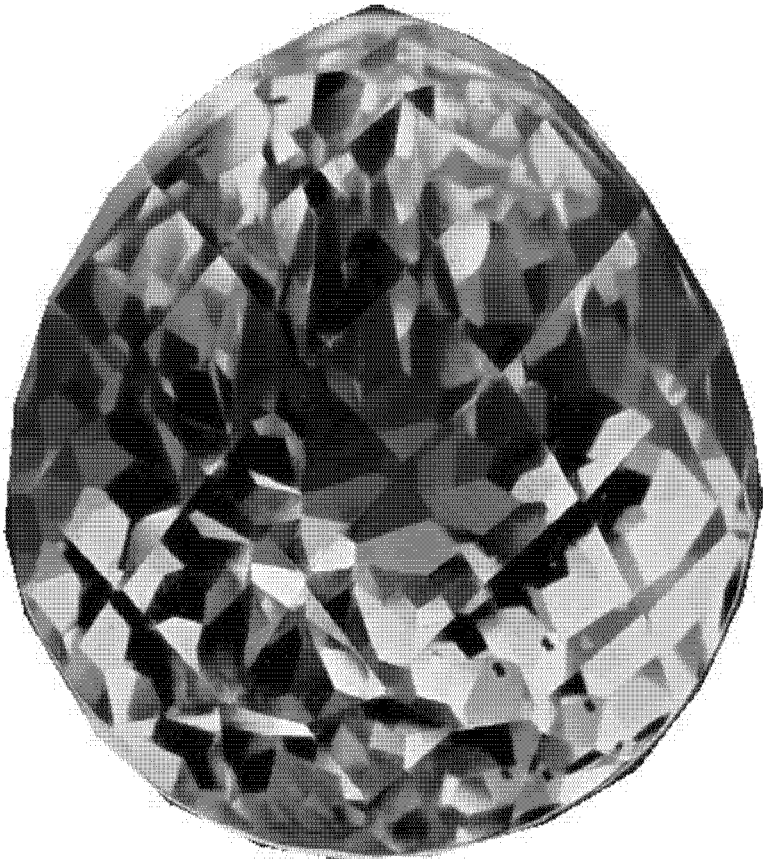
Figure 26B:
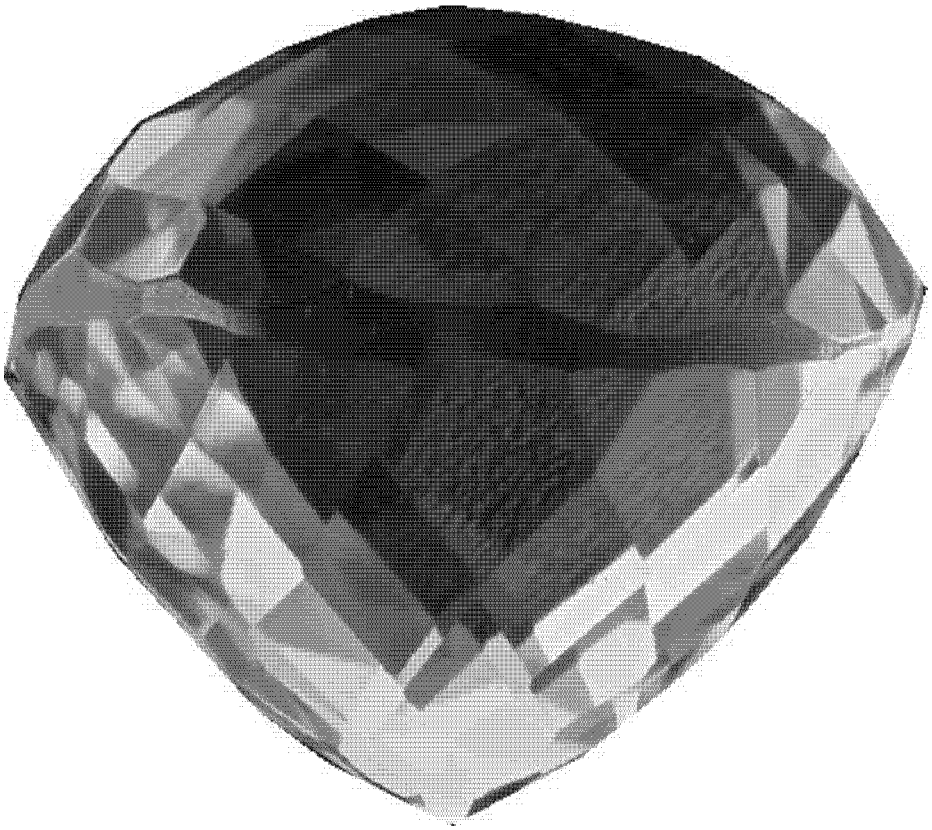
Figure 26C:
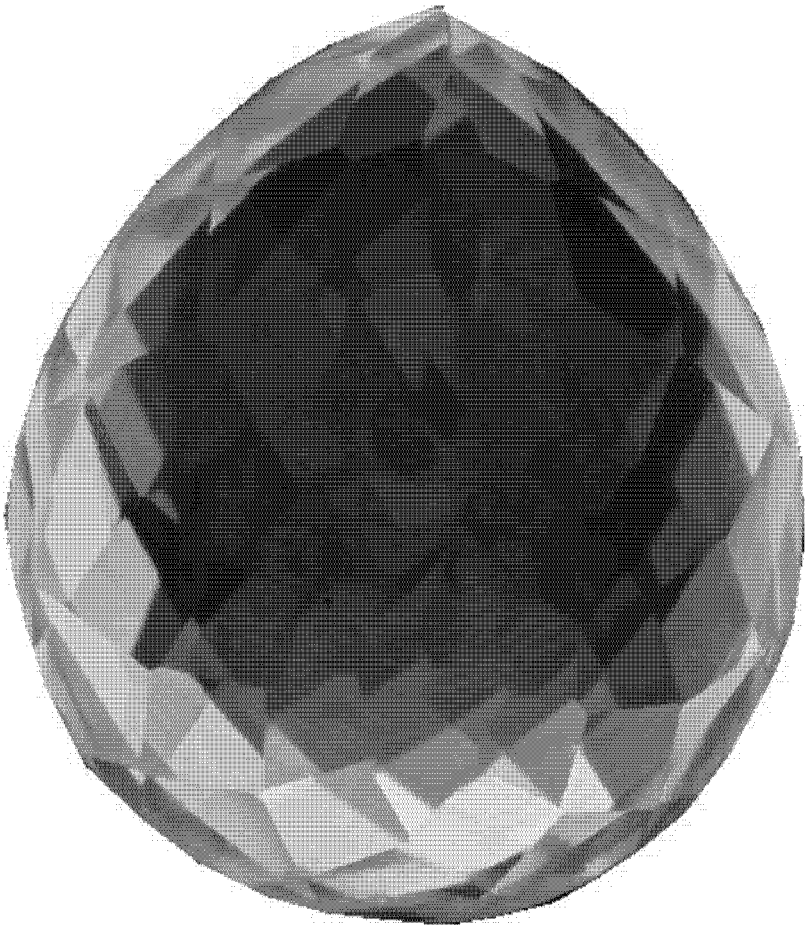

FIG. 26A illustrates a top view of a pear-shaped gem, FIG. 26B illustrates a side view of the pear-shaped gem in FIG. 26A, and FIG. 26C illustrates a bottom view of the pear-shaped gem in FIG. 26A.

Figure 27A:
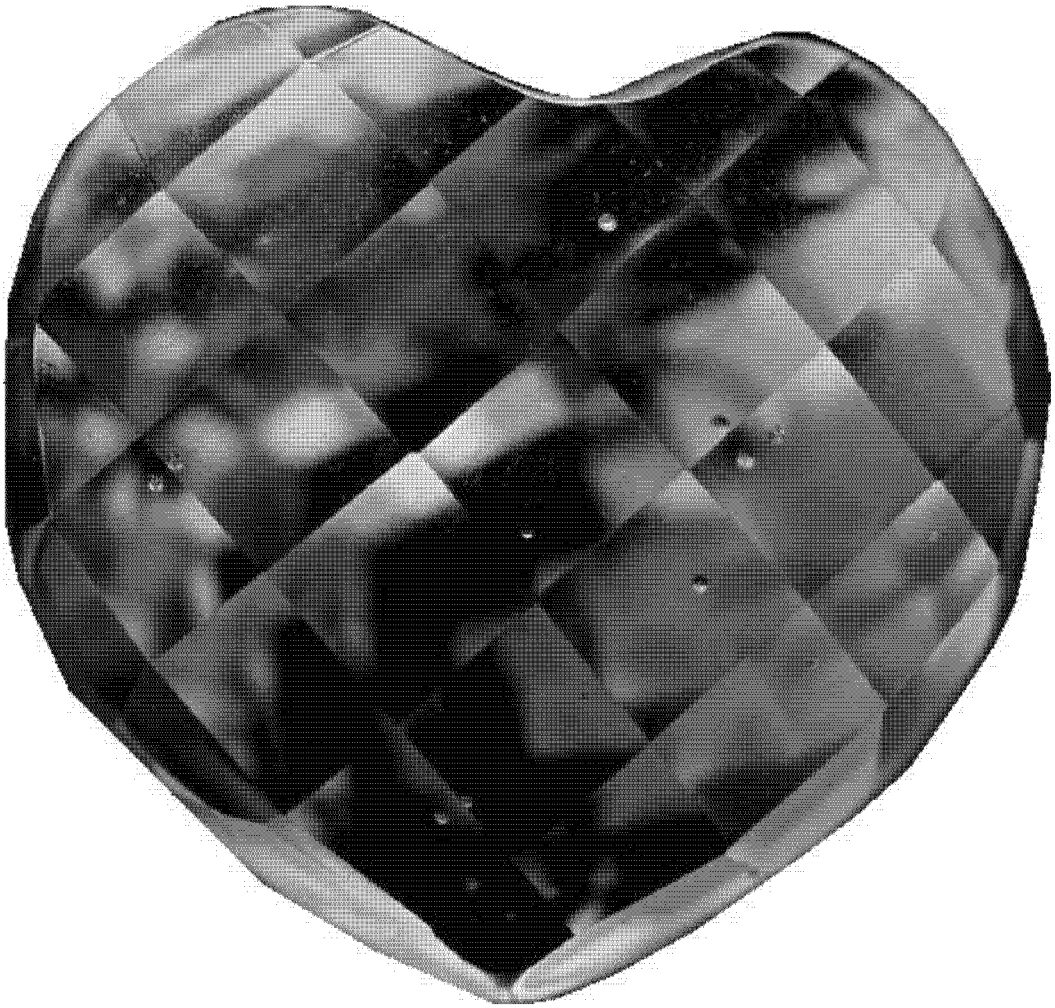
Figure 27B:
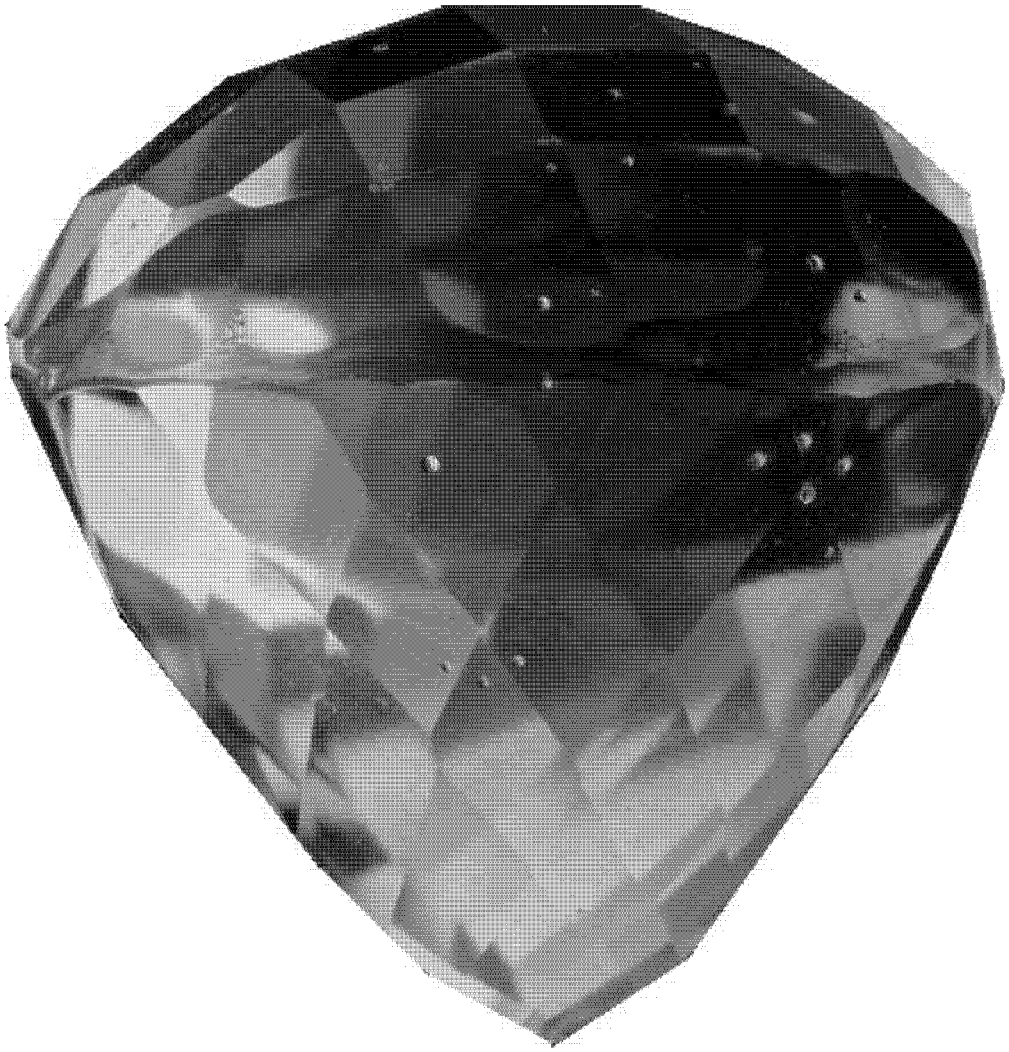
Figure 27C:
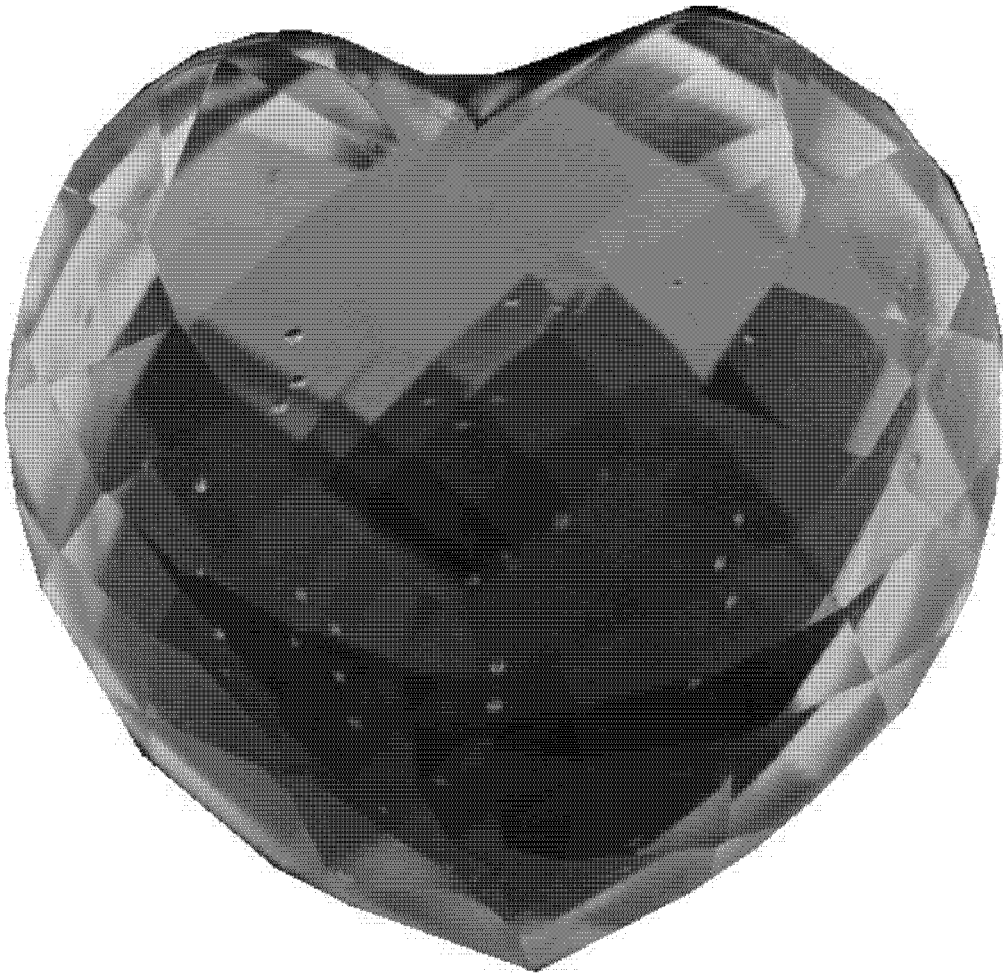

FIG. 27A illustrates a top view of a heart-shaped gem, FIG. 27B illustrates a side view of the heart-shaped gem in FIG. 27A, and FIG. 27C illustrates a bottom view of the heart-shaped gem in FIG. 27A.

Figure 28A:
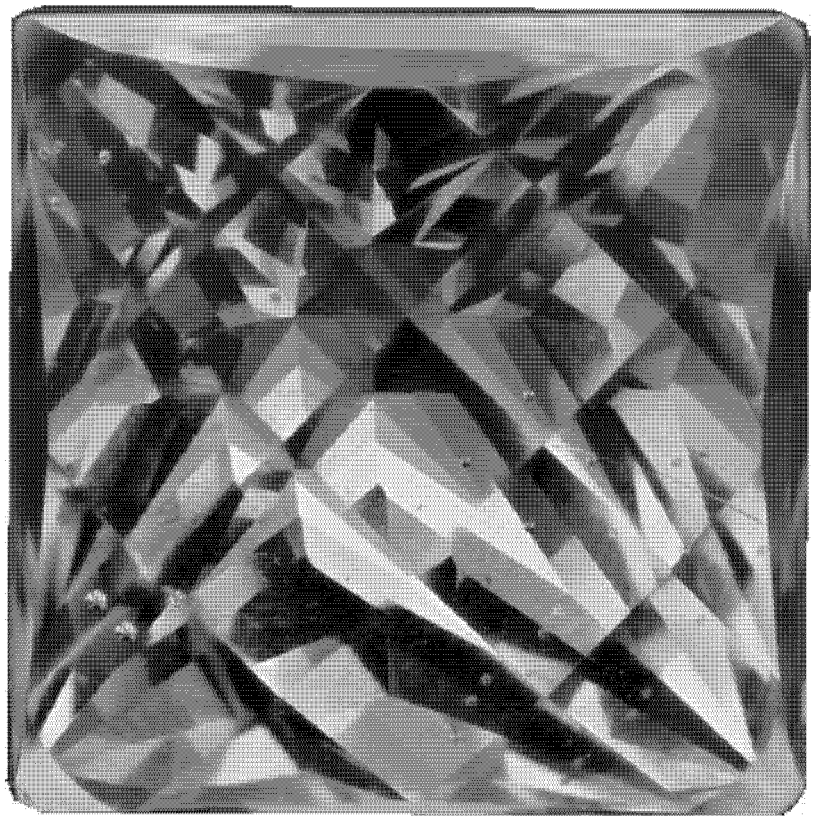
Figure 28B:
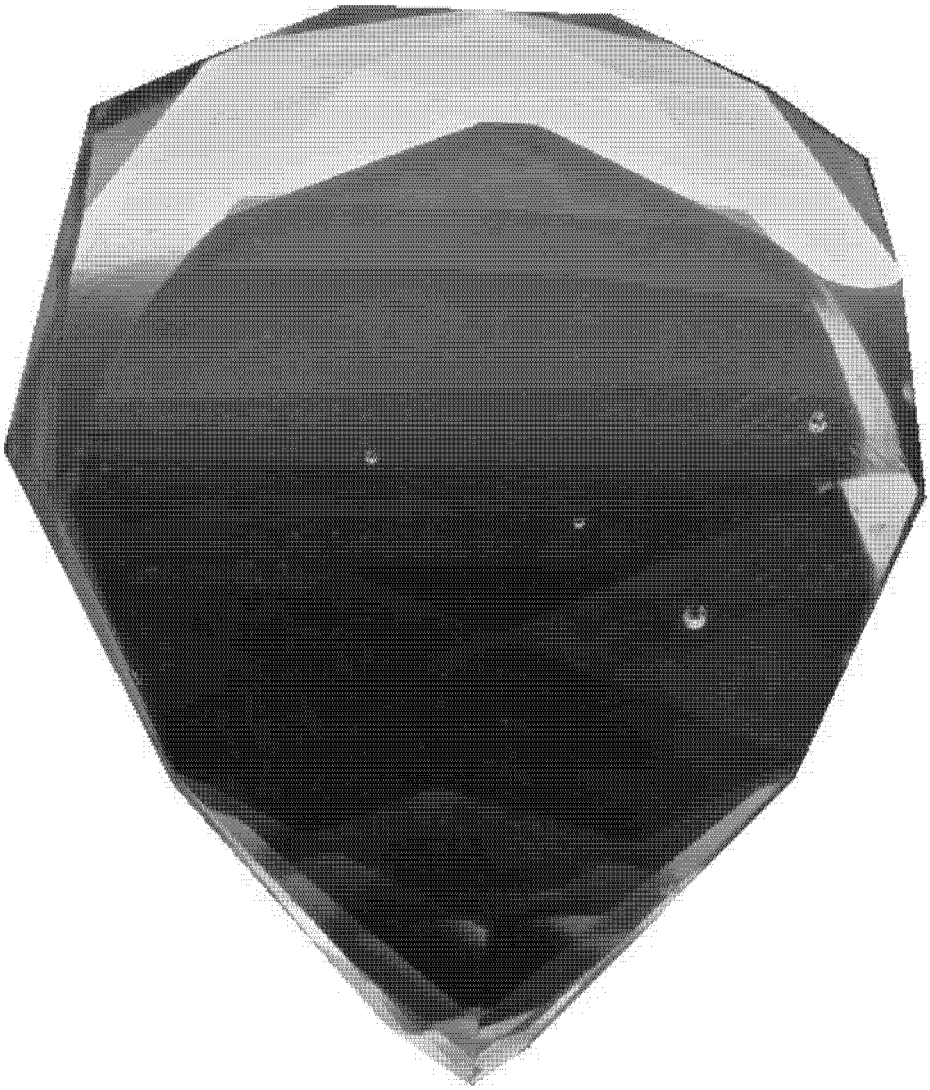
Figure 28C:
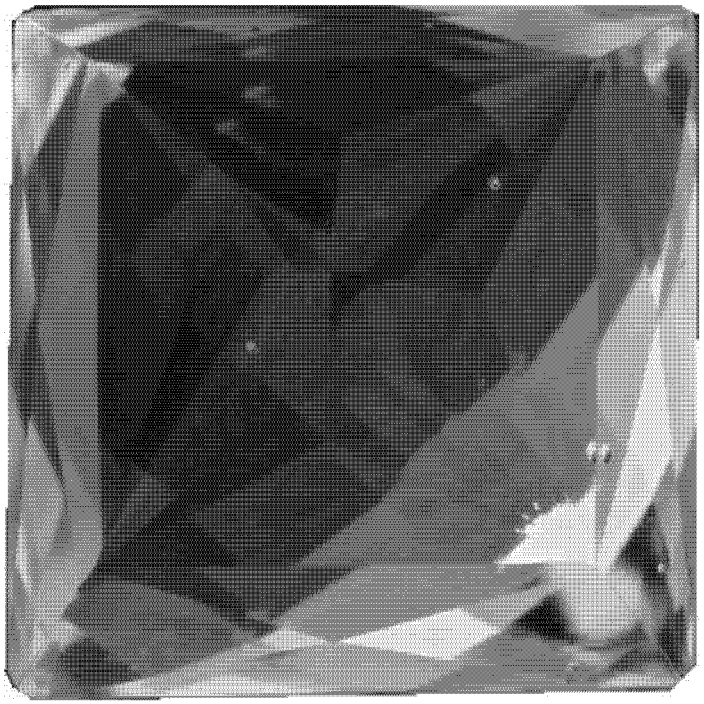

FIG. 28A illustrates a top view of a princess cut gem, FIG. 28B illustrates a side view of the princess cut gem in FIG. 28A, and FIG. 28C illustrates a bottom view of the princess cut gem in FIG. 28A.

Figure 29A:
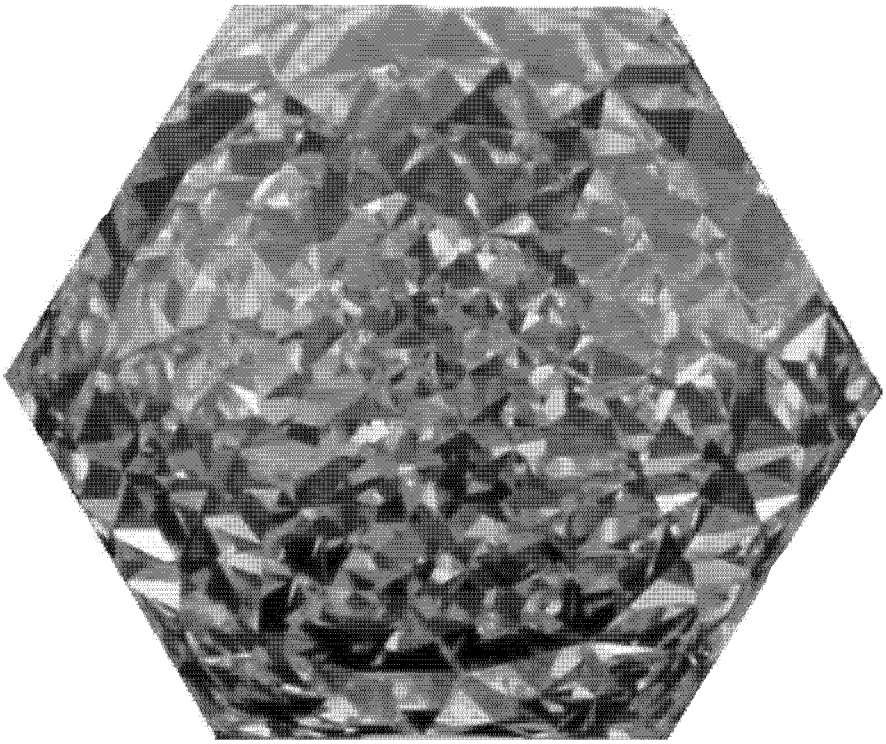
Figure 29B:
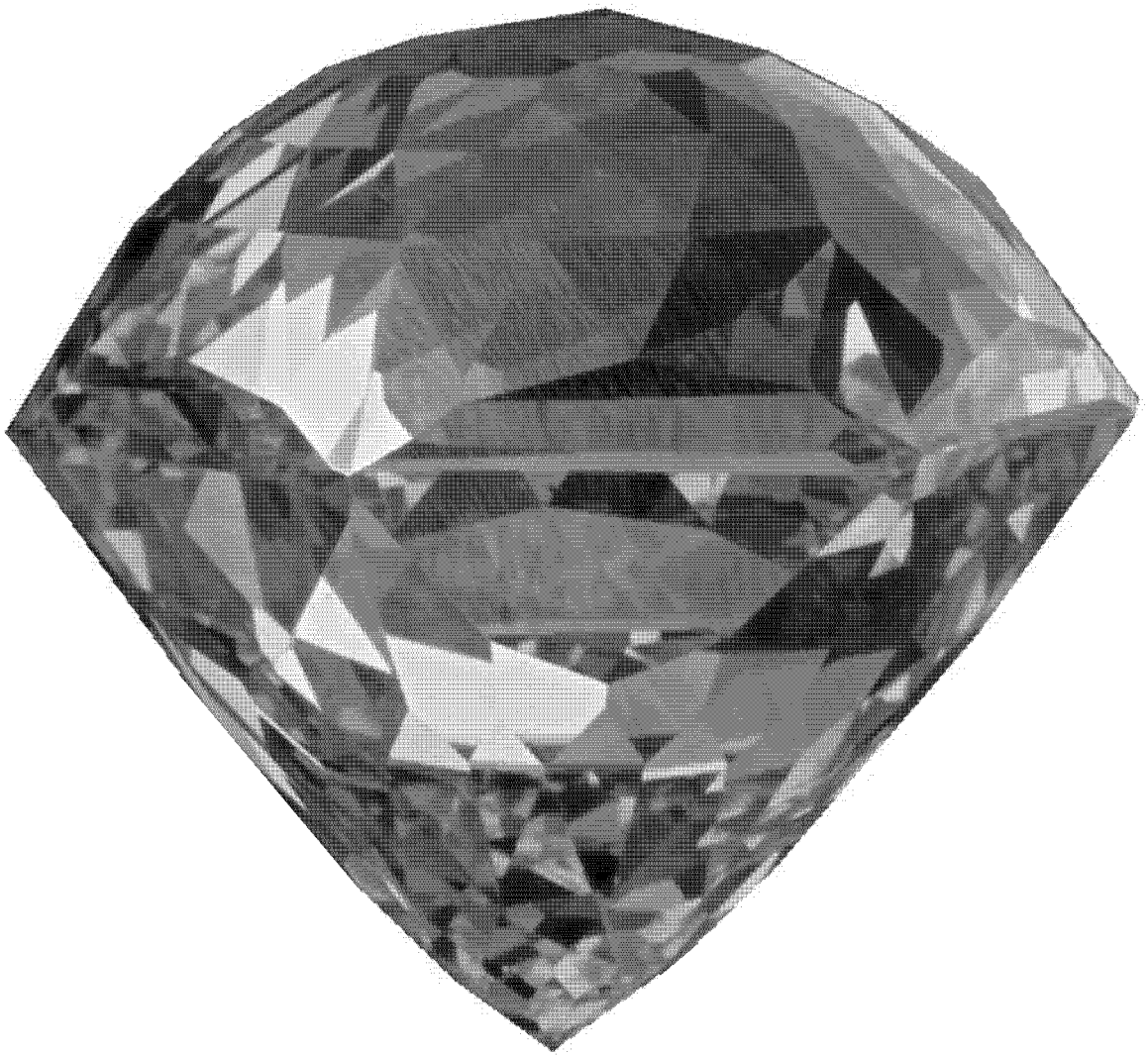
Figure 29C:
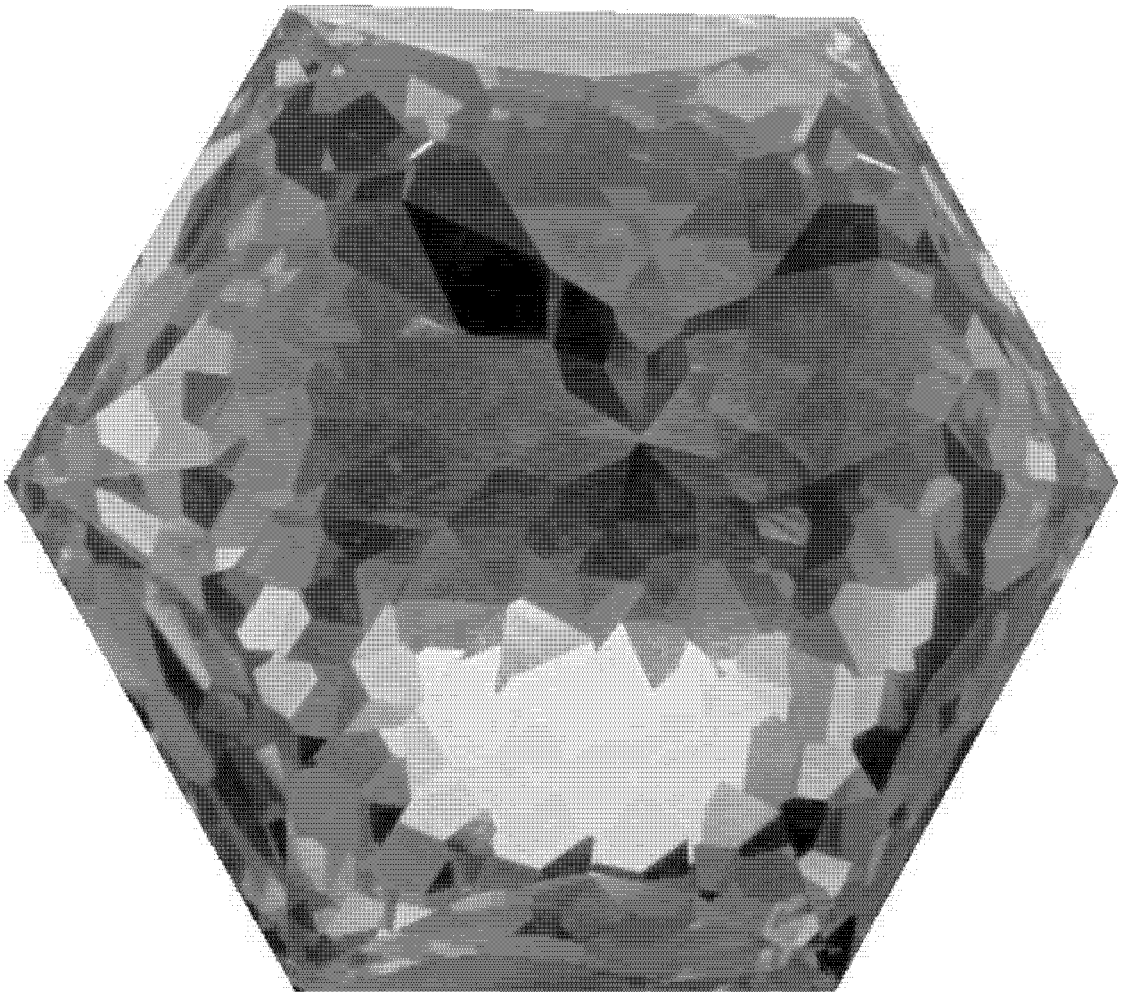

FIG. 29A illustrates a top view of a hexagonal gem, FIG. 29B illustrates a side view of the hexagonal cut gem in FIG. 29A, and FIG. 29C illustrates a bottom view of the hexagonal cut gem in FIG. 29A.

Figure 30A:
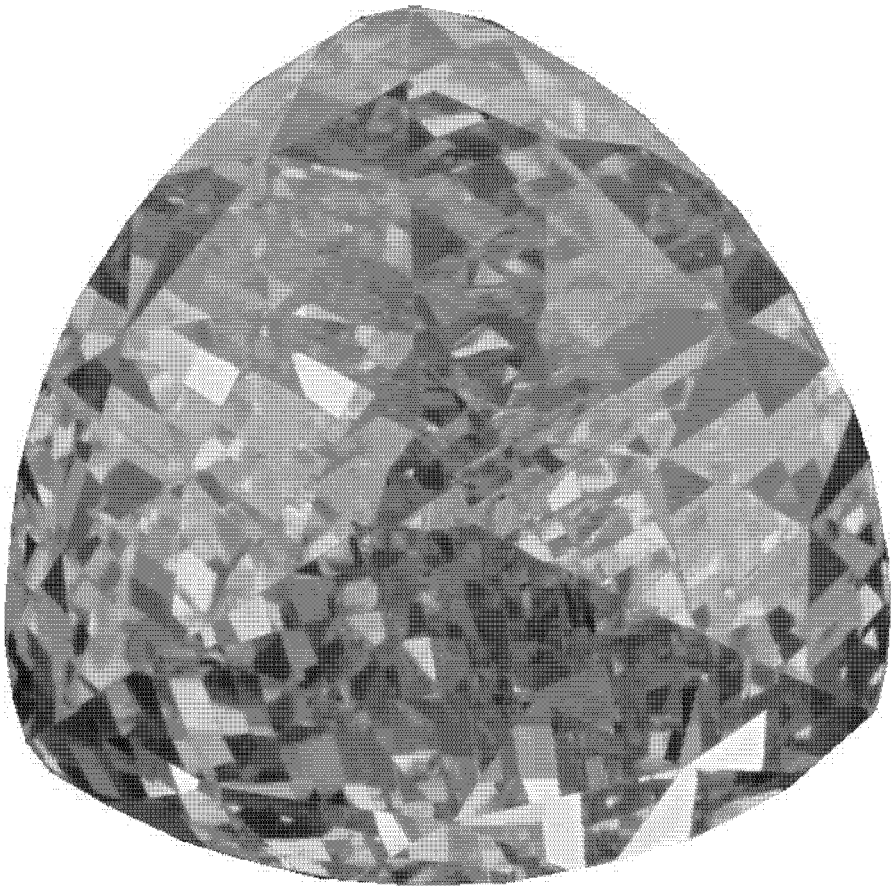
Figure 30B:
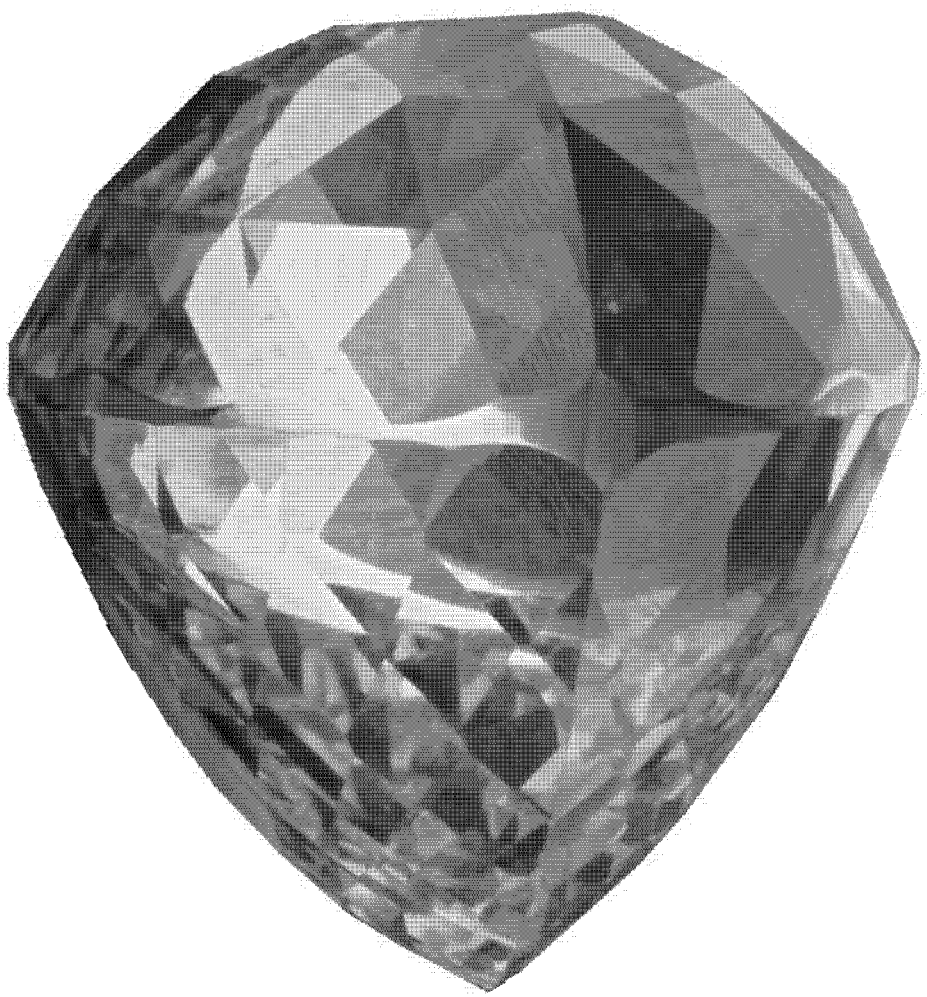
Figure 30C:
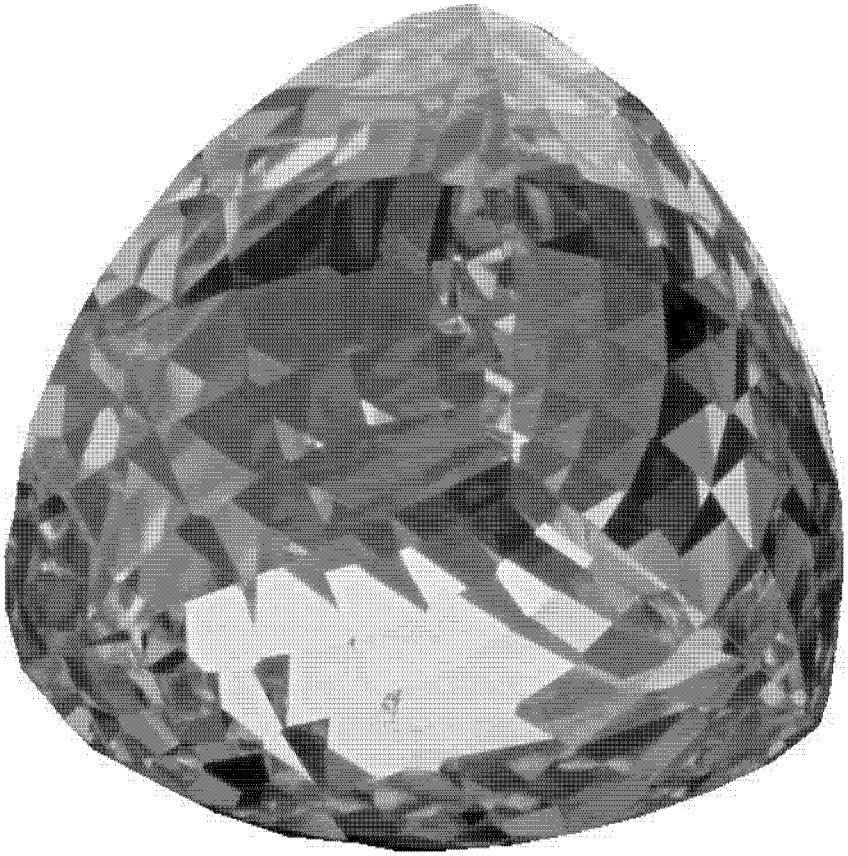

FIG. 30A illustrates a top view of a trilliant-shaped yellow gem, FIG. 30B illustrates a side view of a trilliant-shaped yellow gem in FIG. 30A, and FIG. 30C illustrates a bottom view of the trilliant-shaped yellow gem in FIG. 30A.

Figure 31A:
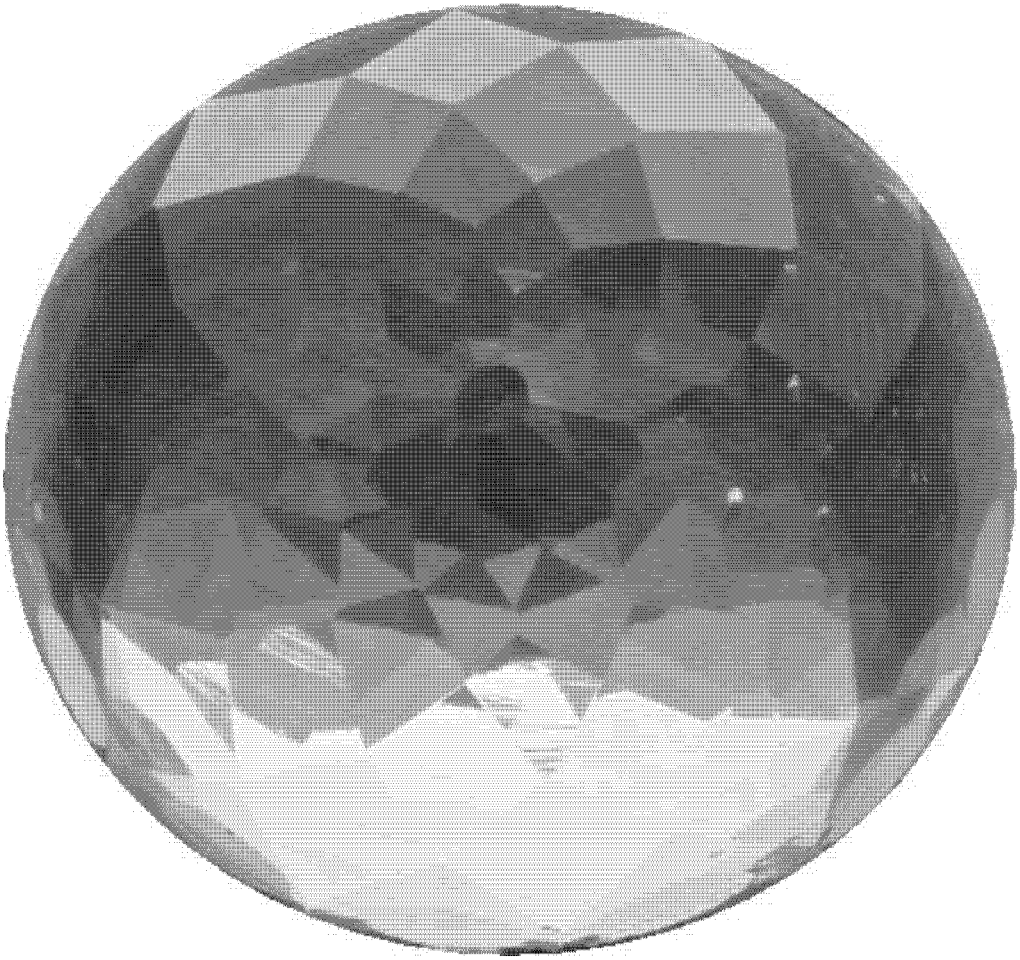
Figure 31B:
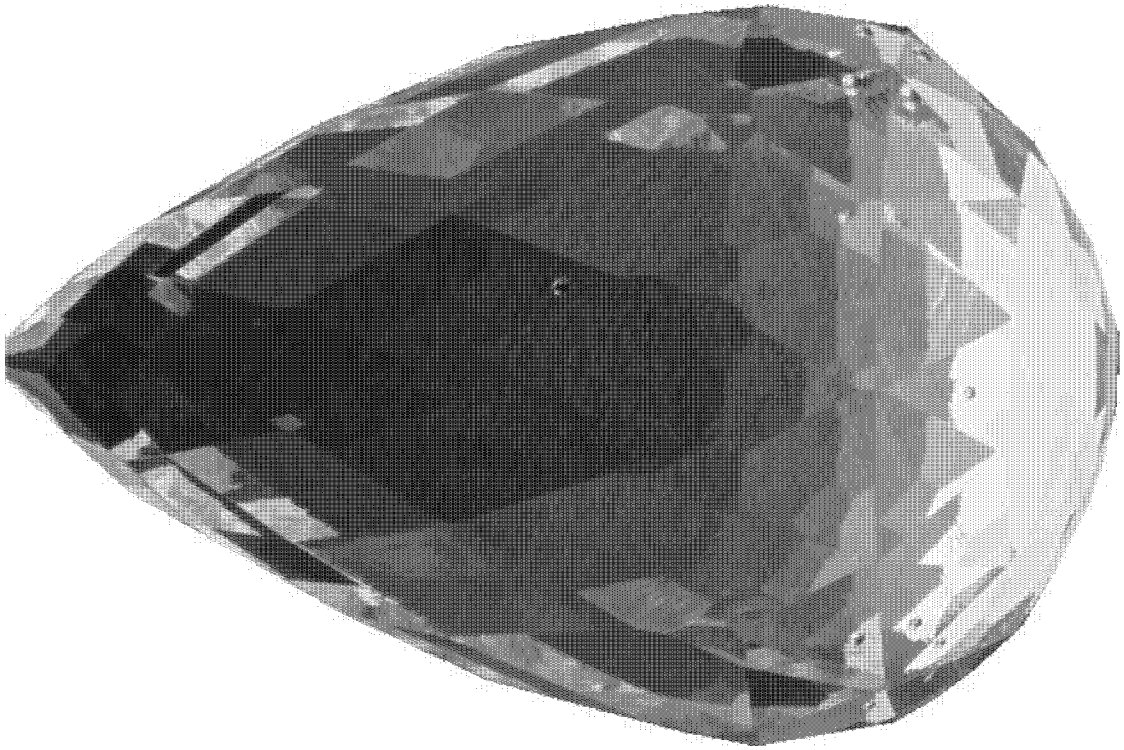
Figure 31C:
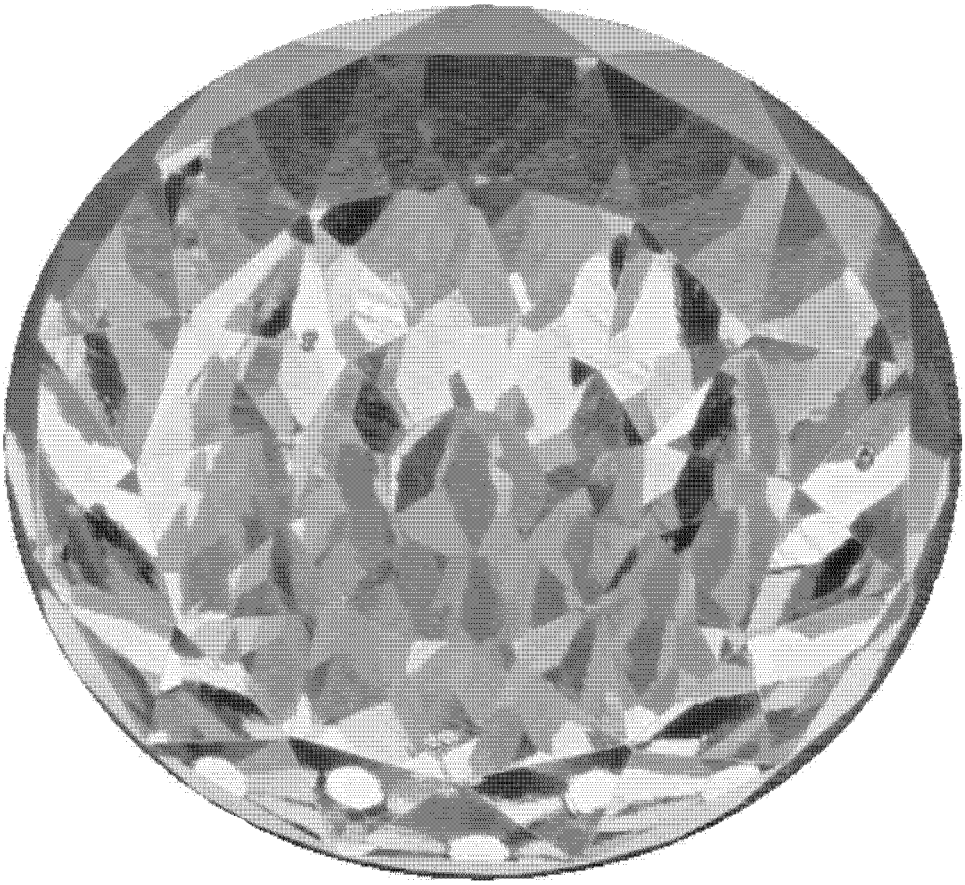

FIG. 31A illustrates a top view of a briolette cut gem, FIG. 31B illustrates a side view of the briolette cut gem in FIG. 31A, and FIG. 31C illustrates a bottom view of the briolette cut gem in FIG. 31A.

Table 1 below summarizes features of the designs shown in FIGS. 21A-31C.

TABLE 1

| FIGS. | Gem Description/ Shape (Material) | Table Facet Description | Facets just Below Table | No. of Facets Around Culet | Notes on gemstone |
|---|---|---|---|---|---|
| FIGS. 21A-21C | Round gem (glass) | Small, round, flat table | 12 polygons | 12 diamond shape | |
| FIGS. 22A-22C | Round gem (glass) | Small, round, flat table | 12 triangles | 8 diamond shape | |
| FIGS. 23A-23C | Oval gem (glass) | Small oval flat table | 12 polygons | 8 diamond shape | |
| FIGS. 24A-24C | Round gem (cubic zirconia) | Small, round flat table | 12 polygons | 16 slim diamond shape | Bright colors |
| FIGS. 25A-25C | Round gem (yellow cubic zirconia) | Small, round flat table | 12 polygons | 16 slim diamond shape | Bright colors |
| FIGS. 26A-26C | Pear shape (glass) | No table, Square facets on top | Square facets top | 7 diamond shape | |
| FIGS. 27A-27C | Heart shape (glass) | No table. Square facets on top | Square facets top | 3 polygons | Gem has triangular shape to pavilion; 3 facets form base. |
| FIGS. 28A-28C | Princess cut (glass) | No table. Square facets. | Polygon-faceted top | 8 slim triangles | Complex structure near culet |
| FIGS. 29A-29C | Hexagonal cut (yellow cubic zirconia) | No table; flat, very small facet on top (9 sides) | 9 five-sided polygons | 12 slim diamond facets | Very brilliant colors |
| FIGS. 30A-30C | Trilliant cut (yellow cubic zirconia) | No table. Very small triangles with (6 sides) | 6 four-sided facets | 6, four-sided facets | Triangular gem gives good color, sparkle, and beauty |
| FIGS. 31A-31C | Briolette cut (glass) | Small, flat, 12 sided table. | 12 four-sided facets | 12 facets diamond | Transparent, elongated, glass gem |

Figure 32:
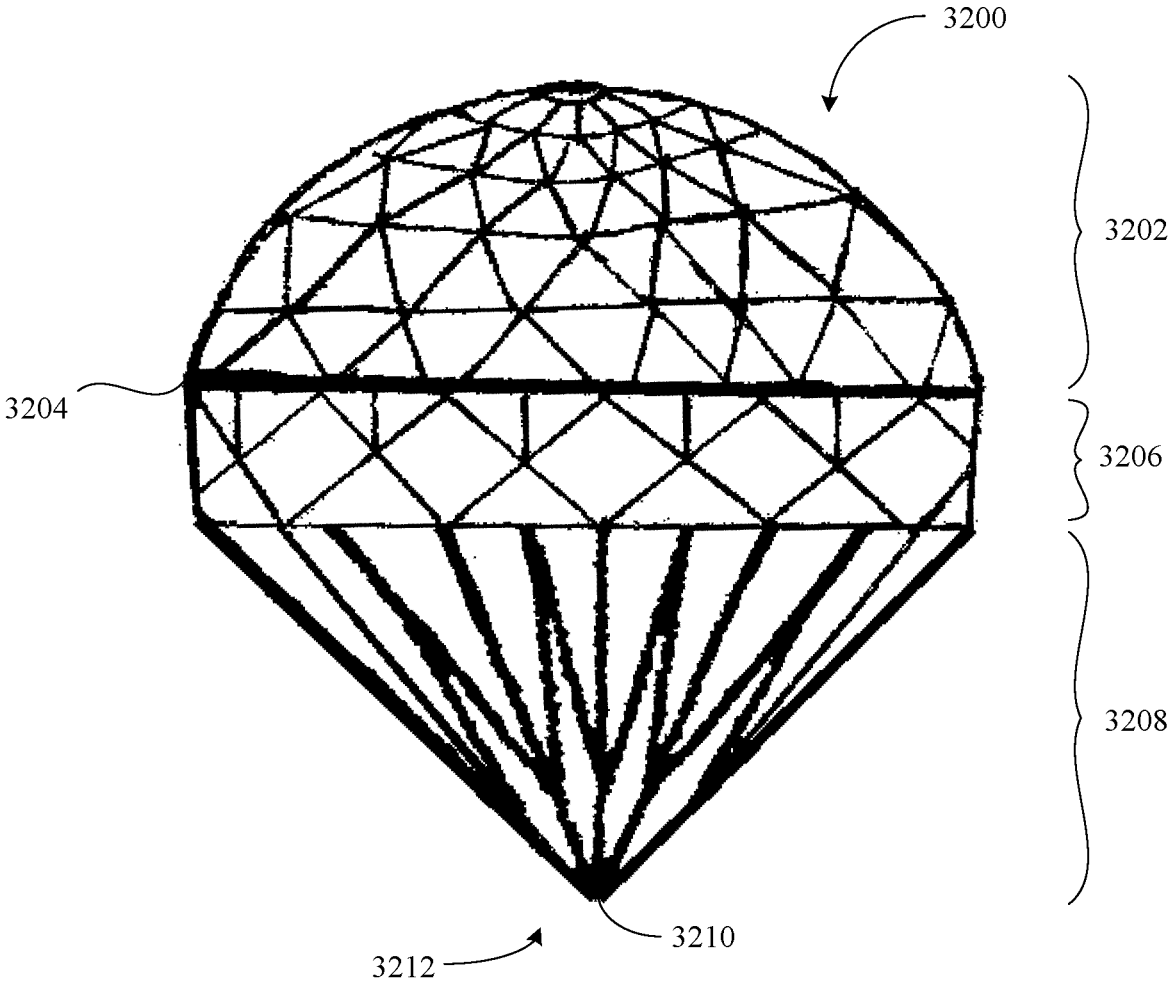
FIG. 32 illustrates a cross-section of a focal point brilliant spheroidal faceted gemstone according to yet another embodiment of the disclosure.

FIG. 32 illustrates a cross-section of a focal point brilliant spheroidal faceted gemstone 3200 according to yet another embodiment of the disclosure. The gemstone 3200 includes a hemispheroidal crown 3202 (i.e., from the top of gemstone to girdle 3204) that creates a focal point 3210 at the base 3212 of the gemstone 3200, as described herein. In the embodiment shown, the base 3212 of the gemstone 3200 comprises a sharp point. In other embodiments, the base 3212 may be a small flat surface or slightly rounded with small facets. The gemstone 3200 includes a pavilion 3208. In one embodiments, the pavilion 3208 may be cone-shaped, as shown. In one implementation, the pavilion 3208 may be similar to that of a present-day round brilliant pavilion.

The gemstone 3200 also includes a faceted band 3206 below the girdle 3204 and above the pavilion 3208. The faceted band 3206 is not found in present-day round brilliant cuts. The faceted band may comprise (from top to bottom) a first row of right-angle triangle facets, a second row of four-sided facets, and a third row of triangle facets, in the embodiment shown. Other embodiments having fewer or more rows for facets in the faceted band 3206 are within the scope of the disclosure. In some embodiments, any shape facets can be used in the faceted band 3206. In some implementations, the faceted band 3206 provides additional sparkle and saturated colors to edges of the gemstone 3200, while the base 3212 that corresponds to the focal point 3210 gives brilliant sparkle and saturated colors elsewhere throughout the gemstone 3200.

Figure 33A:
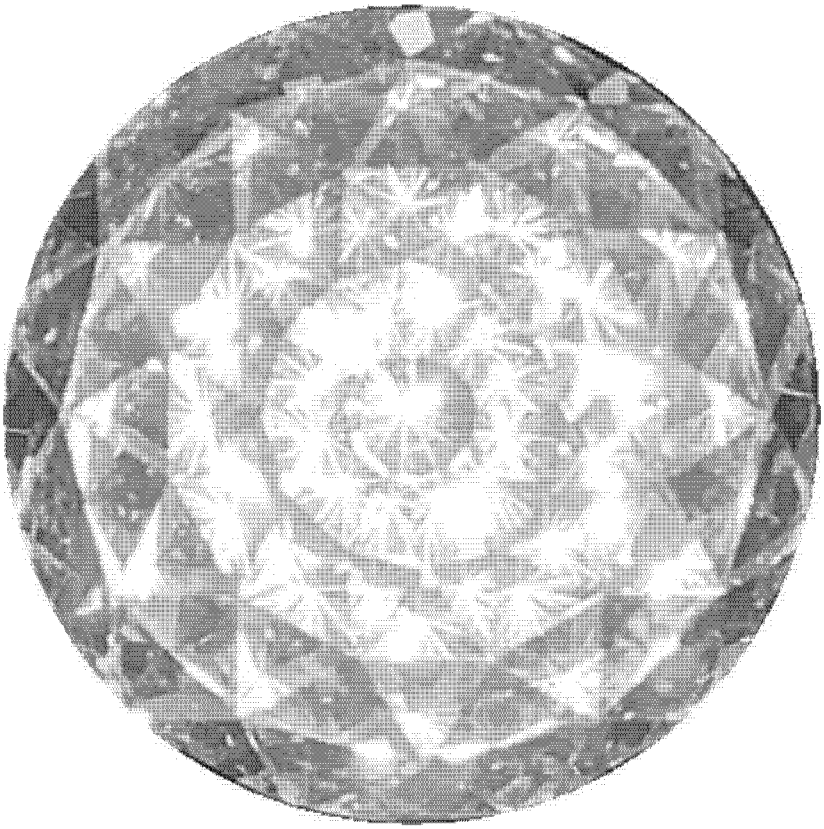
FIGS. 33A-33C illustrate an examples of the spheroidal faceted gemstone of FIG. 32, according to one embodiment.
Figure 33B:
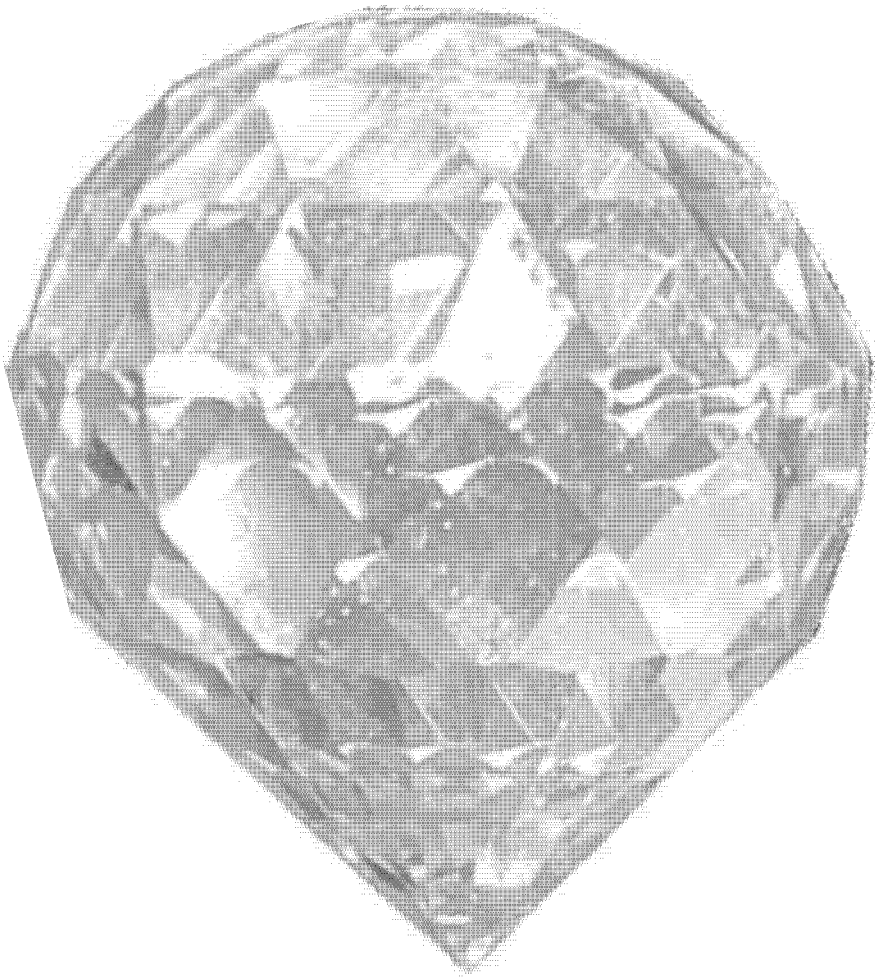
Figure 33C:
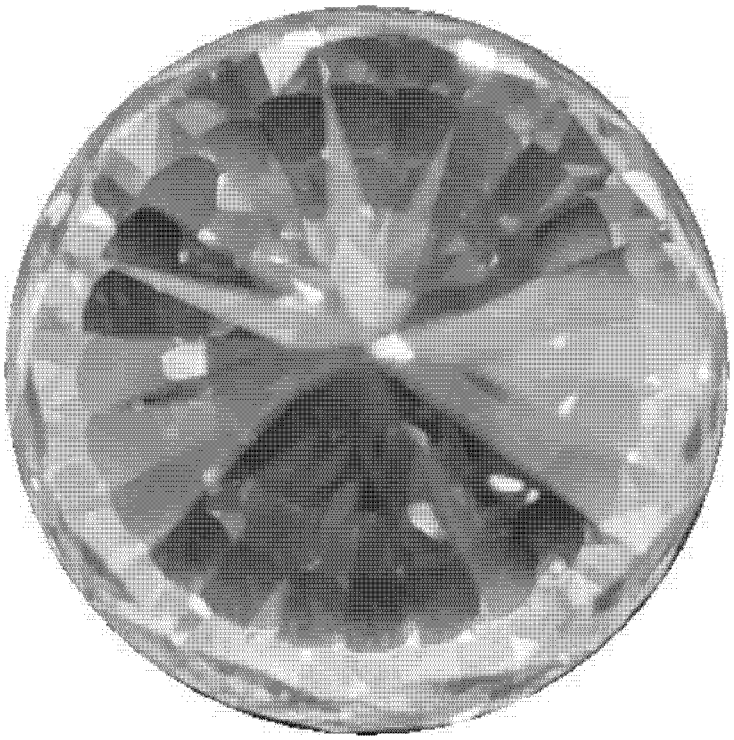

FIG. 33A illustrates a top view of a spheroidal faceted gemstone of FIG. 32, FIG. 33B illustrates a side view of the spheroidal faceted gemstone in FIG. 33A, and FIG. 33C illustrates a bottom view of the spheroidal faceted gemstone in FIG. 33A.

Figure 34:
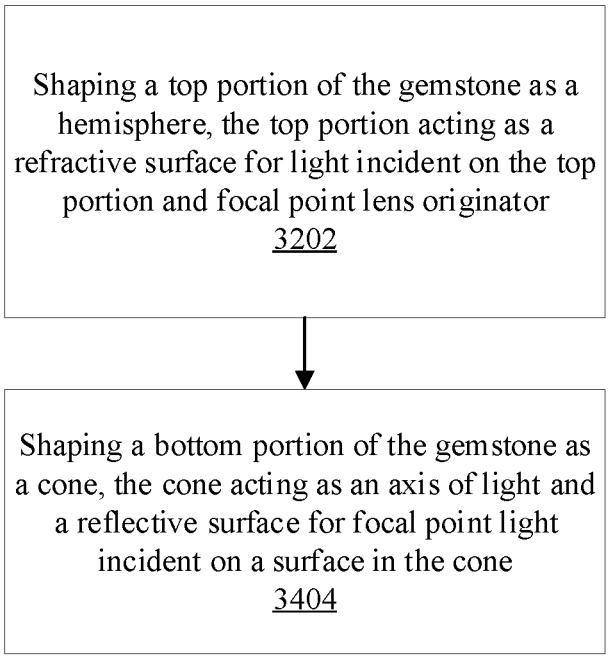
FIG. 34 is a method for faceting a gemstone, according to one embodiment.

FIG. 34 is a method for faceting a gemstone, according to one embodiment.

The method includes shaping a top portion of the gemstone as a hemisphere (or other spheroidal shape). The top portion acts as a refractive surface for light incident on the top portion and focal point lens originator (step 3402). The method further includes shaping a bottom portion of the gemstone as a cone, the cone acting as an axis of light and a reflective surface for focal point light incident on a surface in the cone (step 3404).

As such, incident light that interacts with the spheroidal top portion is focused to a focal point in the bottom portion. The light reflects once from the bottom portion and exits the gemstone out through the top portion of the gemstone.

As described herein, the dimensions of the gemstone may be calibrated based on the refractive index of the gem material.

In some embodiments, facets coinciding with the top portion (e.g., hemisphere) are cut into and aligned with the curved hemispheroidal top portion. Facets of the pavilion are cut on its cone-like curved surface and terminate at the culet. The focal point (i.e., point of maximum illumination crossing the axis of light in the pavilion) is where additional reflective facets can be located in the gemstone for additional resolution of reflective color and light upward through the surface facets of the top portion. The focal point crates a source of intense illumination to power the gemstone, which brightens the gemstone and gives brilliant, saturated colors in the gemstone.

Multiple-Gemstone Arrangements

In some embodiments, two or more gemstones that are faceted such as to create a focal point at or near the base of the gemstone (as described herein) can be arranged relative to one another in one jewelry piece. In some implementations, a largest gemstones of the arrangement may be referred to as the "mother" gemstone(s), where the other gemstones of the arrangement may be referred to as the "daughter" gemstone(s).

Figure 35A:
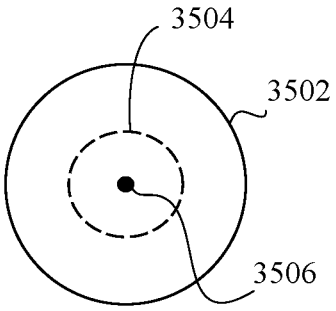
FIGS. 35A-35C illustrate views of an arrangement of two spheroidal faceted gemstones according to an embodiment of the disclosure.
Figure 35B:
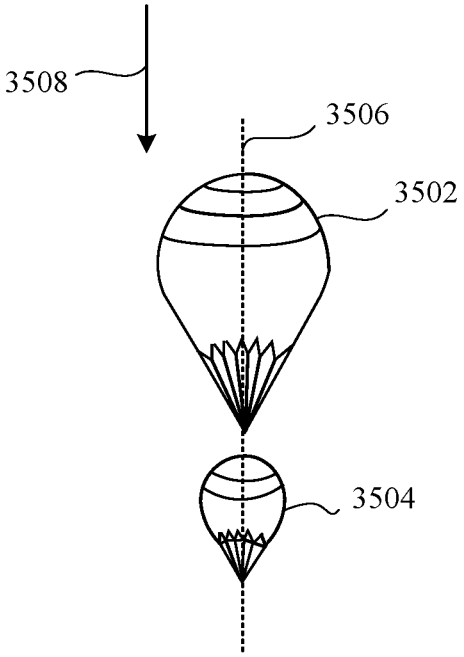
Figure 35C:
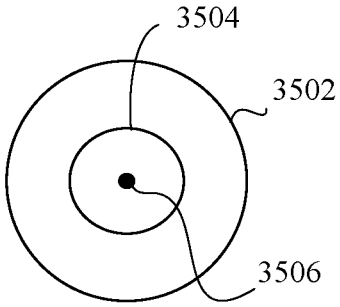

FIGS. 35A-35C illustrate views of an arrangement of two spheroidal faceted gemstones according to an embodiment of the disclosure, where FIG. 35A is a top view, FIG. 35B is a side view, and FIG. 35C is a bottom view. As shown, a first gemstone 3502 ("mother") is coaxially aligned along axis 3506 with a second gemstone 3504 ("daughter"), such that the light axis of the first first gemstone 3502 is the same as the light axis of the second first gemstone 3504, i.e., light axis 3506. The first gemstone 3502 is arranged above the second gemstone 3504 relative to the direction 3508 of incident light towards the gemstone arrangement. In one embodiment, the first gemstone 3502 and the second gemstone 3504 are made from the same gem material. In other embodiments, the first gemstone 3502 and the second gemstone 3504 are made from different gem materials. In various embodiments, the gemstones 3502, 3504 may have rounded surfaces or flat facets. In various embodiments, the bottom of the gemstones 3502, 3504 may be a sharp point, flat facet, or rounded bottom formed of a series of flat facets, or any other shape.

In one embodiment, when incident light enters the arrangement along direction 3508, the light interacts with the spheroidal crown of the first gemstone 3502 to create a focal point. In some configurations, the arrangement of the two gemstones can be such that the focal point of light interacting with the first gemstone 3502 is at the top (table) of the second gemstone 3404. In other embodiments, the focal point diameter corresponds to the culet of the first gemstone 3502. In some implementations, the diameter of the culet of the first gemstone 3502 is about equal or smaller in diameter to a diameter of a table of the second gemstone 3504. For example, the diameter of the culet of the first gemstone 3502 may be about 1-3 mm. In a single gemstone arrangement, a sharp point with narrow facets at the base of the gemstones may give good color and uniform brilliance across the crown. In a mother-daughter pair, a sharp point on the mother gemstone may interfere with acquiring colors and sparkle from the daughter; hence, a slightly rounded base with small flat facets for the mother gemstone may provide better color and sparkle acquisition from the daughter gemstone.

Some of the light that enters the first gemstone 3502 will be refracted such that it enters the second gemstone 3504. Other light may enter the second gemstone 3504 directly without first entering the first gemstone 3502. Light that enters the second gemstone 3504 is refracted to a focal point at the base of the second gemstone 3504, and then reflected back out the top of the second gemstone 3504. The light exiting the second gemstone 3504 then enters the first gemstone 3502, and then exits the first gemstone 3502. In some implementations, the colors radiating from the first (mother) gemstone 3502 in the two-gemstone arrangement are more numerous than from a single gemstone itself, more saturated in color, more intense in illumination, may be more evenly spaced across the crown of the first (mother) gemstone 3502, and the body color of the second gemstone 3504 is acquired by the first gemstone 3502, unless the second gemstone 3504 is colorless. In the disclosed arrangement, both gemstones 3502, 3504 may exhibit excellent beauty in colors and brilliance.

Figure 36A:
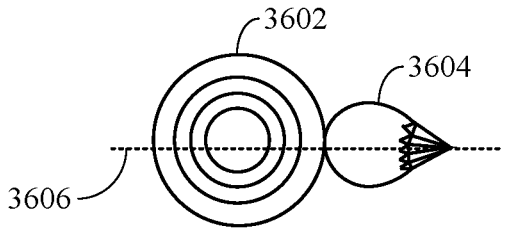
FIGS. 36A-36C illustrate views of another arrangement of two spheroidal faceted gemstones according to an embodiment of the disclosure.
Figure 36B:
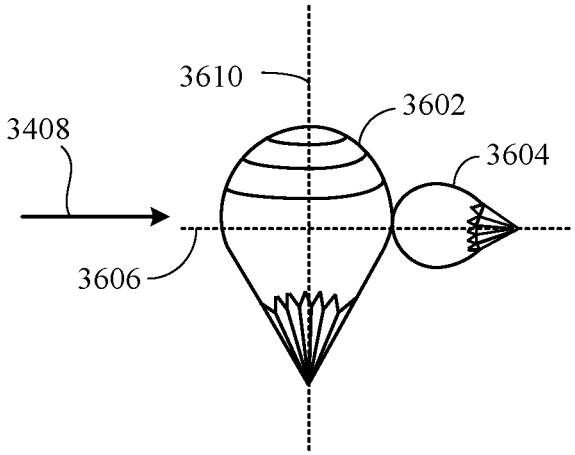
Figure 36C:
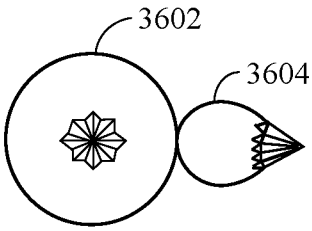

FIGS. 36A-36C illustrate views of an arrangement of two spheroidal faceted gemstones according to an embodiment of the disclosure, where FIG. 36A is a top view, FIG. 36B is a side view, and FIG. 36C is a bottom view. As shown, a second gemstone 3604 ("daughter") is aligned along a light axis 3606 that is perpendicular to a light axis 3610 of the first gemstone 3602 ("mother"). In one embodiment, the first gemstone 3602 and the second gemstone 3604 are made from the same gem material. In other embodiments, the first gemstone 3602 and the second gemstone 3604 are made from different gem materials. For example, when the second gemstone 3604 is colored and the first gemstone 3602 is colorless, the second gemstone 3604 can impart color to the first gemstone. When incident light enters the arrangement along direction 3608, the light interacts with the second gemstone 3604 and reflects from a focal point within the second gemstone 3604. The reflected light from the focal point within the second gemstone 3604 then illuminates the first gemstone 3602. In various embodiments, the gemstones 3602, 3604 may have rounded surfaces or flat facets. In various embodiments, the bottom of the gemstones 3602, 3604 may be a sharp point, flat facet, or rounded bottom formed of a series of flat facets, or any other shape. Both gemstones 3602, 3604 may have sharp points to reflect light to their respective crowns.

Figure 37A:
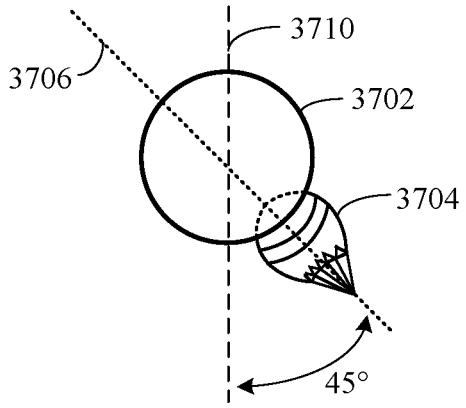
FIGS. 37A-37C illustrate views of yet another arrangement of two spheroidal faceted gemstones according to an embodiment of the disclosure.
Figure 37B:
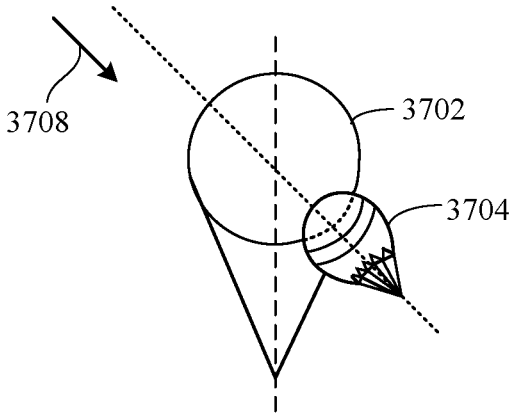
Figure 37C:
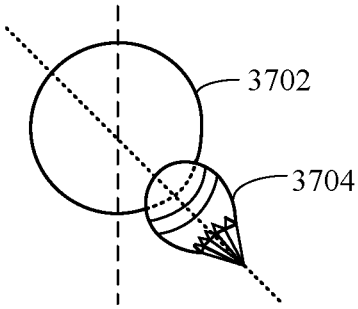

FIGS. 37A-37C illustrate views of an arrangement of two spheroidal faceted gemstones according to an embodiment of the disclosure, where FIG. 37A is a top view, FIG. 37B is a side view, and FIG. 37C is a bottom view. As shown, a second gemstone 3704 ("daughter") is aligned along a light axis 3706 that is at a 45° angle relative to a light axis 3710 of the first gemstone 3702 ("mother"). The second gemstone 3704 is arranged below and to the side of the first gemstone 3702 and is angled up towards the first gemstone 3702 at a 45° angle. In one embodiment, the first gemstone 3702 and the second gemstone 3704 are made from the same gem material. In other embodiments, the first gemstone 3702 and the second gemstone 3704 are made from different gem materials. When incident light enters the arrangement along direction 3708, some of the light interacts with the second gemstone 3704 and reflects from a focal point within the second gemstone 3704. The reflected light from the focal point within the second gemstone 3704 then augments illumination in the first gemstone 3702. In various embodiments, the gemstones 3702, 3704 may have rounded surfaces or flat facets. In various embodiments, the bottom of the gemstones 3702, 3704 may be a sharp point, flat facet, or rounded bottom formed of a series of flat facets, or any other shape. Once again, to reflect upward as much light as possible to both crowns, sharp, even facets may be used.

In some embodiments, both the first ("mother") and the second ("daughter") gemstones shown in FIGS. 35A-37C are faceted to provide self-illumination with a rounded spheroidal crown that creates a focal point at or near the base of the pavilion. In some embodiments, the first ("mother") gemstones shown in FIGS. 35A-37C are faceted to provide self-illumination with a rounded spheroidal crown that creates a focal point at or near the base of the pavilion, and the second ("daughter") gemstones may be conventional round brilliant gemstones or other gemstones that may have any other gem cut.

Figure 38A:
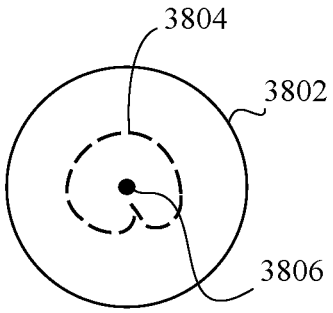
FIGS. 38A-38C illustrate views of an arrangement of a spheroidal faceted gemstone and a heart-shaped gemstone according to an embodiment of the disclosure.
Figure 38B:
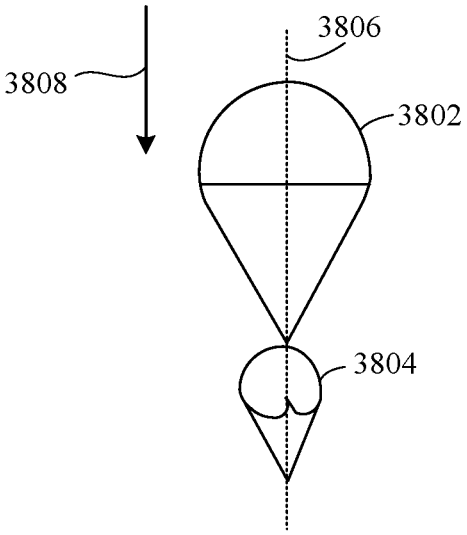
Figure 38C:
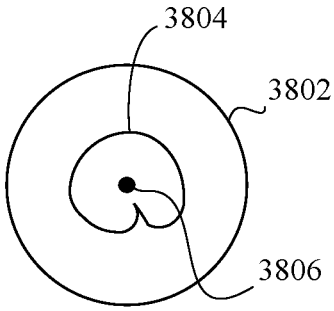

FIGS. 38A-38C illustrate views of an arrangement of a spheroidal faceted gemstone and a heart-shaped gemstone according to an embodiment of the disclosure, where FIG. 38A is a top view, FIG. 38B is a side view, and FIG. 38C is a bottom view. As shown, a first gemstone 3802 ("mother") is coaxially aligned along axis 3806 with a second gemstone 3804 ("daughter"), such that the light axis of the first first gemstone 3802 is the same as the light axis of the second first gemstone 3804, i.e., light axis 3806. The first gemstone 3802 is arranged above the second gemstone 3804 relative to the direction 3808 of incident light towards the gemstone arrangement. In one embodiment, the first gemstone 3802 and the second gemstone 3804 are made from the same gem material. In other embodiments, the first gemstone 3802 and the second gemstone 3804 are made from different gem materials. The reflected light from the second gemstone 3804 then augments illumination, sparkle, and/or body color into the first gemstone 3802.

In various embodiments, in mother-daughter pairs with coaxial alignment, one arrangement for the bottom of the pavilion of the mother is to have a slightly rounded base made up of flat facets and the daughter has a sharp point base. Such an arrangement allows a free exchange of illumination from the mother to the daughter gemstone, yet good reflection from the daughter gemstone.

Figure 39A:
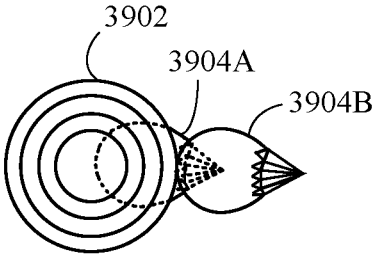
FIGS. 39A-39C illustrate views of an arrangement of three spheroidal faceted gemstones according to an embodiment of the disclosure.
Figure 39B:
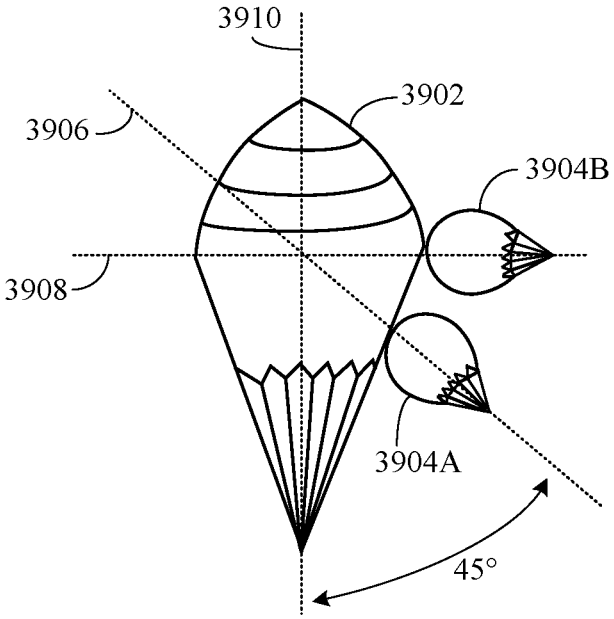
Figure 39C:
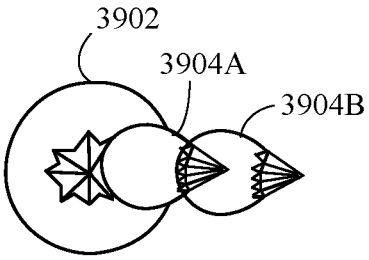
Figure 40A:
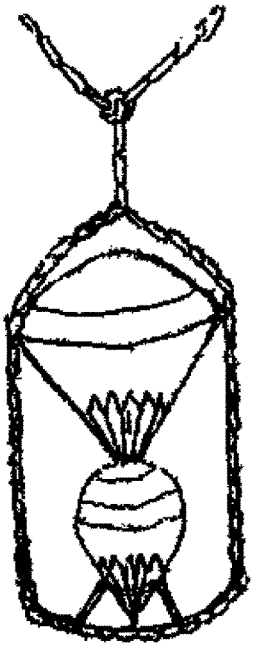
FIGS. 40A-40D illustrate various examples of multiple spheroidal faceted gemstones in a pendant according to various embodiments of the disclosure.
Figure 40B:
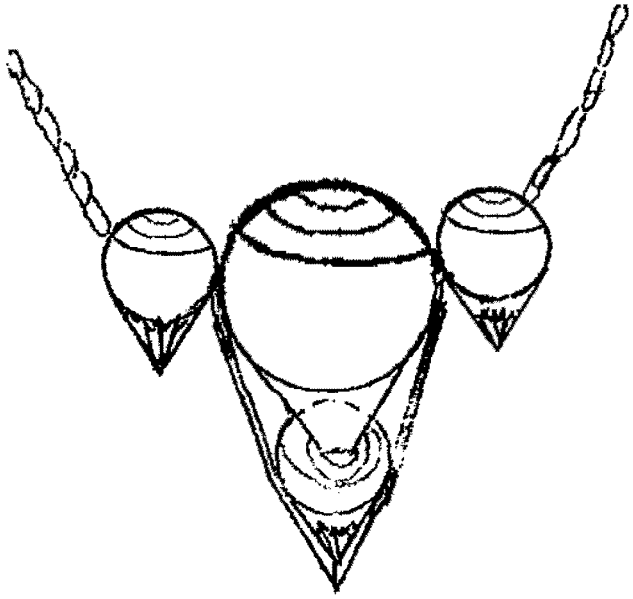
Figure 40C:
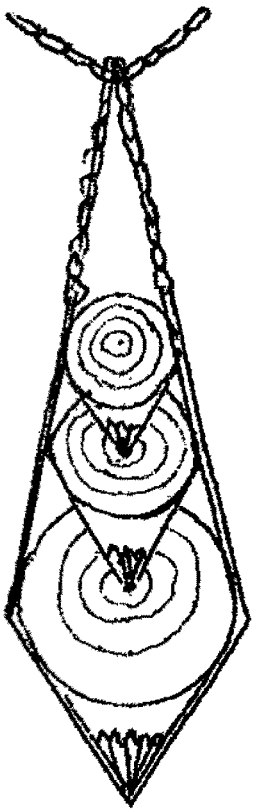
Figure 40D:
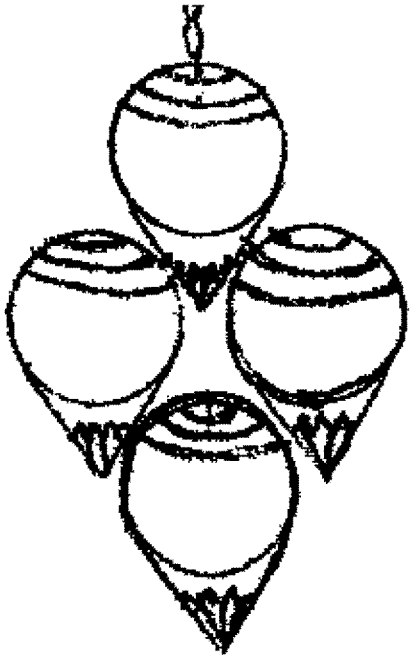

In some embodiments, two or more "daughter" gemstones can be provided in an arrangement with a single "mother" gemstone, as shown in FIGS. 39A-39C.

FIGS. 39A-39C illustrate views of an arrangement of three spheroidal faceted gemstones according to an embodiment of the disclosure, where FIG. 39A is a top view, FIG. 39B is a side view, and FIG. 39C is a bottom view. As shown, a first gemstone 3902 ("mother") has light axis 3910. Two additional gemstones 3904A, 3904B ("daughter" gemstones) are included in the arrangement. Gemstone 3904B is aligned along a light axis 3908 that is perpendicular to the light axis 3910 of the first gemstone 3902 ("mother"). Gemstone 3904A is aligned along a light axis 3906 that is at a 45° angle relative to a light axis 3910 of the first gemstone 3902 ("mother").

In one embodiment, the first gemstone 3902 and the second gemstones 3904A, 3904B are made from the same gem material. In other embodiments, the first gemstone 3902 and the second gemstones 3904A, 3904B can be made from different gem materials.

When incident light enters the arrangement along direction of light axis 3906, incident light interacts with the first gemstone 3902, then the light interacts with the second gemstone 3904A and reflects from a focal point within the second gemstone 3904A. The reflected light from the focal point within the second gemstone 3904A then augments illumination in the first gemstone 3902.

When incident light enters the arrangement along direction of light axis 3908B, incident light interacts with the first gemstone 3902, then the light interacts with the second gemstone 3904B and reflects from a focal point within the second gemstone 3904B. The reflected light from the focal point within the second gemstone 3904B then augments illumination in the first gemstone 3902.

In various embodiments, potential daughter gem materials include minerals (e.g., precious fire or jelly, black opal). Also, in some embodiments, the daughter gemstones may include ornamental features, such as letters, numbers, symbols, animals, birds etc., which may be etched into the gem materials. Upon illumination of the daughter gemstone, the ornamental features can be transferred into and optically replicated one or more times in the larger mother gemstone.

One example arrangement provides body color suffusion and other optic illumination and gem feature transformation along coaxial light axe. A 5 mm diameter round brilliant faceted daughter cubic zirconia gemstone with canary yellow body color can be coaxially arranged below a 15 mm diameter mother transparent focal point brilliant (e.g., focal point-creating) glass gemstone. Upon illumination, the daughter cubic zirconia transfers its gem brightness, color, brilliance, and sparkle into and completely engulfs the mother gemstone, causing the effect of a 9-fold size increase of the canary yellow cubic zirconia gemstone.

Two or more gemstones can be arranged in a jewelry piece in a variety of ways, including in pendants, broaches, bracelets, and rings, for example.

FIGS. 40A-40D illustrate various examples of multiple spheroidal faceted gemstones in a pendant according to various embodiments of the disclosure.

Figure 41A:
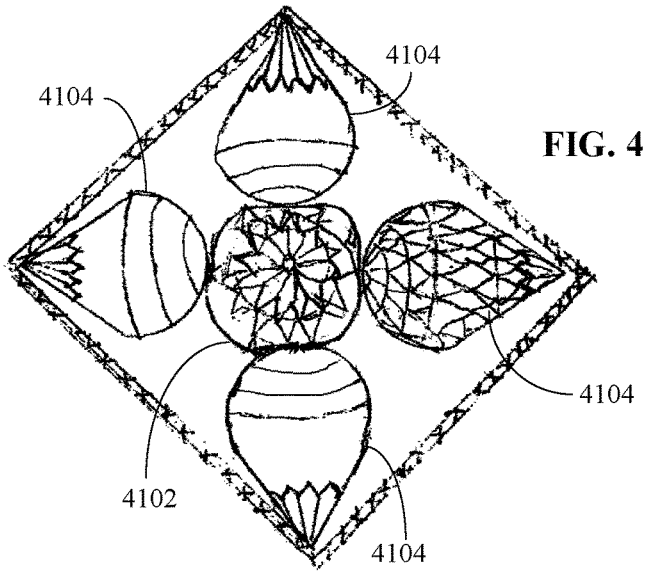
FIGS. 41A-41C illustrate views of of multiple spheroidal faceted gemstones in a pendent or broach according to one embodiment of the disclosure.
Figure 41B:
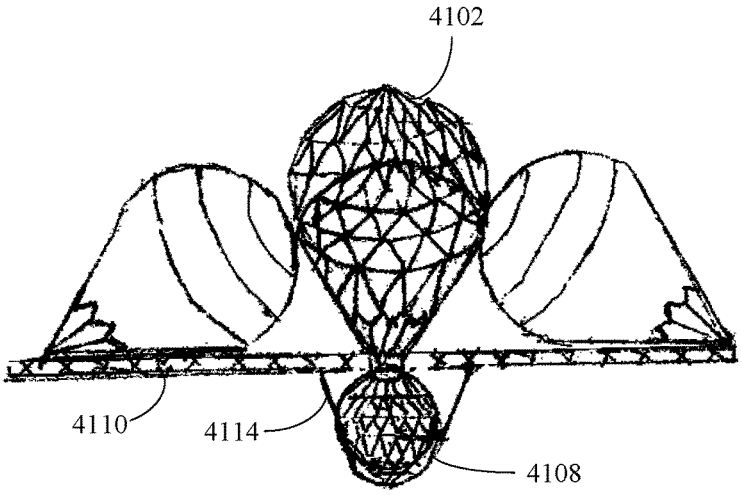
Figure 41C:
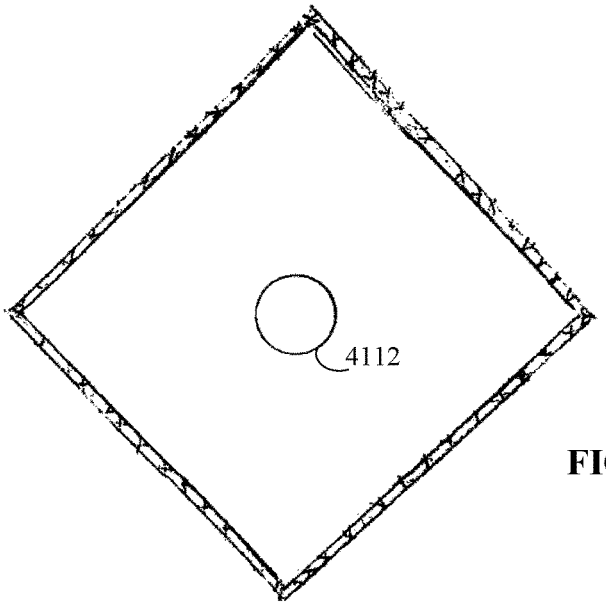

FIGS. 41A-41C illustrate views of multiple spheroidal faceted gemstones in a pendent or broach according to one embodiment of the disclosure, where FIG. 41A is a top view, FIG. 41B is a side view, and FIG. 41C is a bottom view. As shown, the diamond-shaped jewelry piece includes a central gemstone 4102 ("mother") and a plurality of "daughter" gemstones, including four gemstones 4104 arranged above an opaque surface 4110 of the pendent or broach. A fifth daughter gemstone 4108 is located below the opaque surface 4110, which also includes a hole 4112 to allow light to reach the gemstone 4108. In one implementation, a rounded cup (e.g., made from gold or other material) 4114 may secure the gemstone 4108 in the pendent or broach.

Figure 42A:
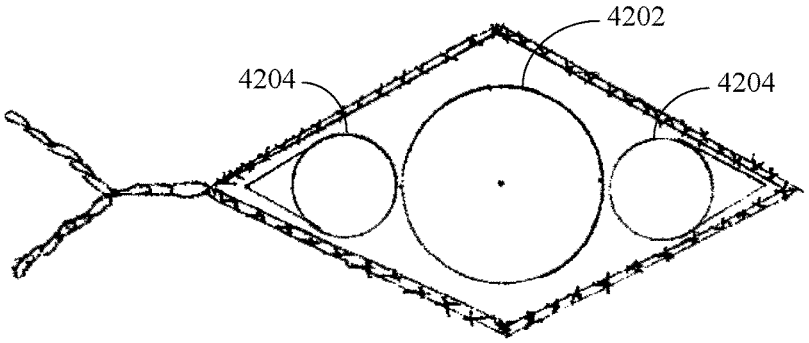
FIGS. 42A-42D illustrate various examples of multiple spheroidal faceted gemstones in a pendant or broach according to various embodiments of the disclosure.
Figure 42B:
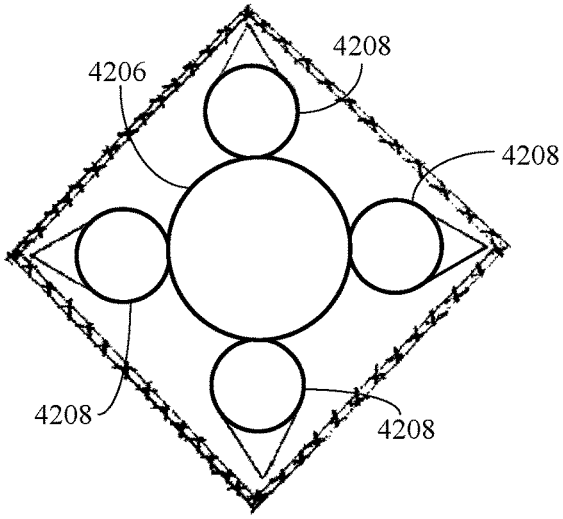
Figure 42C:
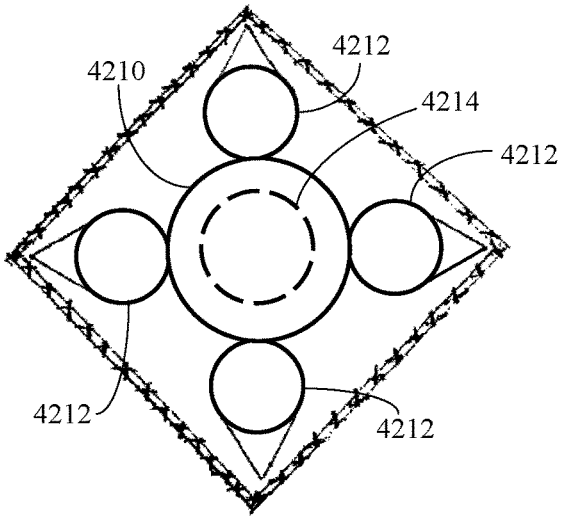
Figure 42D:
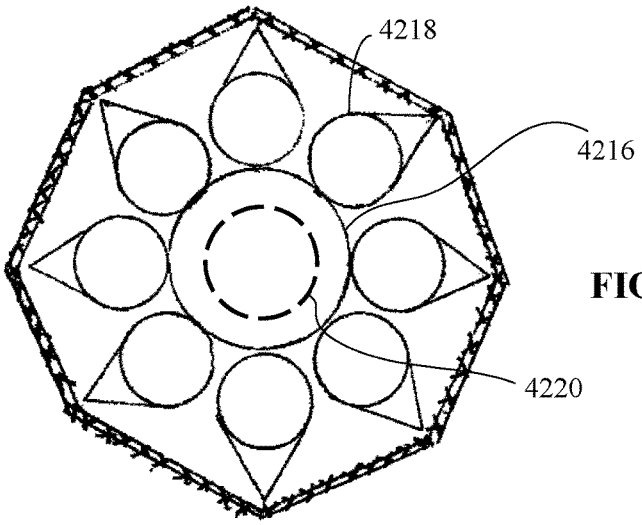

FIGS. 42A-42D illustrate various examples of multiple spheroidal faceted gemstones in a pendant or broach according to various embodiments of the disclosure. FIG. 42A includes a mother gemstone 4202 and two daughter gemstones 4204. FIG. 42B includes a mother gemstone 4206 and four daughter gemstones 4208. FIG. 42C includes a mother gemstone 4210 and five daughter gemstones, including four daughter gemstones 4212 above an opaque surface and one daughter gemstone 4214 below the opaque surface. FIG. 42D includes a mother gemstone 4216 and nine daughter gemstones, including eight daughter gemstones 4218 above an opaque surface and one daughter gemstone 4220 below the opaque surface.

According to various embodiments, the mother-daughter gemstones may rest on or against each other, or may be separated by a small distance (e.g., to avoid chipping). In some embodiments, metal prongs may secure the gemstones to the jewelry piece. The metal prongs of each gemstone's restraint may be secured to the ring, pendant, brooch, or gem cluster structure such that there is a free path of illumination, if possible, between mother(s) and daughter(s) for optical transfer of light, color, and other gem features between the gemstones. Various methods for affixing the gemstones in the jewelry piece are within the scope of the disclosure and can be determined on a case-by-case basis.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better understand the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A gemstone, comprising:

a top portion having a spheroidal shape at one end that approximates a semi-spherical surface terminating along a circular girdle; and a bottom portion having a frusto-conical shape defining a frusto-conical surface extending between a large base and a single base facet, the large base defined along the circular girdle and the single base facet disposed opposite the circular girdle at another end;

wherein the semi-spherical surface comprises a plurality of flat facets arranged in rows symmetrically around a centerpoint of the semi-spherical surface disposed on a plane defined by the circular girdle, wherein each facet of the plurality of flat facets has a different angle relative to the centerpoint, wherein the plurality of flat facets forms a shape that approximates the semi-spherical surface with an apex located on a longitudinal axis extending perpendicular to the plane defined by the circular girdle and intersecting said plane at the centerpoint;

wherein the single base facet is flat, wherein the single base facet is centered on the longitudinal axis, and wherein the single base facet extends perpendicularly relative to the longitudinal axis at a location opposite the apex relative to the plane defined by the circular girdle;

wherein a light axis of the gemstone is defined along the longitudinal axis and extends through the gemstone from the apex, through the centerpoint, and to the single base facet; and wherein an axial dimension of the bottom portion along the longitudinal axis between the centerpoint and the single base facet is equal to $$\frac{nD}{4(n-1)},$$

where n is an index of refraction of a material of the gemstone and D is a diameter dimension of the circular girdle.

2. The gemstone according to claim 1, wherein the flat facets are triangular, square, rectangular, diamond, octagonal, circular, or polygonal shaped.

3. The gemstone according to claim 1, wherein facets in rows that are closer to the circular girdle of the gemstone are larger in size than facets in rows that are further from the circular girdle of the gemstone.

4. The gemstone according to claim 1, wherein the top portion and the bottom portion include one or more facets, wherein the one or more facets are flat, convex, or concave.

5. The gemstone according to claim 1, wherein the bottom portion is formed from diamond-shaped facets.

6. The gemstone according to claim 5, wherein an exterior surface of the bottom portion includes diamond-shaped facets arranged adjacent to the single base facet, the diamond-shaped facets being elongated and smaller compared to corresponding diamond-shaped facets of the bottom portion adjacent to the circular girdle of the gemstone.

7. The gemstone according to claim 1, wherein the bottom portion of the gemstone includes one or more convex basins, wherein the one or more convex basins is/are located along an exterior surface of the bottom portion between the circular girdle and the single base facet located at the opposite end of the bottom portion away from the circular girdle.

8. The gemstone according to claim 1, wherein the gemstone has an index of refraction (n) that is 1.33 or greater.

9. The gemstone according to claim 1, wherein the material of the gemstone is selected from the group consisting of:

glass, marble, plastic, diamond, cubic zirconia, zircon, smoky quartz, any non-opaque natural or man-made gem material, and a solid non-gem material.

10. The gemstone according to claim 1, wherein the semi-spherical surface includes horizontal and/or vertical rounded bands or grooves.

11. The gemstone according to claim 1, wherein the top portion and the bottom portion are polished to a mirror-like finish.

12. The gemstone according to claim 1, wherein the the single base facet of the bottom portion includes an optic-ornamental design etched on the bottom portion of the gemstone, the optic ornamental design comprising a flower, a bird, an animal, a fish, a flag, a map, a picture, a letter, a number, a symbol, a word, a phrase, an emblem, one or more initials, a name, a country, a location, and/or a logo.

13. The gemstone according to claim 1, wherein the plurality of flat facets of the semi-spherical surface includes at least one hundred facets.

14. The gemstone according to claim 1, wherein the semi-spherical surface comprises the plurality of flat facets and a single rounded facet at the apex of the semi-spherical surface.

15. A jewelry piece, comprising:

a first gemstone; and a second gemstone disposed on a setting adjacent the first gemstone, wherein the first gemstone comprises:

a top portion having a spheroidal shape at one end that approximates a semi-spherical surface terminating along a circular girdle; and a bottom portion having a frusto-conical shape defining a frusto-conical surface extending between a large base and a single base facet, the large base defined along the circular girdle and the single base facet disposed opposite the circular girdle at another end;

wherein the semi-spherical surface comprises a plurality of flat facets arranged in rows symmetrically around a centerpoint of the semi-spherical surface disposed on a plane defined by the circular girdle, wherein each facet of the plurality of flat facets has a different angle relative to the centerpoint, wherein the plurality of flat facets forms a shape that approximates the semi-spherical surface with an apex located on a longitudinal axis extending perpendicular to the plane defined by the circular girdle and intersecting said plane at the centerpoint, wherein the single base facet is flat, wherein the single base facet is centered on the longitudinal axis, and wherein the single base facet extends perpendicularly relative to the longitudinal axis at a location opposite the apex relative to the plane defined by the circular girdle;

wherein a light axis of the first gemstone is defined along the longitudinal axis and extends through the first gemstone from the apex, through the centerpoint, and to the single base facet; and wherein an axial dimension of the jewelry piece along the longitudinal axis between the centerpoint of the semi-spherical surface of the first gemstone and a table of the second gemstone is equal to $$\frac{nD}{4(n-1)},$$

where n is an index of refraction of a material of the first gemstone and D is a diameter dimension of the circular girdle of the first gemstone.

16. The jewelry piece according to claim 15, wherein the second gemstone comprises a brilliant gemstone.

17. The jewelry piece according to claim 15, wherein the single base facet of the first gemstone is circular and has a diameter, and wherein the diameter of the single base facet of the first gemstone is less than or equal to a diameter of the table of the second gemstone.

18. A method for faceting a gemstone comprising:

shaping a top portion of the gemstone; and shaping a bottom portion of the gemstone; and wherein the top portion is shaped to have a spheroidal shape at one end that approximates a semi-spherical surface terminating along a circular girdle;

wherein the bottom portion is shaped to have a frusto-conical shape defining a frusto-conical surface extending between a large base and a single base facet, the large base defined along the circular girdle and the single base facet disposed opposite the circular girdle at another end;

wherein the semi-spherical surface comprises a plurality of flat facets arranged in rows symmetrically around a centerpoint of the semi-spherical surface disposed on a plane defined by the circular girdle, wherein each facet of the plurality of flat facets has a different angle relative to the centerpoint, wherein the plurality of flat facets forms a shape that approximates the semi-spherical surface with an apex located on a longitudinal axis extending perpendicular to the plane defined by the circular girdle and intersecting said plane at the centerpoint;

wherein the single base facet is flat, it is centered on the longitudinal axis, and it extends perpendicularly relative to the longitudinal axis at a location opposite the apex relative to the plane defined by the circular girdle, wherein a light axis of the gemstone is defined along the longitudinal axis and extends through the gemstone from the apex, through the centerpoint, and to the single base facet; and wherein an axial dimension of the bottom portion along the longitudinal axis between the centerpoint and the single base facet is equal to $$\frac{nD}{4(n-1)},$$

where n is an index of refraction of a material of the gemstone and D is a diameter dimension of the circular girdle.

* * * * *